US010607575B2

(12) United States Patent
Iwaki et al.

(10) Patent No.: US 10,607,575 B2
(45) Date of Patent: Mar. 31, 2020

(54) DISPLAY SYSTEM AND ELECTRONIC DEVICE

(71) Applicant: Semiconductor Energy Laboratory Co., Ltd., Atsugi-shi, Kanagawa-ken (JP)

(72) Inventors: Yuji Iwaki, Isehara (JP); Hideaki Okamoto, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 6 days.

(21) Appl. No.: 15/714,206

(22) Filed: Sep. 25, 2017

(65) Prior Publication Data

US 2018/0096670 A1 Apr. 5, 2018

(30) Foreign Application Priority Data

Sep. 30, 2016 (JP) ..... 2016-192889
Apr. 26, 2017 (JP) ..... 2017-086898

(51) Int. Cl.
*G09G 5/395* (2006.01)
*G09G 3/3225* (2016.01)
(Continued)

(52) U.S. Cl.
CPC ..... *G09G 5/395* (2013.01); *G09G 3/2007* (2013.01); *G09G 3/3225* (2013.01);
(Continued)

(58) Field of Classification Search
None
See application file for complete search history.

(56) References Cited

U.S. PATENT DOCUMENTS 6,714,268 B2 3/2004 Wang et al.
7,038,641 B2 5/2006 Hirota et al.
(Continued)

FOREIGN PATENT DOCUMENTS

CN 001403856 A 3/2003
CN 105122341 A 12/2015
(Continued)

OTHER PUBLICATIONS

Shieh.H, "Transflective display by Hybrid OLED and LCD", LEOS 2005 (IEEE Lasers and Electro-Optics Society Annual Meeting) , Oct. 22, 2005, pp. 650-651, IEEE.
(Continued)

*Primary Examiner* — Samira Monshi
(74) *Attorney, Agent, or Firm* — Robinson Intellectual Property Law Office; Eric J. Robinson

(57) ABSTRACT

A novel display system is provided. The display system includes a display portion and a control portion. The control portion includes a controller and a memory device. The display portion has a function of displaying an image. The controller has a function of outputting a signal for controlling a refresh rate of the image. The memory device has a function of storing data including data indicating a recognition state of the image and data on whether a flicker is recognized in the recognition state by a user or not. The controller has a function of changing the refresh rate of the image with reference to the data stored in the memory device when data on whether a flicker is recognized or not is input by the user.

16 Claims, 29 Drawing Sheets

(51) Int. Cl.

| | |
|---|---|
| ***G09G 3/20*** | (2006.01) |
| ***G09G 3/36*** | (2006.01) |
| ***G09G 5/00*** | (2006.01) |
| ***G09G 5/42*** | (2006.01) |

(52) U.S. Cl.

CPC ..... *G09G 3/3648* (2013.01); *G09G 5/006* (2013.01); *G09G 5/42* (2013.01); *G09G 2300/046* (2013.01); *G09G 2300/0452* (2013.01); *G09G 2310/0278* (2013.01); *G09G 2320/0209* (2013.01); *G09G 2320/0247* (2013.01); *G09G 2320/103* (2013.01); *G09G 2330/021* (2013.01); *G09G 2330/12* (2013.01); *G09G 2340/0435* (2013.01); *G09G 2340/06* (2013.01); *G09G 2360/18* (2013.01); *G09G 2380/02* (2013.01)

(56) References Cited

U.S. PATENT DOCUMENTS

| | | | | |
|---|---|---|---|---|
| 7,084,936 | B2 | 8/2006 | Kato | |
| 7,102,704 | B2 | 9/2006 | Mitsui et al. | |
| 7,176,991 | B2 | 2/2007 | Mitsui et al. | |
| 7,239,361 | B2 | 7/2007 | Kato | |
| 7,248,235 | B2 | 7/2007 | Fujii et al. | |
| 7,385,654 | B2 | 6/2008 | Mitsui et al. | |
| 7,674,650 | B2 | 3/2010 | Akimoto et al. | |
| 7,732,819 | B2 | 6/2010 | Akimoto et al. | |
| 7,910,490 | B2 | 3/2011 | Akimoto et al. | |
| 7,932,521 | B2 | 4/2011 | Akimoto et al. | |
| 8,274,077 | B2 | 9/2012 | Akimoto et al. | |
| 8,466,463 | B2 | 6/2013 | Akimoto et al. | |
| 8,629,069 | B2 | 1/2014 | Akimoto et al. | |
| 8,669,550 | B2 | 3/2014 | Akimoto et al. | |
| 8,790,959 | B2 | 7/2014 | Akimoto et al. | |
| 8,796,069 | B2 | 8/2014 | Akimoto et al. | |
| 9,099,562 | B2 | 8/2015 | Akimoto et al. | |
| 2003/0052869 | A1 | 3/2003 | Fujii et al. | |
| 2003/0201960 | A1 | 10/2003 | Fujieda | |
| 2004/0165084 | A1* | 8/2004 | Yamamoto | H04N 5/2351 348/226.1 |
| 2006/0072047 | A1 | 4/2006 | Sekiguchi | |
| 2007/0236432 | A1* | 10/2007 | Benjamin | G09G 3/3648 345/87 |
| 2008/0180618 | A1 | 7/2008 | Fujieda | |
| 2008/0308805 | A1 | 12/2008 | Akimoto et al. | |
| 2010/0171905 | A1 | 7/2010 | Huang et al. | |
| 2011/0104851 | A1 | 5/2011 | Akimoto et al. | |
| 2011/0121290 | A1 | 5/2011 | Akimoto et al. | |
| 2015/0287352 | A1* | 10/2015 | Watanabe | G09G 3/20 345/89 |
| 2015/0340513 | A1 | 11/2015 | Akimoto et al. | |
| 2016/0086557 | A1 | 3/2016 | Watanabe et al. | |
| 2018/0018752 | A1 | 1/2018 | Kurokawa | |
| 2018/0040285 | A1* | 2/2018 | Sakurai | G09G 3/3648 |

FOREIGN PATENT DOCUMENTS

| | | | |
|---|---|---|---|
| JP | 2001-066593 | A | 3/2001 |
| JP | 2002-196702 | A | 7/2002 |
| JP | 2002-281294 | A | 9/2002 |
| JP | 2002-328630 | A | 11/2002 |
| JP | 2003-076302 | A | 3/2003 |
| JP | 2003-157026 | A | 5/2003 |
| JP | 2003-157029 | A | 5/2003 |
| JP | 2003-228304 | A | 8/2003 |
| JP | 2003-316295 | A | 11/2003 |
| JP | 2003-322850 | A | 11/2003 |
| JP | 2004-296162 | A | 10/2004 |
| JP | 2007-096055 | A | 4/2007 |
| JP | 2007-123861 | A | 5/2007 |
| JP | 2007-232882 | A | 9/2007 |
| JP | 4161574 | B2 | 10/2008 |
| JP | 2010-197597 | A | 9/2010 |
| JP | 2013-221965 | A | 10/2013 |
| JP | 2014-211537 | A | 11/2014 |
| KR | 2003-0022049 | A | 3/2003 |
| TW | 588185 | | 5/2004 |
| WO | WO-2004-053819 | A | 6/2004 |
| WO | WO-2014/171323 | | 10/2014 |
| WO | WO-2016/031659 | | 3/2016 |

OTHER PUBLICATIONS

Lee.J et al., "High ambient-contrast-ratio display using tandem reflective liquid crystal display and organic light-emitting device", Optics Express, Nov. 14, 2005, vol. 13, No. 23, pp. 9431-9438.

International Search Report (Application No. PCT/IB2017/055749) dated Dec. 19, 2017.

Written Opinion (Application No. PCT/IB2017/055749) dated Dec. 19, 2017.

* cited by examiner

DISPLAY SYSTEM AND ELECTRONIC DEVICE

TECHNICAL FIELD

One embodiment of the present invention relates to a semiconductor device, a display system, and an electronic device.

Note that one embodiment of the present invention is not limited to the above technical field. Examples of the technical field of one embodiment of the present invention disclosed in this specification and the like include a semiconductor device, a display device, a light-emitting device, a power storage device, a memory device, a display system, an electronic device, a lighting device, an input device, an input/output device, a driving method thereof, and a manufacturing method thereof.

The "semiconductor device" in this specification and the like means all devices which can operate by utilizing semiconductor characteristics. A transistor, a semiconductor circuit, an arithmetic device, a memory device, and the like are each an embodiment of the semiconductor device. In addition, an imaging device, an electro-optical device, a power generation device (e.g., a thin film solar cell and an organic thin film solar cell), and an electronic device each may include a semiconductor device.

BACKGROUND ART

Flat panel displays typified by liquid crystal display devices and light-emitting display devices are widely used for displaying images. Although the transistors used in these display devices are mainly manufactured using silicon semiconductors, attention has been drawn to a technique in which a metal oxide exhibiting semiconductor characteristics is used for transistors instead of a silicon semiconductor in recent years. For example, in Patent Documents 1 and 2, a technique is disclosed in which a transistor manufactured using zinc oxide or an In—Ga—Zn-based oxide for a semiconductor layer is used in a pixel of a display device.

REFERENCE

Patent Document

[Patent Document 1] Japanese Published Patent Application No. 2007-96055

[Patent Document 2] Japanese Published Patent Application No. 2007-123861

DISCLOSURE OF INVENTION

An object of one embodiment of the present invention is to provide a novel semiconductor device or display system. Another object of one embodiment of the present invention is to provide a semiconductor device or display system which has low power consumption. Another object of one embodiment of the present invention is to provide a semiconductor device or display system capable of displaying an image with high visibility. Another object of one embodiment of the present invention is to provide a semiconductor device or display system which is operated easily.

One embodiment of the present invention does not necessarily achieve all the objects listed above and only needs to achieve at least one of the objects. The description of the above objects does not preclude the existence of other objects. Other objects will be apparent from and can be derived from the description of the specification, the drawings, the claims, and the like.

A display system of one embodiment of the present invention includes a display portion and a control portion. The control portion includes a controller and a memory device. The display portion has a function of displaying an image. The controller has a function of outputting a signal for controlling a refresh rate of the image. The memory device has a function of storing data including data indicating a recognition state of the image and data on whether a flicker is recognized in the recognition state by a user or not. The controller has a function of changing the refresh rate of the image with reference to the data stored in the memory device when data on whether a flicker is recognized or not is input by the user.

In the display system of one embodiment of the present invention, the control portion may include a counter. The counter may have a function of counting time during which the image is continuously displayed at a specific refresh rate. The controller may have a function of predicting a refresh rate at which a flicker is not recognized by comparing the time counted by the counter and the data stored in the memory device.

A display system of one embodiment of the present invention includes a display portion and a control portion. The control portion includes a controller. The display portion has a function of displaying an image. The controller includes a neural network. The neural network has a function of making an inference when data on whether a flicker is recognized or not is input to the controller by a user. Data including data on a recognition state of the image and data on whether a flicker is recognized in the recognition state by the user or not is input to an input layer of the neural network. A refresh rate at which a flicker is not recognized is output from an output layer of the neural network.

In the display system of one embodiment of the present invention, the control portion may include a counter. The counter may have a function of counting time during which the image is continuously displayed at a specific refresh rate. The data on the recognition state may include data indicating time counted by the counter.

In the display system of one embodiment of the present invention, the data indicating the recognition state may include at least one of data indicating a user who recognizes the image, data indicating time during which the image is recognized, and data indicating a content of the image.

In the display system of one embodiment of the present invention, the display portion may include a pixel including a first display element and a second display element. The selection/non-selection state of the pixel may be controlled by a transistor including a metal oxide in a channel formation region.

The display system of one embodiment of the present invention may further include an input portion. The input portion may have a function of detecting data on whether a flicker is recognized by the user or not and outputting the data to the controller.

An electronic device of one embodiment of the present invention includes the display system. As the input portion, an operation button, a touch sensor, a speaker, or a microphone is used.

According to one embodiment of the present invention, a novel semiconductor device or display system can be provided. According to one embodiment of the present invention, a semiconductor device or display system which has low power consumption can be provided. According to one embodiment of the present invention, a semiconductor device or display system capable of displaying an image with high visibility can be provided. According to one embodiment of the present invention, a semiconductor device or display system which is operated easily can be provided.

Note that the description of these effects does not preclude the existence of other effects. One embodiment of the present invention does not necessarily have all of these effects. Other effects will be apparent from and can be derived from the description of the specification, the drawings, the claims, and the like.

BRIEF DESCRIPTION OF DRAWINGS

FIGS. 14A and 14B1 to 14B3 illustrate configuration examples of a memory device.

FIGS. 20A and 20B1 to 20B4 illustrate configuration examples of a display device.

BEST MODE FOR CARRYING OUT THE INVENTION

Figure 1:
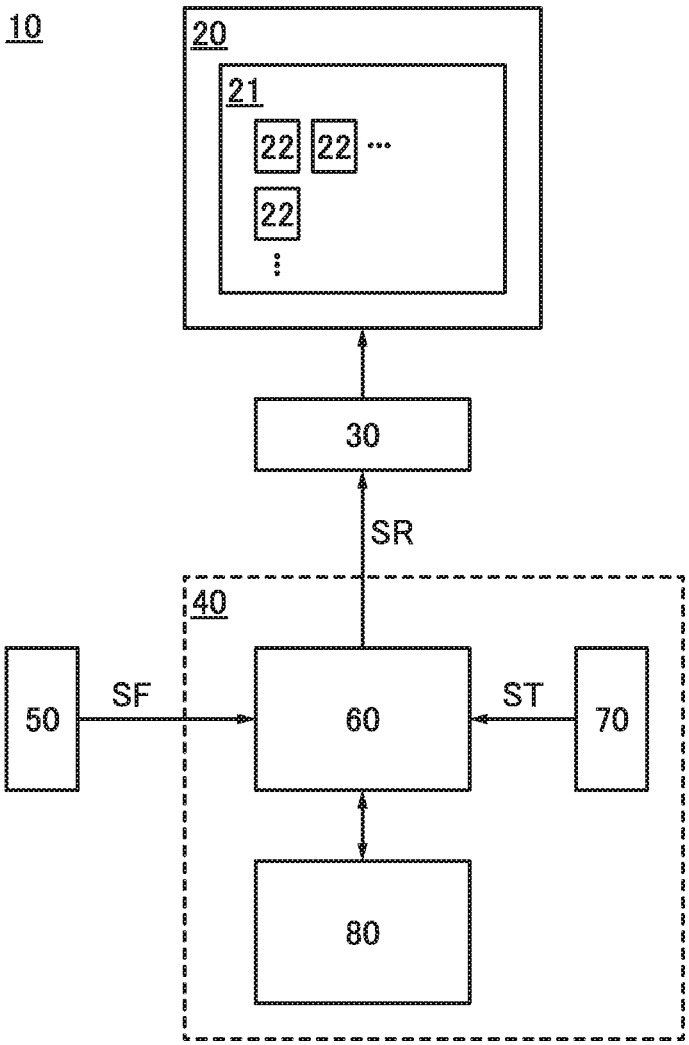
FIG. 1 illustrates a configuration example of a display system.

Embodiments of the present invention will be described below in detail with reference to the accompanying drawings. Note that one embodiment of the present invention is not limited to the following description and it is easily understood by those skilled in the art that the mode and details can be variously changed without departing from the scope and spirit of the present invention. Therefore, the present invention should not be interpreted as being limited to the description of the embodiments below.

One embodiment of the present invention includes, in its category, devices such as a semiconductor device, a memory device, a display device, an imaging device, and a radio frequency (RF) tag. The display devices include, in its category, liquid crystal display devices, light-emitting devices having pixels each provided with a light-emitting element typified by an organic light-emitting element, electronic paper, digital micromirror devices (DMDs), plasma display panels (PDPs), field emission displays (FEDs), and the like.

In this specification and the like, a metal oxide means an oxide of metal in a broad sense. Metal oxides are classified into an oxide insulator, an oxide conductor (including a transparent oxide conductor), an oxide semiconductor (also simply referred to as an OS), and the like. For example, a metal oxide used in a channel formation region of a transistor is called an oxide semiconductor in some cases. That is to say, a metal oxide that has at least one of an amplifying function, a rectifying function, and a switching function can be called a metal oxide semiconductor, or OS for short. In the following description, a transistor including a metal oxide in a channel formation region is also referred to as an OS transistor.

In this specification and the like, a metal oxide including nitrogen is also called a metal oxide in some cases. Moreover, a metal oxide including nitrogen may be called a metal oxynitride. The details of a metal oxide are described later.

Furthermore, in this specification and the like, an explicit description "X and Y are connected" means that X and Y are electrically connected, X and Y are functionally connected, and X and Y are directly connected. Accordingly, without limitation to a predetermined connection relation, for example, a connection relation shown in drawings or text, another connection relation is included in the drawings or the text. Here, X and Y each denote an object (e.g., a device, an element, a circuit, a wiring, an electrode, a terminal, a conductive film, or a layer).

Examples of the case where X and Y are directly connected include the case where an element that allows an electrical connection between X and Y (e.g., a switch, a transistor, a capacitor, an inductor, a resistor, a diode, a display element, a light-emitting element, and a load) is not connected between X and Y, and the case where X and Y are connected without the element that allows the electrical connection between X and Y provided therebetween.

For example, in the case where X and Y are electrically connected, one or more elements that enable an electrical connection between X and Y (e.g., a switch, a transistor, a capacitor, an inductor, a resistor, a diode, a display element, a light-emitting element, or a load) can be connected between X and Y. Note that the switch is controlled to be turned on or off. That is, the switch is turned on or off to determine whether current flows therethrough or not. Alternatively, the switch has a function of selecting and changing a current path. Note that the case where X and Y are electrically connected includes the case where X and Y are directly connected.

For example, in the case where X and Y are functionally connected, one or more circuits that enable functional connection between X and Y (e.g., a logic circuit such as an inverter, a NAND circuit, or a NOR circuit; a signal converter circuit such as a DA converter circuit, an AD converter circuit, or a gamma correction circuit; a potential level converter circuit such as a power source circuit (e.g., a step-up converter or a step-down converter) or a level shifter circuit for changing the potential level of a signal; a voltage source; a current source; a switching circuit; an amplifier circuit such as a circuit that can increase signal amplitude, the amount of current, or the like, an operational amplifier, a differential amplifier circuit, a source follower circuit, or a buffer circuit; a signal generation circuit; a memory circuit; and/or a control circuit) can be connected between X and Y. For example, even when another circuit is interposed between X and Y, X and Y are functionally connected if a signal output from X is transmitted to Y. Note that the case where X and Y are functionally connected includes the case where X and Y are directly connected and the case where X and Y are electrically connected.

Note that in this specification and the like, an explicit description "X and Y are electrically connected" means that X and Y are electrically connected (i.e., the case where X and Y are connected with another element or another circuit provided therebetween), X and Y are functionally connected (i.e., the case where X and Y are functionally connected with another circuit provided therebetween), and X and Y are directly connected (i.e., the case where X and Y are connected without another element or another circuit provided therebetween). That is, in this specification and the like, the explicit description "X and Y are electrically connected" is the same as the description "X and Y are connected".

Note that components denoted by the same reference numerals in different drawings represent the same components, unless otherwise specified.

Even when independent components are electrically connected to each other in the drawing, one component has functions of a plurality of components in some cases. For example, when part of a wiring also functions as an electrode, one conductive film functions as the wiring and the electrode. Thus, "electrical connection" in this specification includes in its category such a case where one conductive film has functions of a plurality of components.

Embodiment 1

In this embodiment, a semiconductor device and a display system of one embodiment of the present invention are described.

<Configuration Example of Display System>

FIG. 1 illustrates a configuration example of a display system 10. The display system 10 includes a display portion 20, a driver portion 30, a control portion 40, and an input portion 50. The display system 10 has a function of displaying an image on the display portion 20 and a function of controlling the frequency at which an image displayed on the display portion 20 is updated (hereinafter also referred to as a "refresh rate") with the control portion 40.

The display portion 20 has a function of displaying an image. The display portion 20 includes a pixel portion 21 including a plurality of pixels 22. The pixels 22 each include a display element. The pixels 22 each display a predetermined gray level, whereby the pixel portion 21 displays a predetermined image.

Examples of the display element in the pixel 22 include a liquid crystal element and a light-emitting element. As the liquid crystal element, a transmissive liquid crystal element, a reflective liquid crystal element, a transflective liquid crystal element, or the like can be used. Alternatively, for example, a micro electro mechanical systems (MEMS) shutter element, an optical interference type MEMS element, or a display element using a microcapsule method, an electrophoretic method, an electrowetting method, an Electronic Liquid Powder (registered trademark) method, or the like can be used as the display element. Examples of the light-emitting element include a self-luminous element such as an organic light-emitting diode (OLED), a light-emitting diode (LED), a quantum-dot light-emitting diode (QLED), and a semiconductor laser.

Note that the pixel 22 may include a plurality of display elements having different kinds or different characteristics. A configuration example of the display portion 20 including a plurality of display elements in each of the pixels 22 is described in detail in Embodiment 4.

An OS transistor is preferably used in the pixel 22. A metal oxide has a larger energy gap and a lower minority carrier density than a semiconductor such as silicon; thus, the off-state current of an OS transistor is extremely low. Accordingly, in the case where an OS transistor is used in the pixel 22, a variation in voltage applied to a display element can be significantly suppressed as compared with the case where a transistor including silicon in a channel formation region (hereinafter also referred to as a Si transistor) is used, for example, so that the gray level of the pixel 22 can be held for a long period. A circuit configuration of the pixel 22 including an OS transistor is described in detail in Embodiment 3.

The driver portion 30 has a function of controlling operation of the display portion 20. Specifically, the driver portion 30 has a function of supplying a signal corresponding to an image displayed on the display portion 20 (hereinafter also referred to as an image signal), a signal for controlling a timing at which an image displayed on the display portion 20 is updated (hereinafter also referred to as a timing signal), and the like. The display portion 20 displays a predetermined image on the pixel portion 21 on the basis of an image signal and a timing signal supplied from the driver portion 30.

A timing signal output from the driver portion 30 to the display portion 20 is controlled, whereby a timing at which an image signal is supplied to the pixel portion 21 can be controlled. Thus, a refresh rate of an image displayed on the display portion 20 is controlled. Here, when the refresh rate is reduced, the frequency of generation of an image signal and the frequency of supply of an image signal can be reduced, so that power consumption can be reduced. However, when the refresh rate becomes less than or equal to a predetermined value, a flicker is caused on an image displayed on the display portion 20.

Generation of a flicker brings discomfort to a user who recognizes an image. In the case where an image of a game is displayed on the display portion 20, for example, a movement of a character or an object in the game is less likely to be recognized because of a flicker, possibly resulting in an operation error. Also in the case where a moving image such as a movie or a television program or a still image such as a picture is displayed on the display portion 20, an image is distorted by a flicker, and thus stress the user feels when recognizing the image is increased. Furthermore, generation of a flicker is a cause of eye fatigue, which may hinder the user from recognizing an image for a long time. As the eye fatigue is accumulated because of generation of a flicker, the user is more likely to recognize a flicker and more unlikely to recognize an image. Therefore, the refresh rate is preferably set in a range where a flicker is not recognized by the user.

However, the refresh rate at which a flicker is recognized (the flicker value) varies between individuals. The flicker value tends to be low as the fatigue of the user is accumulated and might vary depending on time during which the user continues to recognize an image, a content of an image the user recognizes, the constitution of the user, and the like. Accordingly, in order to suppress generation of a flicker in a variety of states where the display portion 20 is used, the refresh rate needs to be increased in accordance with a state where a flicker is most likely to be recognized, resulting in an increase in power consumption. In the case where the refresh rate is changed to an appropriate value depending on states, the user needs to manually and periodically input a specific refresh rate at which a flicker is not recognized, resulting in a complicated operation.

The display system 10 of one embodiment of the present invention includes the control portion 40 which can actively set a refresh rate of an image displayed on the display portion 20 in accordance with a state where an image is recognized (hereinafter also referred to as a recognition state), such as a user who recognizes an image, time during which an image is recognized, a content of an image, or the like. Specifically, the control portion 40 includes a memory device which accumulates data on whether a flicker is recognized in a specific recognition state or not. By referring to data accumulated in the memory device, the control portion 40 predicts a range of a refresh rate at which a flicker is not recognized in the current recognition state. Thus, it is possible to reduce the refresh rate in a range where a flicker is not recognized in accordance with the recognition state even when a value of a specific refresh rate is not specified by the user. Accordingly, the visibility of an image can be improved, and power consumption can be reduced. A configuration example of the control portion 40 is described below.

The control portion 40 has a function of changing a refresh rate of an image displayed on the display portion 20. Specifically, the control portion 40 has a function of supplying a control signal to the driver portion 30 to control output of a timing signal generated by the driver portion 30. Thus, the frequency at which an image signal is supplied to the pixel portion 21 is controlled, and thus the refresh rate is controlled. The control portion 40 includes a controller 60, a counter 70, and a memory device 80.

The controller 60 has a function of outputting a signal SR corresponding to a predetermined refresh rate to the driver portion 30. When the signal SR is input to the driver portion 30, the driver portion 30 generates a timing signal corresponding to the signal SR and outputs the timing signal to the display portion 20. Thus, the refresh rate of an image displayed on the display portion 20 is controlled.

The counter 70 has a function of counting time during which an image is continuously displayed on the display portion 20 at a specific refresh rate. A signal indicating time counted by the counter 70 is output to the controller 60 as a signal ST.

Note that the counter 70 may have a function of counting time during which an image is continuously displayed on the display portion 20 at a specific refresh rate for each user or each content of an image (e.g., each moving image or each still image). Moreover, the counter 70 may have a function of counting the total time during which an image is continuously displayed on the display portion 20.

A signal SF corresponding to data on whether the user recognizes a flicker or not is input from the input portion 50 to the controller 60. The input portion 50 has a function of detecting data on whether the user recognizes a flicker or not to output the data to the controller 60. In recognizing an image displayed on the display portion 20, the user inputs, to the input portion 50, data on whether he/she recognizes a flicker or not. When the user inputs data on whether he/she recognizes a flicker or not, the input portion 50 outputs the signal SF to the controller 60.

It is possible to freely use, as the input portion 50, an interface to which data on whether the user recognizes a flicker or not can be input. For example, as the input portion 50, a touch sensor, a voice sensor, an image sensor, an infrared ray sensor for detecting an infrared ray emitted from a remote controller, an operation button, or the like can be used. Note that the input portion 50 may be provided for the display portion 20.

The memory device 80 has a function of storing data on conditions under which a flicker is recognized. Specifically, the memory device 80 has a function of storing data on whether a flicker is recognized or not in the case where an image is displayed at a specific refresh rate in a specific recognition state. For example, the memory device 80 can store a plurality of sets of data on whether generation of a flicker is recognized or not when the user recognized an image displayed on the display portion 20 at a specific refresh rate during specific time in the past. The data stored in the memory device 80 is output to the controller 60 when the controller 60 controls the refresh rate.

When the signal SF, the signal ST, and the data stored in the memory device 80 are input to the controller 60, the controller 60 controls the refresh rate of an image displayed on the display portion 20. Specifically, by referring to the data stored in the memory device 80, the controller 60 predicts a range of a refresh rate at which a flicker is not recognized in the current recognition state and sets a refresh rate in the range.

In the case where the signal SF indicates that a flicker is not recognized, for example, the controller 60 maintains or reduces the refresh rate. In the case where the refresh rate is reduced, by referring to the data stored in the memory device 80, the controller 60 reduces the refresh rate in a range where a flicker is predicted not to be recognized in the current recognition state. In contrast, in the case where the signal SF indicates that a flicker is recognized, by referring to the data stored in the memory device 80, the controller 60 increases the refresh rate to a value at which a flicker is predicted not to be recognized in the current recognition state.

A refresh rate at which a flicker is not recognized can be predicted in such a manner that the current recognition state and the recognition state stored in the memory device 80 are compared with each other. For example, time indicated by the signal ST can be compared with time during which an image is recognized, which is included in data indicating the recognition state stored in the memory device 80. In the case where a flicker is more likely to be recognized in the current recognition state than in the recognition state when a flicker was recognized in the past, which is stored in the memory device 80 (in the case where time during which an image is recognized in the current recognition state is longer than that in the recognition state when a flicker was recognized in the past), the display portion 20 is operated at a refresh rate having a value higher than the refresh rate stored in the memory device 80. In contrast, in the case where a flicker is less likely to be recognized in the current recognition state than in the recognition state when a flicker was not recognized in the past, which is stored in the memory device 80 (in the case where time during which an image is recognized in the current recognition state is shorter than that in the recognition state when a flicker was recognized in the past), the display portion 20 is operated at a refresh rate having a value lower than the refresh rate stored in the memory device 80.

Note that classification of the recognition states stored in the memory device 80 can be set freely. For example, the memory device 80 can store data on whether generation of a flicker is recognized or not when the user recognizes an image including a specific content at a specific fresh rate during specific time for each user. When the recognition states stored in the memory device 80 are subdivided in this manner, a refresh rate at which a flicker is not recognized can be predicted more precisely. Comparison of recognition states may be performed using some or all of the items of the recognition states stored in the memory device 80.

In addition, when the signal SF is input, the controller 60 has a function of outputting, to the memory device 80, data on whether a flicker is recognized or not and data indicating the recognition state at that time. When the signal SF indicating that a flicker is not recognized is input to the controller 60, for example, the controller 60 can output, to the memory device 80, a signal indicating the current refresh rate and time during which an image is continuously displayed on the display portion 20 at the refresh rate, as one of recognition states where a flicker is not recognized. Thus, every time the user inputs data on whether a flicker is recognized or not, data on the relationship between a recognition state and a flicker is stored in the memory device 80, so that the accuracy of prediction of a refresh rate by the controller 60 can be improved.

Note that the memory device 80 is preferably formed using an OS transistor. When the memory device 80 is formed using an OS transistor, even in a period during which power supply to the memory device 80 is stopped, data on the relationship between a recognition state and a flicker can be held. Accordingly, after power supply is restarted, data stored before the power supply is stopped can be used for prediction of a refresh rate. The memory device 80 formed using an OS transistor is described in detail in Embodiment 3.

In the above manner, in one embodiment of the present invention, even in the case where the user does not specify a refresh rate, the control portion 40 can predict a refresh rate at which a flicker is not recognized, with reference to data stored in the memory device 80, and change the refresh rate actively. Thus, image display at a refresh rate capable of improving the visibility and reducing power consumption can be performed by simple operation. Since the control portion 40 can store data indicating the relationship between a recognition state and a flicker in the memory device 80 every time the user inputs data on whether a flicker is recognized or not, as the user uses the display portion 20 for a longer time, the accuracy of prediction of a refresh rate can be improved.

Note that the display portion 20, the driver portion 30, the control portion 40, and the input portion 50 can be each formed using a semiconductor device. In this case, the display portion 20, the driver portion 30, the control portion 40, and the input portion 50 can also be referred to as a semiconductor device 20, a semiconductor device 30, a semiconductor device 40, and a semiconductor device 50, respectively. The display system 10 including the display portion 20, the driver portion 30, the control portion 40, and the input portion 50 each formed using a semiconductor device can also be referred to as a semiconductor device 10.

<Operation Example of Display System>

Figure 2A:
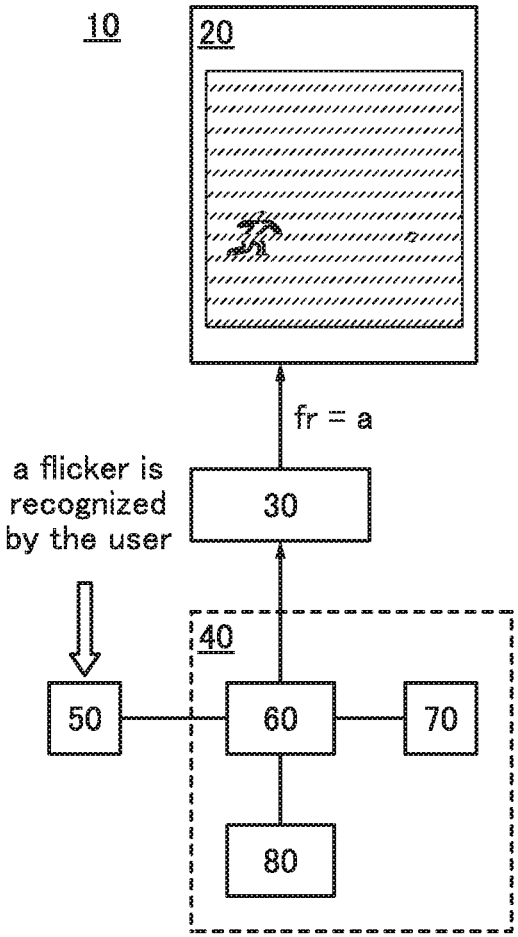
FIGS. 2A and 2B illustrate an operation example of a display system.
Figure 2B:
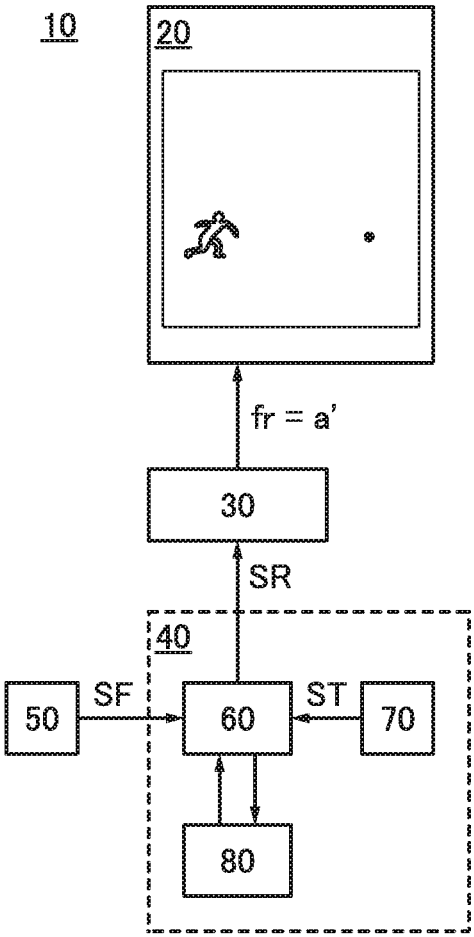

Next, an operation example of the above-described display system 10 is described. FIGS. 2A and 2B illustrate an operation example of the display system 10 when it changes the refresh rate.

First, as illustrated in FIG. 2A, the case where an image is displayed on the display portion 20 at a refresh rate of fr=a[Hz] specified by the control portion 40 is described. FIG. 2A illustrates a state where a flicker is recognized by the user recognizing an image displayed on the display portion 20. At this time, the user inputs, to the input portion 50, data indicating that a flicker is recognized spontaneously or in accordance with a request from the display system 10.

When the data indicating that a flicker is recognized is input to the input portion 50, as illustrated in FIG. 2B, the signal SF is output from the input portion 50 to the controller 60. Furthermore, the signal ST corresponding to time during which the image is displayed at the refresh rate of fr=a is output from the counter 70 to the controller 60.

Then, the controller 60 selects a refresh rate of fr=a'[Hz] at which a flicker is predicted not to be recognized, on the basis of the signals SF and ST. As described above, selection of the refresh rate is performed with reference to data stored in the memory device 80. Then, the signal SR corresponding to the refresh rate of fr=a' is output from the controller 60 to the driver portion 30. Thus, the refresh rate of the image displayed on the display portion 20 is changed to the refresh rate a', so that a flicker on the display portion 20 is not recognized by the user.

Note that in the case where a flicker keeps being recognized even after the refresh rate is changed, the user may input again, to the input portion 50, data indicating that a flicker is recognized so that the refresh rate is further changed.

As one of the recognition states where a flicker is recognized, the controller 60 stores, in the memory device 80, data indicating the refresh rate when the signal SF is input and the time during which an image is displayed on the display portion 20 at the refresh rate. Thus, data indicating the relationship between the recognition state and a flicker is stored in the memory device 80.

Figure 3A:
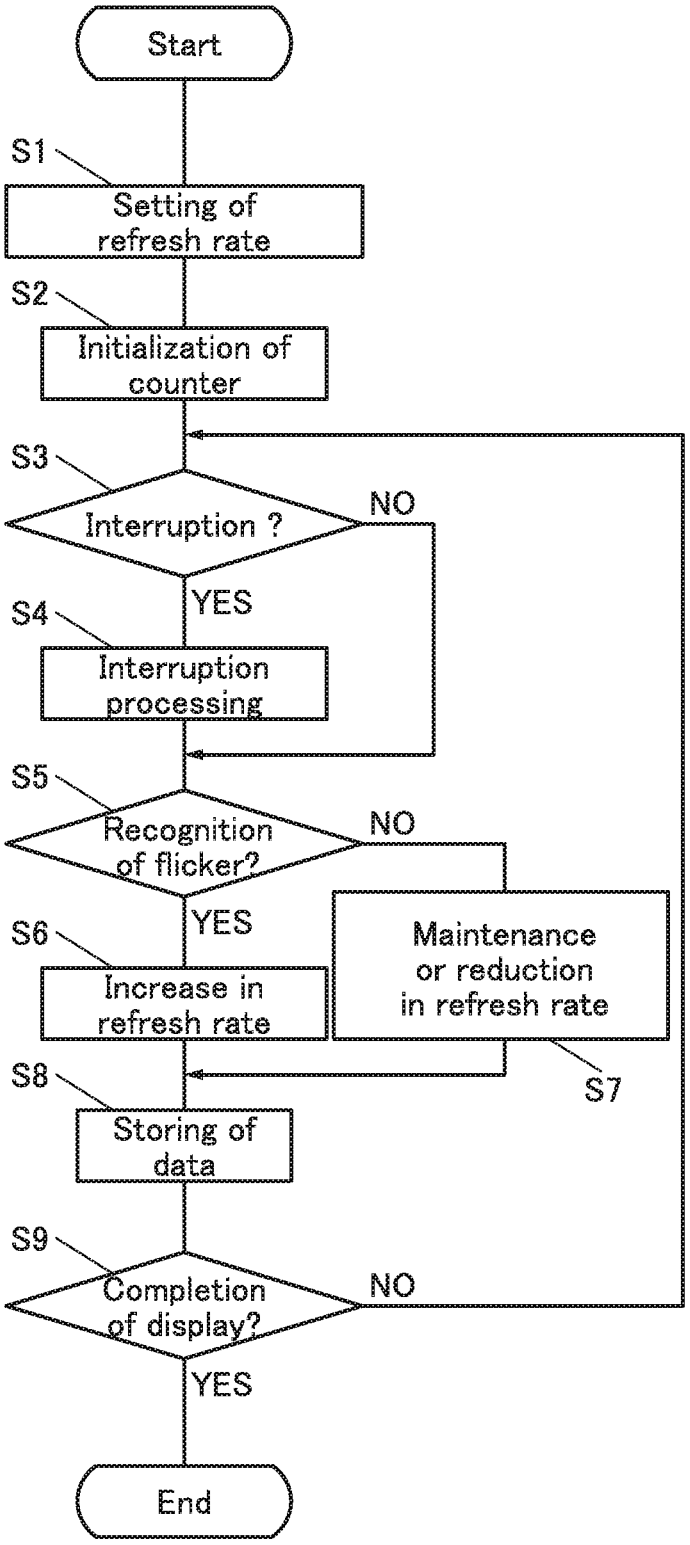
FIGS. 3A and 3B show a flow chart.

Next, a more specific operation example of the display system 10 is described. FIG. 3A is a flow chart showing an operation example of the display system 10.

First, when image display on the display portion 20 is started, an initial value of a refresh rate is set (Step S1). The initial value of the refresh rate may be set uniformly regardless of the recognition state of the image or may be determined with reference to data stored in the memory device 80. Next, a value of the counter 70 is initialized (Step S2), and counting of time during which an image is displayed at the refresh rate set in Step S1 is started.

Next, whether there is an interruption or not is determined (Step S3). The interruption is a processing through which the refresh rate is changed in accordance with time during which an image is displayed on the display portion 20 regardless of whether the user inputs data on whether a flicker is recognized or not. As described above, as time during which an image is recognized becomes longer and the fatigue of the user is accumulated, the flicker value tends to be low. Therefore, the refresh rate is increased when time during which an image is displayed reaches a certain value, whereby generation of a flicker can be prevented.

The time during which an image is displayed can be counted by the counter 70. Note that counted time may be the total time during which an image is continuously displayed or the time during which an image is continuously displayed at a specific refresh rate.

Figure 3B:
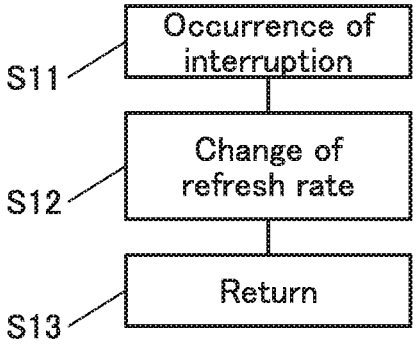

When an interruption occurs ("YES" in Step S3), an interrupt processing is performed (Step S4). FIG. 3B shows the content of the interrupt processing. In detecting occurrence of interruption (Step S11), the control portion 40 changes the refresh rate in accordance with time during which an image is displayed (Step S12). After that, the interrupt processing is completed, and the operation of the control portion 40 returns to the flow shown in FIG. 3A (Step S13).

Next, whether a flicker is recognized by the user or not is checked (Step S5). The confirmation of whether a flicker is recognized or not may be performed at a given timing by the user or in accordance with a request of confirmation, which is made by the display system 10. As a method for requesting the user to confirm whether a flicker is recognized or not, a method in which a message urging the user to confirm whether a flicker is recognized or not is displayed on the display portion 20, a method in which a confirmation button is displayed on the display portion 20, or the like can be used. Note that in the case where a confirmation button is displayed on the display portion 20, a touch panel provided for the display portion 20 can be used as the input portion 50, for example.

In the case where a flicker is recognized by the user ("YES" in Step S5), the control portion 40 increases the refresh rate to a value with which a flicker is predicted not to be recognized in the current recognition state (Step S6). In contrast, in the case where a flicker is not recognized by the user ("NO" in Step S5), the control portion 40 maintains or reduces the refresh rate (Step S7). In the case where the refresh rate is reduced, the control portion 40 sets the refresh rate in a range where a flicker is predicted not to be recognized.

As described above, the refresh rate is changed in such a manner that the controller 60 determines the frequency with reference to data stored in the memory device 80. Note that in the case where no data is stored in the memory device 80, the controller 60 can change the refresh rate at a predetermined value specified in advance. The refresh rate may be set at a different value depending on whether an image displayed on the display portion 20 is a moving image or a still image.

Next, data corresponding to the current recognition state and whether a flicker is recognized in the current recognition state or not is stored in the memory device 80 (Step S8). Thus, data indicating the relationship between the recognition state and a flicker is stored in the memory device 80. Here, as the recognition states, data indicating time during which an image is displayed, which is counted by the counter 70, the refresh rate, and the like are stored.

After that, in the case where an image is continuously displayed on the display portion 20 ("NO" in Step S9), whether there is an interruption or not (Step S3) and whether a flicker is recognized by the user or not (Step S5) are checked again. Note that in the case where the refresh rate is changed, the value of the counter 70 may be initialized (Step S2) so that time during which an image is displayed at the changed refresh rate is counted again.

Through the above operation, in the display system 10, the refresh rate can be changed actively using data stored in the memory device 80. Moreover, in the display system 10, when whether a flicker is recognized or not is checked, data indicating the relationship between the recognition state and a flicker can be stored in the memory device 80.

<Configuration Example of Controller>

Figure 4:
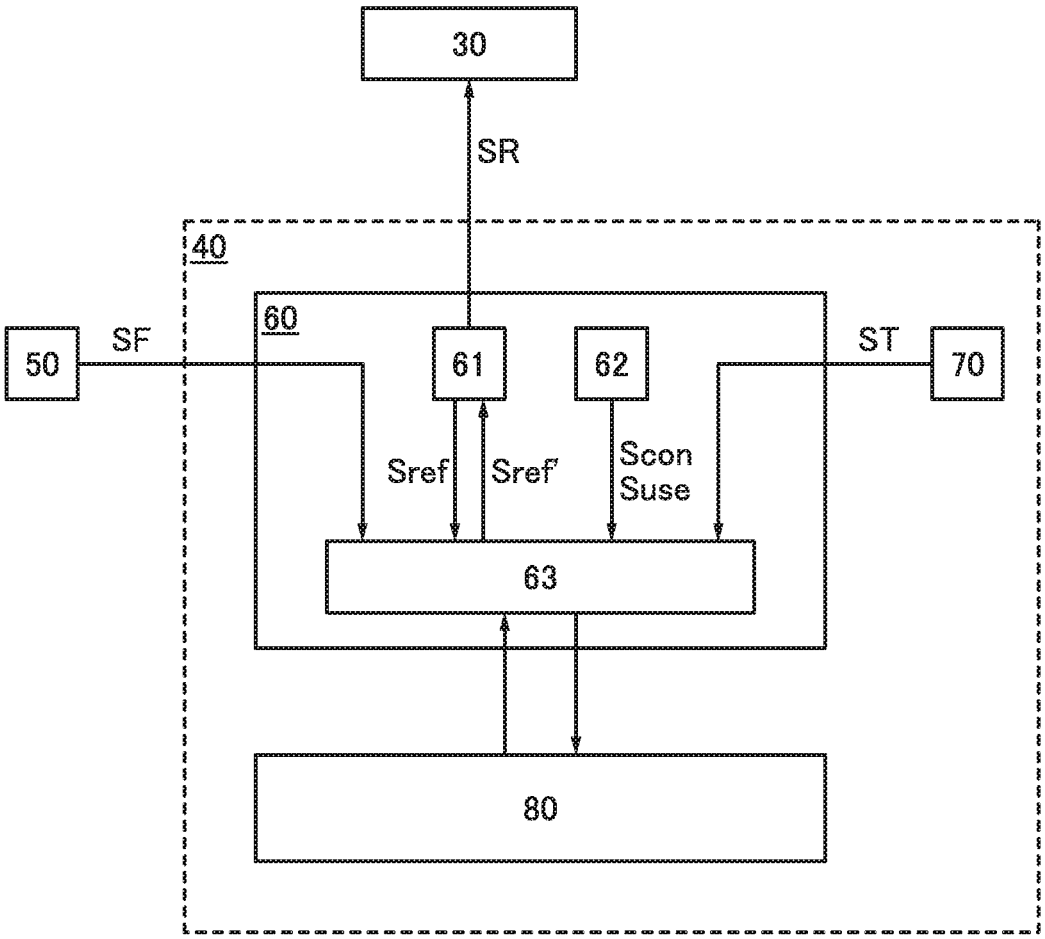
FIG. 4 illustrates a configuration example of a control portion.

Next, a specific configuration example of the controller 60 is described. FIG. 4 illustrates a specific configuration example of the controller 60. Here, as an example, a configuration of the controller 60 capable of setting the refresh rate in accordance with not only time during which an image is displayed but also the user recognizing an image and the content of an image is described. Note that items of the recognition state are not limited to the above and can be set freely.

The controller 60 includes an output portion 61, an output portion 62, and an analysis device 63. The signal SF output from the input portion 50 and the signal ST output from the counter 70 are input to the analysis device 63.

The output portion 61 has a function of outputting the signal SR corresponding to a predetermined refresh rate to the driver portion 30. Thus, the refresh rate of an image displayed on the display portion 20 is controlled. In addition, the output portion 61 has a function of outputting, to the analysis device 63, a signal Sref corresponding to the refresh rate of an image displayed on the display portion 20.

The output portion 62 has a function of outputting, to the analysis device 63, a signal Scon corresponding to the content of an image displayed on the display portion 20 and a signal Suse corresponding to a user using the display portion 20. Here, as an example, the case where the signal Scon is a signal indicating whether an image displayed on the display portion 20 is a moving image or a still image is described.

Note that data on the refresh rate of an image displayed on the display portion 20 may be held in the output portion 61 or may be input to the output portion 61 from the outside of the controller 60. Data on the content of an image displayed on the display portion 20 and the user using the display portion 20 may be held in the output portion 62 or may be input to the output portion 62 from the outside of the controller 60.

In the memory device 80, as the recognition state, data on the user using the display portion 20, time during which an image is displayed, the content of an image, and the refresh rate of an image are stored together with data on whether a flicker is recognized or not. Table 1 shows examples of data stored in the memory device 80. In Table 1, data A, data B, data C, data D, and data E correspond to data indicating a user, data indicating time during which an image is displayed, data indicating the content of an image, data indicating the refresh rate, and data on whether a flicker is recognized by the user or not, respectively.

TABLE 1

| Data A (user) | Data B (time during which an image is displayed) | Data C (content of image) | Data D (refresh rate) | Data E (whether a flicker is recognized or not) |
|---|---|---|---|---|
| a | T1 | moving image | 60 Hz | not recognized |
| a | T1 | moving image | 30 Hz | recognized |
| a | T1 | still image | 60 Hz | not recognized |
| a | T1 | still image | 30 Hz | recognized |
| a | T1 | still image | 1 Hz | not recognized |
| a | T2 | moving image | 60 Hz | not recognized |
| a | T2 | moving image | 30 Hz | recognized |
| a | T2 | still image | 60 Hz | recognized |

TABLE 1-continued

| Data A (user) | Data B (time during which an image is displayed) | Data C (content of image) | Data D (refresh rate) | Data E (whether a flicker is recognized or not) |
|---|---|---|---|---|
| a | T2 | still image | 30 Hz | recognized |
| a | T2 | still image | 1 Hz | not recognized |
| b | T1 | moving image | 60 Hz | recognized |
| b | T1 | moving image | 30 Hz | recognized |

The analysis device 63 has a function of selecting a refresh rate at which a flicker is predicted not to be recognized with reference to data stored in the memory device 80. When the user inputs, to the input portion 50, data on whether a flicker is recognized or not, the signal SF, the signal ST, the signal Sref, the signal Scon, and the signal Suse are input to the analysis device 63. The data shown in Table 1 is input from the memory device 80 to the controller 60. Then, the analysis device 63 compares the signal Suse and the data A, compares the signal ST and the data B, compares the signal Scon and the data C, refers to the data D and the data E, and selects a refresh rate at which a flicker is predicted not to be recognized.

The refresh rate selected by the analysis device 63 is output to the output portion 61 as a signal Sref. Then, the output portion 61 outputs the signal SR corresponding to the signal Sref to the driver portion 30. Thus, the display portion 20 is operated at the refresh rate selected in the control portion 40.

The analysis device 63 has a function of outputting, to the memory device 80, data on the current recognition state and whether a flicker is recognized in the current recognition state or not. When the user inputs data on whether a flicker is recognized or not to the input portion 50, the signal Suse, the signal ST, the signal Scon, the signal Sref, and the signal SF are added to the memory device 80 as the data A, the data B, the data C, the data D, and the data E in Table 1, respectively. Thus, data indicating the relationship between the recognition state and a flicker is stored in the memory device 80.

Note that although FIG. 4 shows the case where the signal Scon and the signal Suse are output from the output portion 62, one of the signals Scon and Suse can be omitted. Alternatively, a signal corresponding to another recognition state may be output to the analysis device 63 in addition to or instead of the signals Scon and Suse. In this case, items of data stored in the memory device 80 are changed as appropriate in accordance with a signal input to the analysis device 63.

<Operation Example of Display Portion and Driver Circuit Portion>

Figure 5:
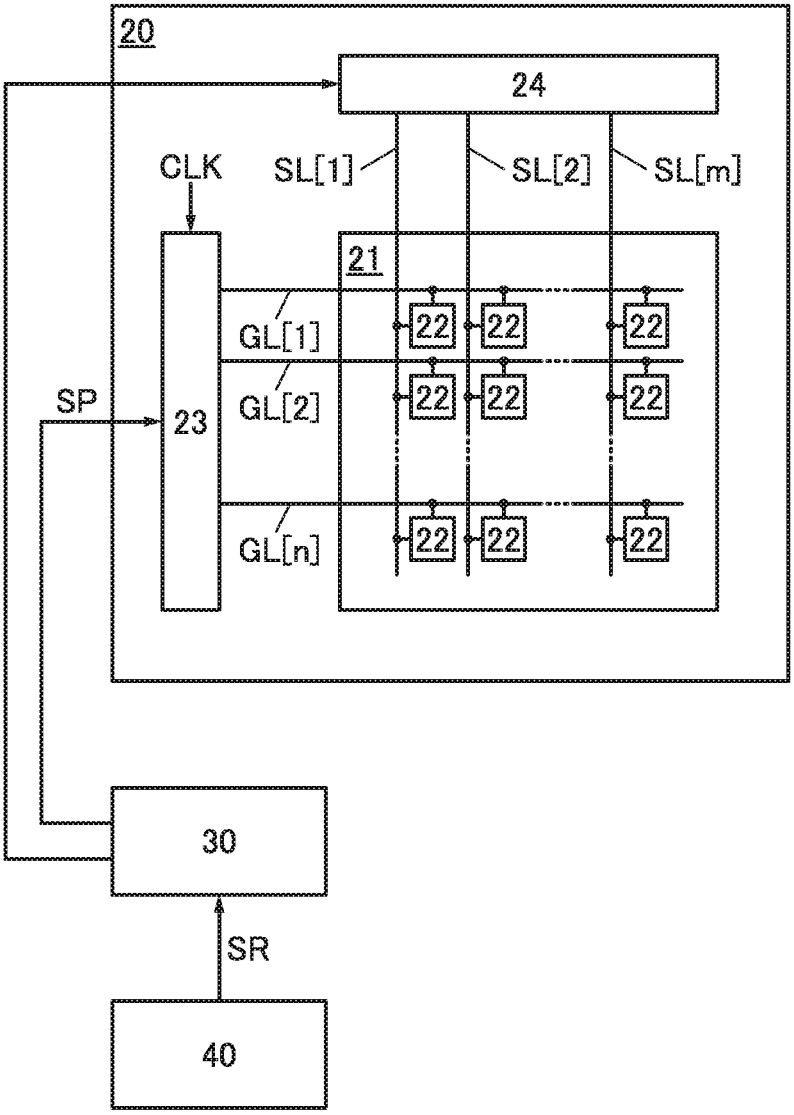
FIG. 5 illustrates a configuration example of a display portion.

Next, an operation example of the display portion 20 and the driver portion 30 is described. Here, in particular, an operation when the operation of the display portion 20 is controlled by a signal output from the driver portion 30 is described. FIG. 5 illustrates a configuration example of the display portion 20.

The display portion 20 includes the pixel portion 21, a driver circuit 23, and a driver circuit 24. Here, the case where the pixel portion 21 includes the pixels 22 arranged in m rows and n columns (each of m and n is an integer of two or more) is described. The pixel 22 in the i-th column and the j-th row (i is an integer greater than or equal to 1 and less than or equal to m, and j is an integer greater than or equal to 1 and less than or equal to n) is connected to a wiring SL[i] and a wiring GL[j]. The wirings GL[1] to GL[n] are connected to the driver circuit 23. The wirings SL[1] to SL[m] are connected to the driver circuit 24.

The driver circuit 23 has a function of generating a signal for selecting the pixels 22 (hereinafter, this signal is also referred to as a selection signal) and supplying the signal to the wiring GL. The driver circuit 24 has a function of generating an image signal and supplying the image signal to the wirings SL. The image signals supplied to the wirings SL are written to the pixels 22 selected by the driver circuit 23.

When the signal SR is input from the control portion 40 to the driver portion 30, the driver portion 30 generates a timing signal corresponding to the signal SR and outputs the timing signal to the driver circuits 23 and 24. Selection signals are generated by the driver circuits 23 and 24 with use of the timing signal.

For example, the operation of the driver circuit 23 is specifically described. The driver circuit 23 generates a selection signal on the basis of a start pulse SP and a clock signal CLK. Here, the timing signal input from the driver portion 30 is used as the start pulse SP.

Figure 6:
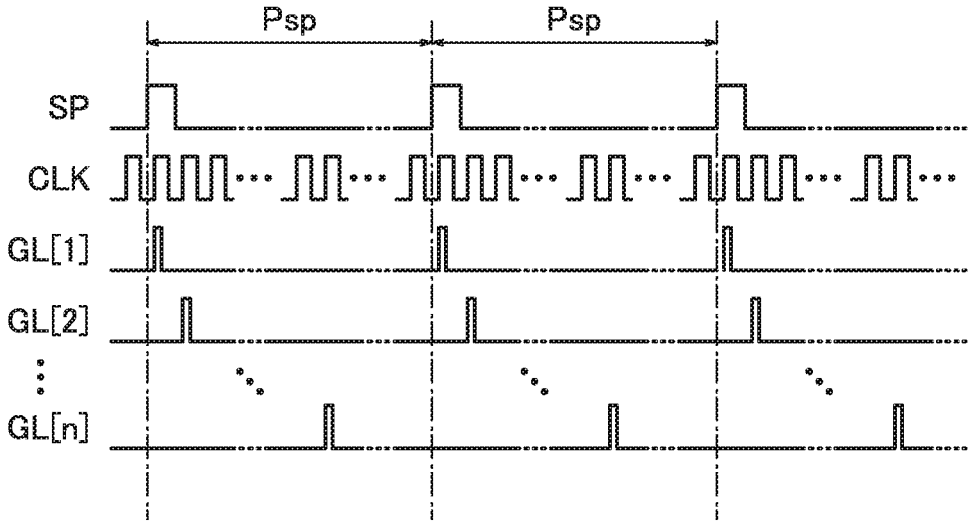
FIG. 6 shows a timing chart.

FIG. 6 shows a timing chart of the driver circuit 23. When the start pulse SP and the clock signal CLK are input to the driver circuit 23, the driver circuit 23 generates selection signals and sequentially outputs the selection signals to the wirings GL[1] to GL[n]. Thus, the potentials of the wirings GL[1] to GL[n] sequentially become a high level, so that the gray levels of the pixels 22 connected to the wirings GL[1] to GL[n] are updated. Thus, an image displayed on the pixel portion 21 is updated.

Here, generation of selection signals supplied to the wirings GL[1] to GL[n] is performed every time the start pulse SP is input. Thus, the cycle Psp of the start pulse SP generated in the driver portion 30 is controlled by the control portion 40, whereby the refresh rate of an image displayed on the display portion 20 can be changed. The cycle Psp of the pulse can be controlled in such a manner that a value of a parameter defining a waveform of a timing signal, which is held in the driver portion 30, is changed on the basis of the signal SR.

As described above, in the display system 10 of one embodiment of the present invention, the refresh rate can be actively set in accordance with a recognition state with reference to data stored in the memory device even in the case where the user does not specify a refresh rate. Thus, image display at a refresh rate capable of improving the visibility and reducing power consumption can be performed by simple operation. Furthermore, in the display system 10 of one embodiment of the present invention, data indicating the relationship between a recognition state and a flicker can be stored in the memory device every time the user inputs data on whether a flicker is recognized or not. Thus, a refresh rate at which a flicker is not recognized can be set more precisely.

This embodiment can be combined with any of the other embodiments as appropriate.

Embodiment 2

In this embodiment, modification examples of the display system described in the above embodiment are described.

<Modification Example of Display System>

Although the configuration example of the display system in which the controller 60 sets a refresh rate with reference to data stored in the memory device 80 is described in Embodiment 1, a refresh rate can also be set by artificial intelligence (AI). Specifically, the controller 60 may include an artificial neural network (ANN) to have a function of setting a refresh rate using an interference (recognition) by the artificial neural network.

Note that artificial intelligence is a general term of computers that resemble the intelligence of human beings. In this specification and the like, artificial intelligence includes an artificial neural network. The artificial neural network is a circuit that resembles a neural network composed of neurons and synapses. In this specification and the like, a term "neural network" particularly refers to the artificial neural network.

Figure 7:
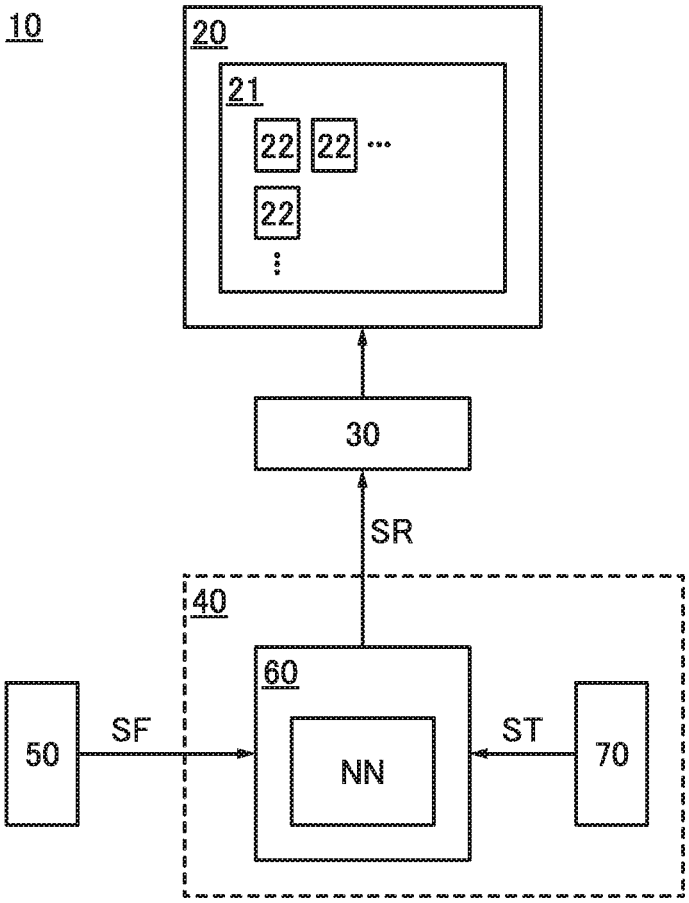
FIG. 7 illustrates a configuration example of a display system.

FIG. 7 illustrates a configuration example in which the controller 60 includes a neural network NN. The control portion 40 illustrated in FIG. 7 differs from that in FIG. 1 in that the controller 60 includes the neural network NN and the memory device 80 in the control portion 40 is omitted. The description of FIG. 1 can be referred to for the other configuration.

The neural network NN learns so that it can calculate a refresh rate at which a flicker is not recognized using data including data indicating a recognition state and data on whether a flicker is recognized in the recognition state by the user or not. When the user inputs data on whether a flicker is recognized or not to the input portion 50, the neural network NN makes an inference from the above data and outputs a refresh rate at which a flicker is not recognized.

In FIG. 7, the signal SF and the signal ST are input to the controller 60. At this time, the neural network NN makes an inference using data including the signal SF and the signal ST as input data and calculates a refresh rate. Then, the signal SR corresponding to the refresh rate is output to the driver portion 30.

When the neural network NN is used in this manner, a refresh rate can be set as appropriate in a variety of recognition states.

Note that the memory device 80 is omitted in FIG. 7 but may be provided in order to store data including data indicating a recognition state and data on whether a flicker is recognized in the recognition state by the user or not. Data stored in the memory device 80 can be used for learning or an inference in the neural network NN.

<Modification Example of Controller>

Figure 8:
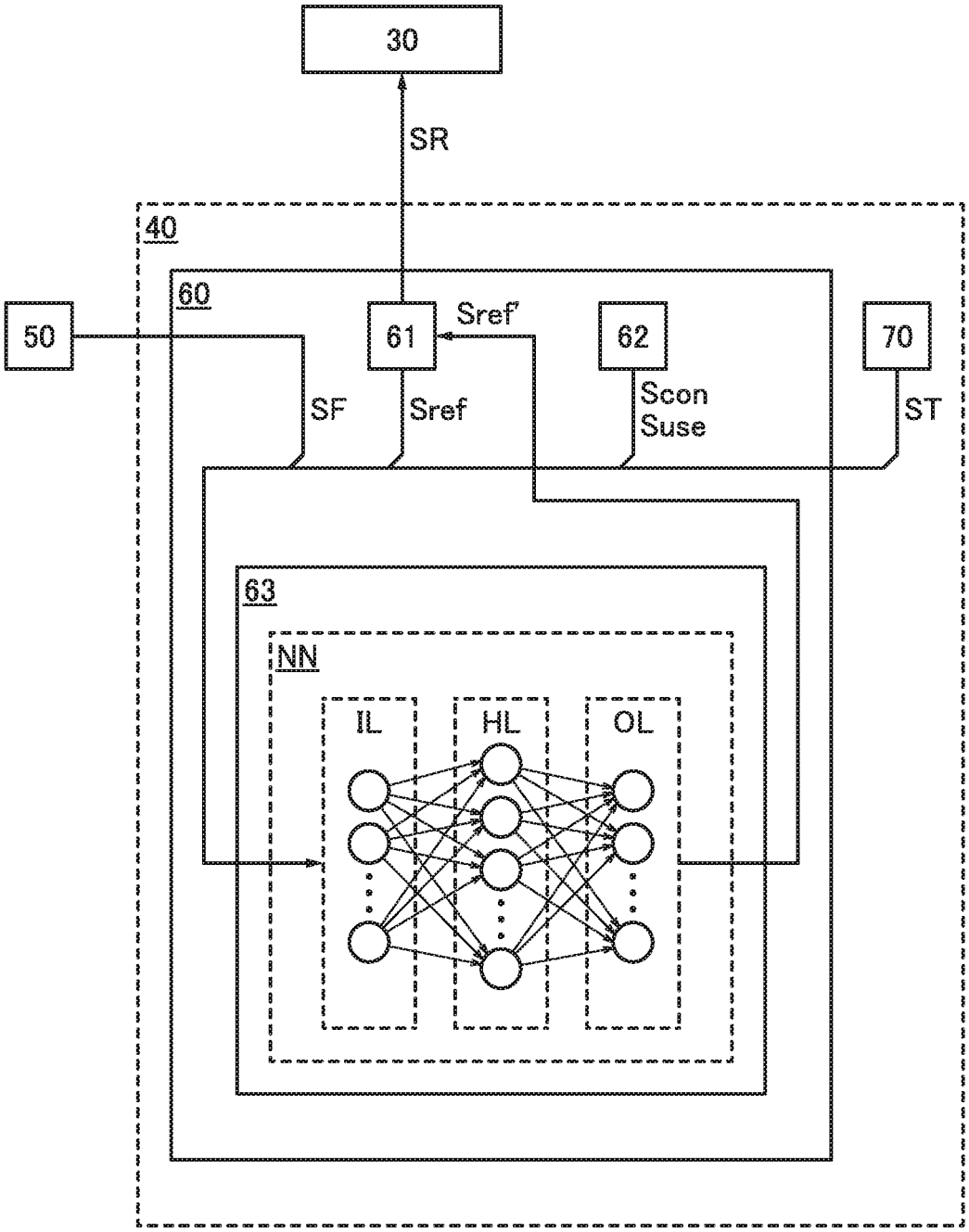
FIG. 8 illustrates a configuration example of a control portion.

FIG. 8 illustrates a specific configuration example of the control portion 40 including the neural network NN. The controller 60 in FIG. 8 differs from that in FIG. 4 in that the analysis device 63 includes the neural network NN. The description of FIG. 4 can be referred to for the other configuration.

The neural network NN includes an input layer IL, an output layer OL, and a hidden layer (middle layer) HL. Data including data indicating a recognition state of an image and data on whether a flicker is recognized in the recognition state by the user or not is input to the input layer IL as input data. For example, data including the signal SF output from the input portion 50, the signal Sref output from the output portion 61, the signals Scon and Suse output from the output portion 62, the signal ST output from the counter 70, and the like is used as the input data.

Note that the neural network NN may be a network including a plurality of hidden layers HL (deep neural network (DNN)). Learning in the deep neural network is referred to as deep learning in some cases. The output layer OL, the input layer IL, and the hidden layer HL each include a plurality of units (neuron circuits), and data output from units is multiplied by weights (connection strength), and then is supplied to units provided in different layers.

As described above, the neural network NN learns so that it can calculate an appropriate refresh rate in accordance with a recognition state. When input data is input to the input layer of the neural network NN, arithmetic processing is performed in each layer. The arithmetic processing in each layer is performed by product-sum operation of data output from the units of the previous layer and weight coefficients, for example. Note that connection between the layers may be full connection in which all the units are connected to each other or partial connection in which some of the units are connected to each other.

Through the arithmetic processing of the neural network NN, a refresh rate at which a flicker is not recognized by the user is calculated. The refresh rate is output from the output layer OL to the output portion 61 as the signal Sref.

Note that in the case where a flicker keeps being recognized even after the refresh rate is changed, the user inputs again, to the input portion 50, data indicating that a flicker is recognized, whereby the neural network NN makes an inference again, so that the refresh rate is updated.

Alternatively, the memory device 80 may be provided in the controller 60 and store data including data indicating the recognition state (the signal Sref, the signal Scon, the signal Suse, the signal ST, or the like) and data on whether a flicker is recognized in the recognition state or not (the signal SF). Data stored in the memory device 80 can be used for learning or an inference in the neural network NN.

<Configuration Examples of Neural Network>

Figure 9A:
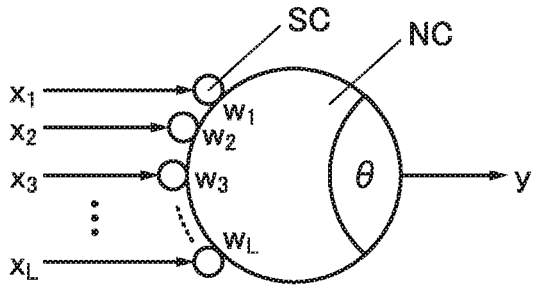
FIGS. 9A to 9C illustrate configuration examples of a neural network.
Figure 9B:
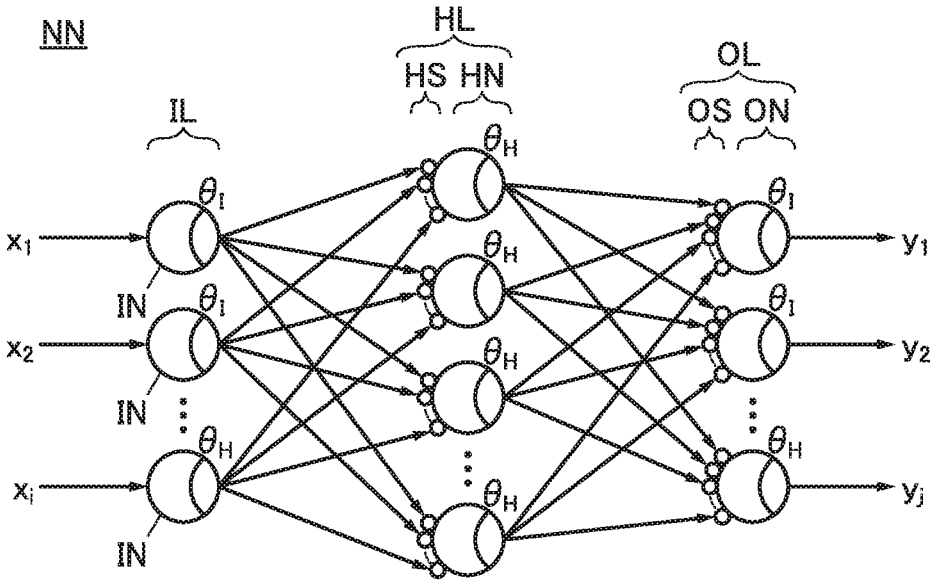
Figure 9C:
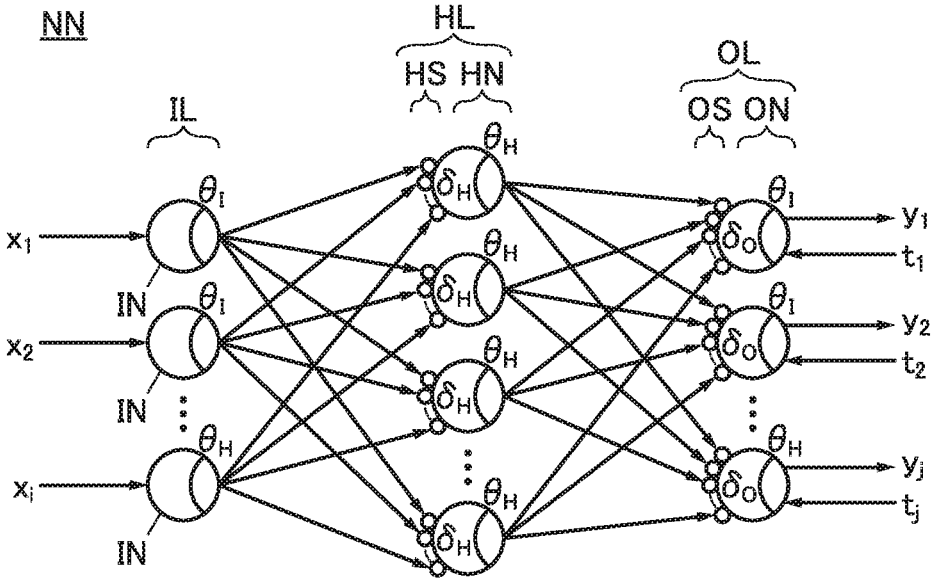

Next, configuration examples of the neural network NN are described. FIGS. 9A to 9C illustrate configuration examples of the neural network. The neural network includes neuron circuits NC and synapse circuits SC provided between the neuron circuits.

FIG. 9A illustrates a configuration example of the neuron circuit NC and the synapse circuit SC. Input data $x_1$ to $x_L$ (L is a natural number) are input to the synapse circuits SC. In addition, the synapse circuits SC each have a function of storing a weight coefficient $w_k$ (k is an integer greater than or equal to 1 and less than or equal to L). The weight coefficient Wk corresponds to the connection strength between the neuron circuits NC.

When the input data $x_1$ to $x_L$ are input to the synapse circuits SC, the sum of the products ($x_k w_k$) for k=1 to L (i.e., $x_1 w_1 + x_2 w_2 + \ldots + x_L w_L$) of input data $x_k$ input to the synapse circuit SC and the weight coefficient $w_k$ stored in the synapse circuit SC, that is, a value obtained by the product-sum operation of $x_k$ and $w_k$ is supplied to the neuron circuit NC. When the value is larger than the threshold θ of the neuron circuit NC, the neuron circuit NC outputs a high-level signal. This phenomenon is referred to as firing of the neuron circuit NC.

FIG. 9B shows a model of a hierarchical neural network using the neuron circuits NC and the synapse circuits SC. The neural network includes the input layer IL, the hidden layer HL, and the output layer OL. The input layer IL includes input neuron circuits IN. The hidden layer HL includes hidden synapse circuits HS and hidden neuron circuits HN. The output layer OL includes output synapse circuits OS and output neuron circuits ON. The thresholds θ of the input neuron circuit IN, the hidden neuron circuit HN, and the output neuron circuit ON are referred to as $\theta_1$, $\theta_H$, and $\theta_O$, respectively.

Data $x_1$ to $x_i$ (i is a natural number) corresponding to data including data indicating a recognition state of an image and data on whether a flicker is recognized in the recognition state by the user or not is supplied to the input layer IL, and output of the input layer IL is supplied to the hidden layer HL. Then, a value obtained by the product-sum operation using the data output from the input layer IL and the weight coefficients w that are held in the hidden synapse circuits HS is supplied to the hidden neuron circuits HN. A value obtained by the product-sum operation using the output of the hidden neuron circuit HN and the weight coefficients w that are held in the output synapse circuits OS is supplied to the output neuron circuits ON. Then, data $y_1$ to $y_j$ (j is a natural number) corresponding to a refresh rate are output from the output neuron circuits ON.

Thus, the neural network shown in FIG. 9B has a function of calculating a refresh rate at which a flicker is not recognized on the basis of a recognition state of an image.

A gradient descent method or the like can be used for learning in the neural network, and a backpropagation method can be used for calculation of a gradient. FIG. 9C shows a model of the neural network which performs supervised learning using a backpropagation method.

A backpropagation method is one of methods for changing a weight coefficient of a synapse circuit so that the error between output data from a neural network and teacher data is reduced. Specifically, a weight coefficient w of the hidden synapse circuit HS is changed in accordance with an error $\delta_O$ that is determined on the basis of the output data (data $y_1$ to $y_j$) and the teacher data (data $t_1$ to $t_j$). In addition, a weight coefficient w of a synapse circuit SC in the previous stage is changed in accordance with the amount of change in the weight coefficient w of the hidden synapse circuit HS. In this manner, weight coefficients of the synapse circuits SC are sequentially changed on the basis of the teacher data, so that the neural network NN can perform learning. Note that an ideal refresh rate in one recognition state can be used as the teacher data.

Note that the number of the hidden layers HL is one in each of FIGS. 9B and 9C but may be two or more. Thus, deep learning can be performed.

The configuration examples of the above neural network NN can be each changed appropriately as needed. For example, a recurrent neural network (RNN) can be used as the neural network NN. In this case, a refresh rate can be determined on the basis of a past recognition state, so that the accuracy of setting of a refresh rate can be improved.

This embodiment can be combined with any of the other embodiments as appropriate.

Embodiment 3

In this embodiment, a specific configuration example of the display system described in the above embodiment is described.

<Configuration Examples of Pixel>

Figure 10A:
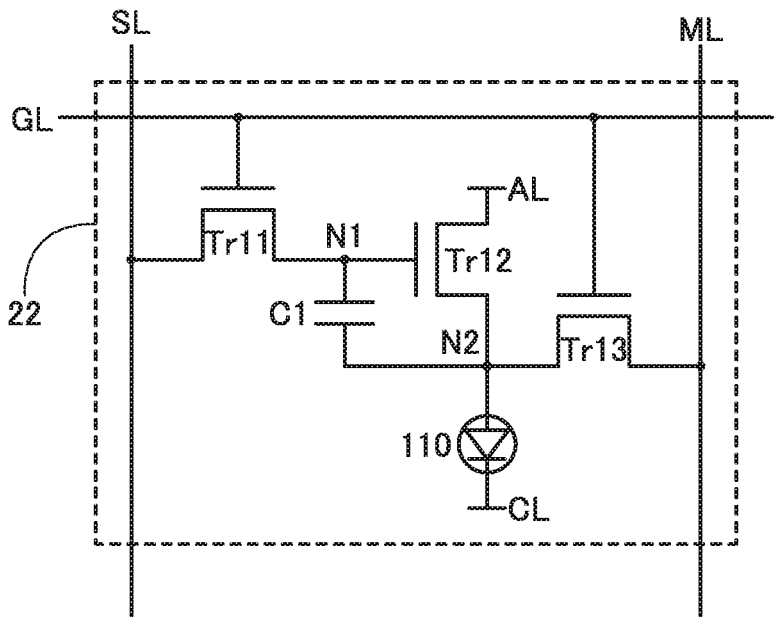
FIGS. 10A and 10B each illustrate a configuration example of a pixel.
Figure 10B:
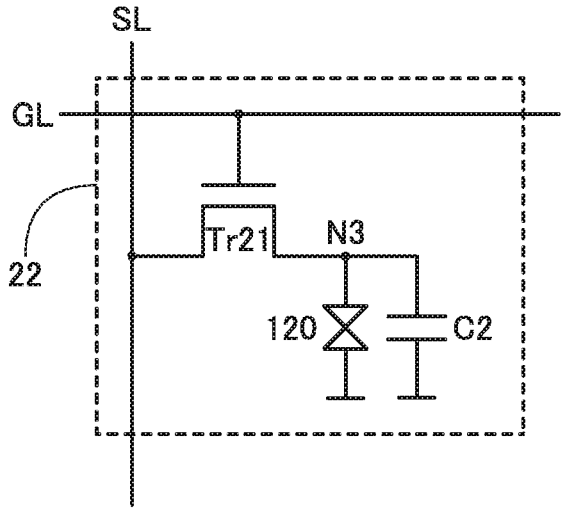

First, configuration examples of the pixel 22 described in the above embodiment are described. FIGS. 10A and 10B each illustrate a configuration example of the pixel 22. Note that each of the pixels 22 is connected to the driver circuit 23 through the wiring GL and connected to the driver circuit 24 through the wiring SL (see FIG. 5).

Configuration Example 1

FIG. 10A illustrates a configuration example of the pixel including a light-emitting element. The pixel 22 illustrated in FIG. 10A includes a transistor Tr11, a transistor Tr12, a transistor Tr13, a light-emitting element 110, and a capacitor C1. Although the transistors Tr11 to Tr13 are n-channel transistors here, the transistors Tr11 to Tr13 may be p-channel transistors.

A gate of the transistor Tr11 is connected to the wiring GL, one of a source and a drain of the transistor Tr11 is connected to a gate of the transistor Tr12 and one electrode of the capacitor C1, and the other of the source and the drain of the transistor Tr11 is connected to the wiring SL. One of the source and the drain of the transistor Tr12 is connected to the other electrode of the capacitor C1, one of electrodes of the light-emitting element 110, and one of a source and a drain of the transistor Tr13. The other of the source and the drain of the transistor Tr12 is connected to a wiring AL to which a potential Va is supplied. The other electrode of the light-emitting element 110 is connected to a wiring CL to which a potential Vc is supplied. A gate of the transistor Tr13 is connected to the wiring GL, and the other of the source and the drain of the transistor Tr13 is connected to a wiring ML. Here, a node which is connected to the one of the source and the drain of the transistor Tr11, the gate of the transistor Tr12, and the one electrode of the capacitor C1 is referred to as a node N1. A node which is connected to the one of the source and the drain of the transistor Tr12, the one of the source and the drain of the transistor Tr13, and the other electrode of the capacitor C1 is referred to as a node N2.

Here, the case where the potential Va supplied to the wiring AL is a high power supply potential and the potential Va supplied to the wiring CL is a low power supply potential is described. The capacitor C1 functions as a storage capacitor for holding the potential of the node N2.

The transistor Tr11 has a function of controlling supply of the potential of the wiring SL to the node N1. The transistor Tr13 has a function of controlling supply of a potential of the wiring ML to the node N2. Specifically, the potential of the wiring GL is controlled to turn on the transistors Tr11 and Tr13, whereby the potential of the wiring SL and the potential of the wiring ML are supplied to the node N1 and the node N2, respectively, and thus are written to the pixel 22. Here, the potential of the wiring SL is a potential corresponding to an image signal. Then, the potential of the wiring GL is controlled to turn off the transistors Tr11 and Tr13, whereby the potentials of the nodes N1 and N2 are held.

The amount of current flowing between the source and the drain of the transistor Tr12 is controlled in accordance with the potentials of the nodes N1 and N2, and thus the light-emitting element 110 emits light with a luminance corresponding to the amount of flowing current. Accordingly, the gray level of the pixel 22 can be controlled.

The above operation is sequentially performed for each wiring GL, whereby an image for one frame can be displayed on the pixel portion 21.

The selection of the wirings GL may be performed by either progressive scan or interlaced scan. The supply of image signals from the driver circuit 24 to the wirings SL may be performed by dot sequential driving in which the image signals are sequentially supplied to the wirings SL, or line sequential driving in which the image signals are concurrently supplied to all the wirings SL. Alternatively, the image signals may be sequentially supplied to every plural wirings SL.

Next, in a next frame period, an image is displayed by an operation similar to the operation described above. Thus, the image displayed on the pixel portion 21 is rewritten. Note that the frequency of image rewriting is controlled by the control portion 40 in Embodiment 1.

On the other hand, for example, in the case of displaying a still image or a moving image which does not change for a predetermined period or changes within a predetermined range on the pixel portion 21, it is preferable to keep an image of the previous frame without rewriting. In this way, power consumption associated with image rewriting can be reduced. In this case, the refresh rate can be set at 5 Hz, preferably 3 Hz, further preferably 1 Hz, for example.

The transistors Tr11 and Tr13 each preferably include an OS transistor. Thus, the potentials of the nodes N1 and N2 can be held for an extremely long time, and the display state can be maintained even when the frequency of image rewriting is reduced.

Note that to maintain a display state is to keep the amount of change in an image within a given range. This given range can be set as appropriate, and is preferably set so that a user viewing an image can recognize that the image is the same, for example.

In a period in which image rewriting is not performed, the supply of a power supply potential and a signal to the driver circuit 23 and the driver circuit 24 can be stopped. Thus, power consumption of the driver circuits 23 and 24 can be reduced.

Note that each of the transistors Tr11 and Tr13 is not necessarily the OS transistor. For example, a transistor whose channel formation region is formed in part of a substrate containing a single-crystal semiconductor other than a metal oxide can be used. Examples of this kind of substrate include a single-crystal silicon substrate and a single-crystal germanium substrate. In addition, a transistor whose channel formation region is formed in a film containing a material other than a metal oxide can be used as the transistors Tr11 and Tr13. Examples of the material other than a metal oxide include silicon, germanium, silicon germanium, silicon carbide, gallium arsenide, aluminum gallium arsenide, indium phosphide, gallium nitride, and an organic semiconductor. Each of the above materials may be a single-crystal semiconductor or a non-single-crystal semiconductor such as an amorphous semiconductor, a microcrystalline semiconductor, or a polycrystalline semiconductor.

Examples of a material that can be used for channel formation regions of the transistor Tr12 and transistors described below are the same as those of the transistors Tr11 and Tr13.

Configuration Example 2

FIG. 10B illustrates a configuration example of the pixel including a liquid crystal element. The pixel 22 in FIG. 10B includes a transistor Tr21, a liquid crystal element 120, and a capacitor C2. Although the transistor Tr21 is an n-channel transistor here, the transistor Tr21 may be a p-channel transistor.

A gate of the transistor Tr21 is connected to the wiring GL and one of a source and a drain of the transistor Tr21 is connected to one electrode of the liquid crystal element 120 and one electrode of the capacitor C2. The other of the source and the drain of the transistor Tr21 is connected to the wiring SL. The other electrode of the liquid crystal element 120 and the other electrode of the capacitor C2 are each connected to a wiring to which a predetermined potential is supplied. A node which is connected to the one of the source and the drain of the transistor Tr21, the one electrode of the liquid crystal element 120, and the one electrode of the capacitor C2 is a node N3.

The potential of the other electrode of the liquid crystal element 120 may be a common potential among the plurality of pixels 22 or may be the same potential as the other electrode of the capacitor C2. The potential of the other electrode of the liquid crystal element 120 may differ between the pixels 22. The capacitor C2 has a function as a storage capacitor for holding a potential of the node N3.

The transistor Tr21 has a function of controlling supply of a potential of the wiring SL to the node N3. Specifically, the potential of the wiring GL is controlled to turn on the transistor Tr21, whereby the potential of the wiring SL is supplied to the node N3 and is written to the pixel 22. Then, the potential of the wiring GL is controlled to turn off the transistor Tr21, whereby the potential of the node N3 is held.

The liquid crystal element 120 includes a pair of electrodes and a liquid crystal layer containing a liquid crystal material to which the a voltage between the pair of electrodes is applied. The alignment of the liquid crystal molecules included in the liquid crystal element 120 changes in accordance with the value of the voltage applied between the pair of electrodes, and thus the transmittance of the liquid crystal layer is changed. Therefore, when the potential supplied from the wiring SL to the node N3 is controlled, the gray level of the pixel 22 can be controlled.

An OS transistor is preferably used as the transistor Tr21. Thus, the potential of the node N3 can be held for an extremely long time. Note that the description of FIG. 10A can be referred to for an operation other than the above.

Modification Examples

Figure 11A:
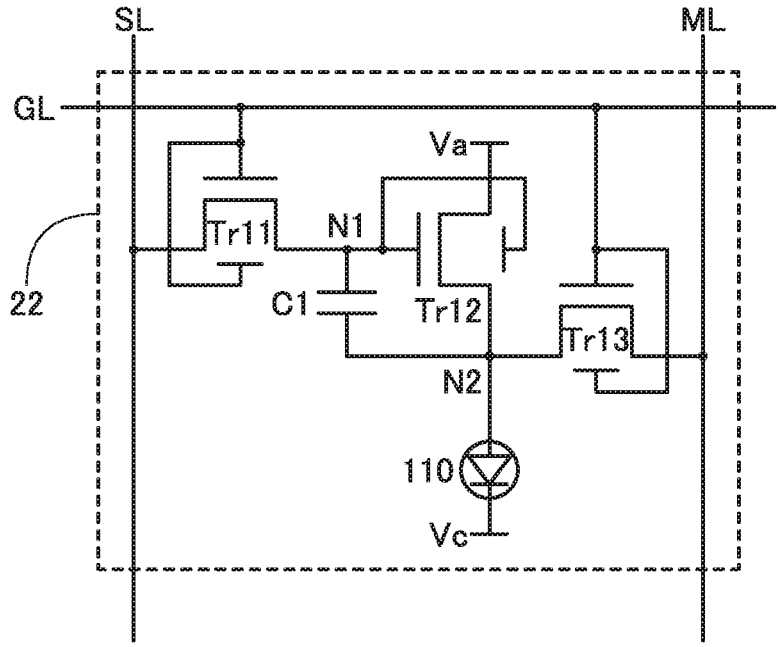
FIGS. 11A and 11B each illustrate a configuration example of a pixel.
Figure 11B:
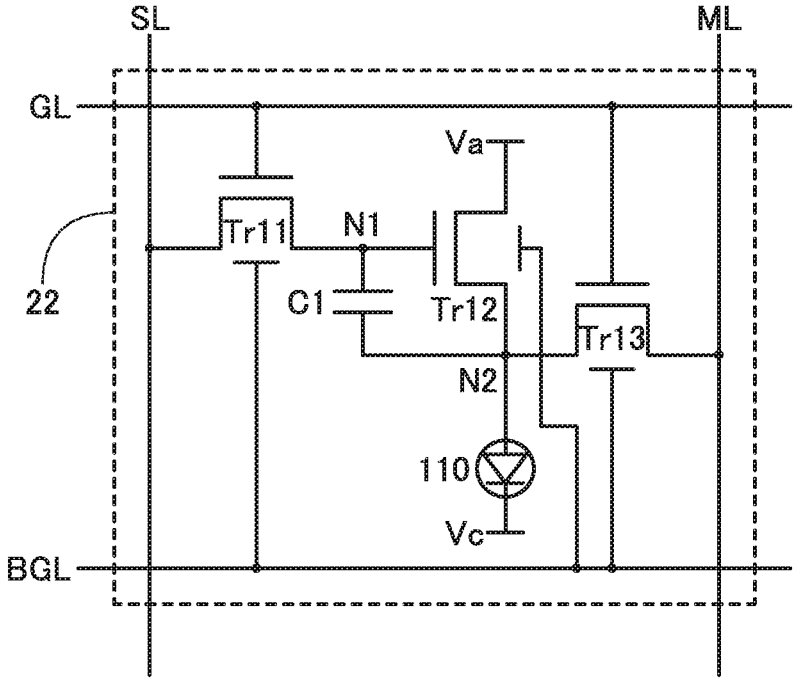
Figure 12:
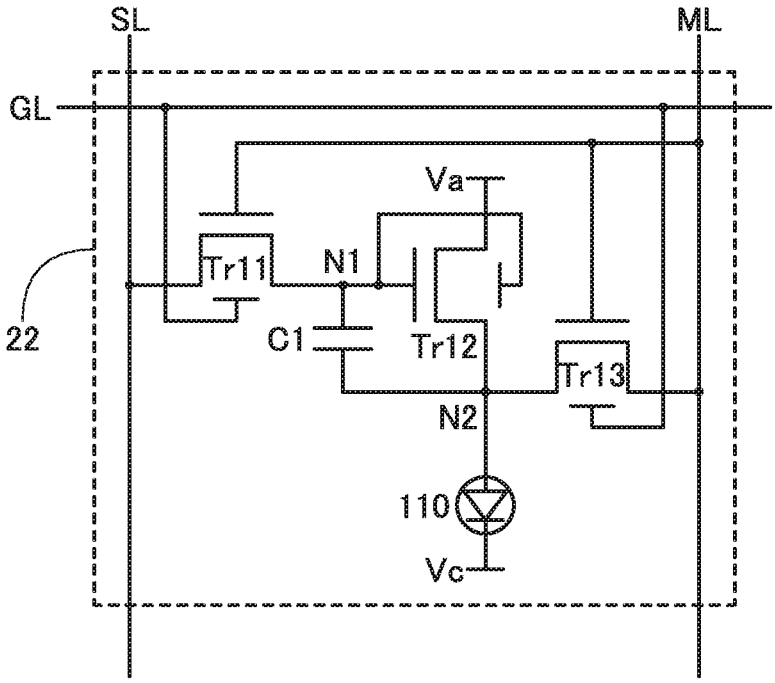
FIG. 12 illustrates a configuration example of a pixel.
Figure 13A:
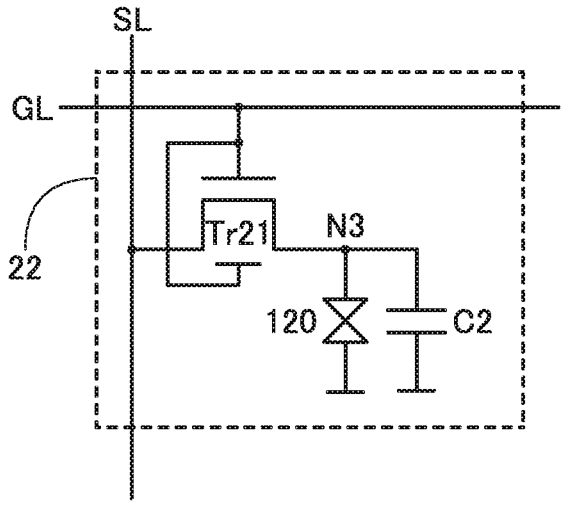
FIGS. 13A and 13B illustrate configuration examples of a pixel.
Figure 13B:
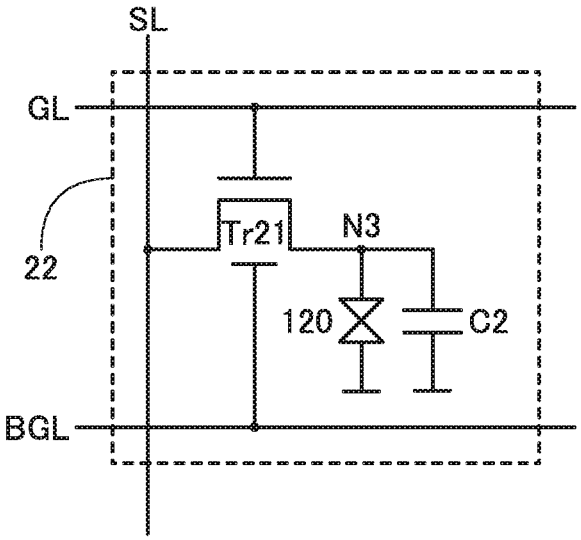

Next, modification examples of the pixels 22 illustrated in FIGS. 10A and 10B are described. FIGS. 11A and 11B and FIG. 12 illustrate modification examples of the pixel 22 including a light-emitting element, and FIGS. 13A and 13B illustrate modification examples of the pixel 22 including a liquid crystal element.

The pixel 22 illustrated in each of FIGS. 11A and 11B differs from that in FIG. 10A in that the transistors Tr11 to Tr13 each include a pair of gates. Note that when a transistor includes a pair of gates, one gate may be referred to as a first gate, a front gate, or simply a gate, and the other gate may be referred to as a second gate or a back gate.

The transistors Tr11 to Tr13 illustrated in FIG. 11A each include a back gate, and the back gate is connected to a front gate. In this case, the same potential as a potential applied to the front gate is applied to the back gate, so that the on-state current of the transistor can be increased. In particular, the transistor Tr11 is used for writing of an image signal; therefore, when the configuration illustrated in FIG. 11A is employed, the pixel 22 can be operated at high speed.

The back gates of the transistors Tr11 to Tr13 illustrated in FIG. 11B are connected to a wiring BGL. The wiring BGL has a function of supplying a predetermined potential to the back gates. The threshold voltages of the transistors Tr11 to Tr13 can be controlled by controlling the potential of the wiring BGL. In particular, the transistors Tr11 and Tr13 are used for holding the potentials of the node N1 and the node N2, respectively; therefore, the threshold voltages of the transistors Tr11 and Tr13 may be shifted to the positive side by control of the potential of the wiring BGL so that the off-state currents of the transistors Tr11 and Tr13 are reduced. The potential supplied to the wiring BGL may be either a fixed potential or a varied potential.

The wiring BGL may be provided separately for each of the transistors Tr11 to Tr13. Furthermore, the wiring BGL may be shared by all or part of the pixels 22 included in the pixel portion 21.

Alternatively, the pixel 22 can have a configuration illustrated in FIG. 12. In FIG. 12, a selection signal is supplied from the wiring GL to the back gates of the transistors Tr11 and Tr13, whereby the transistors Tr11 and Tr13 are turned on, and thus predetermined potentials are supplied to the nodes N1 and N2. Note that the front gates of the transistors Tr11 and Tr13 are connected to the wiring ML.

Although the pixel 22 including a light-emitting element is particularly described above, the back gate can be provided similarly in the pixel 22 including a liquid crystal element. For example, the transistor Tr21 may include a back gate connected to a front gate (see FIG. 13A) or may include a back gate connected to the wiring BGL (see FIG. 13B).

<Configuration Example of Memory Device>

Next, a configuration example of the memory device 80 described in the above embodiments is described.

Figure 14A:
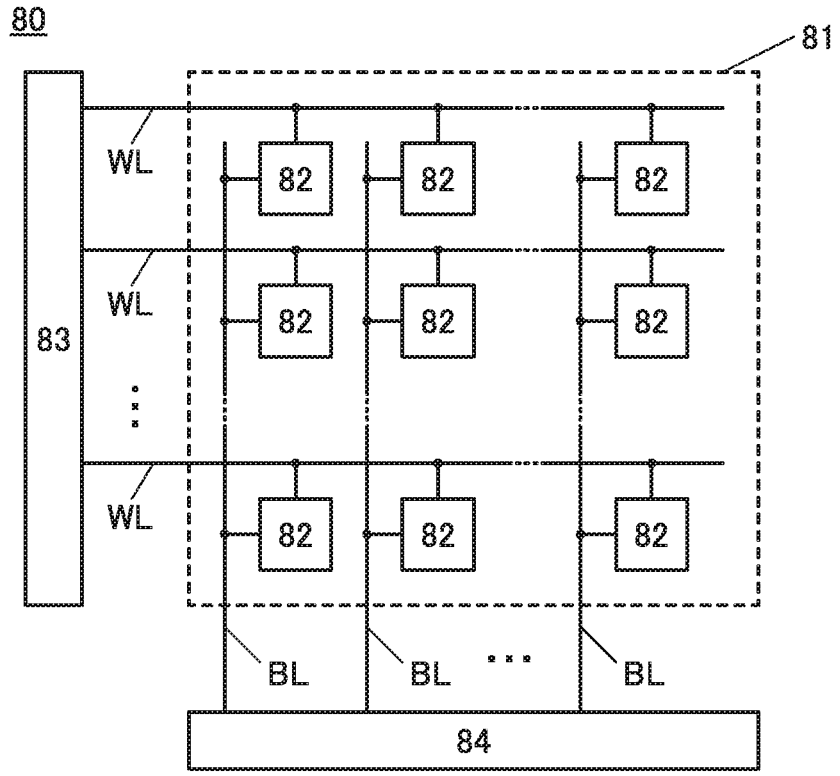

FIG. 14A illustrates a configuration example of the memory device 80. The memory device 80 includes a cell array 81 including a plurality of memory cells 82, a driver circuit 83, and a driver circuit 84.

Figures 1, 14B:
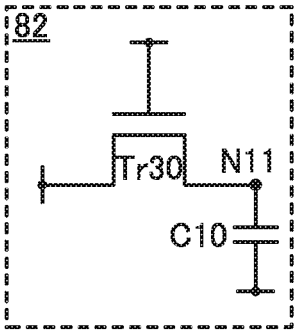

The OS transistor is preferably used in the memory cell 82. An OS transistor has an extremely low off-state current. Accordingly, when the memory cell 82 includes an OS transistor, the memory device 80 can hold data even in a period during which power supply is stopped. Specifically, as illustrated in FIG. 14B1, the memory cell 82 is preferably provided with a transistor Tr30 which is an OS transistor and a capacitor C10.

One of a source and a drain of the transistor Tr30 is connected to the capacitor C10. Here, a node which is connected to the one of the source and the drain of the transistor Tr30 and the capacitor C10 is referred to as a node N11.

A potential to be retained in the memory cell 82 is supplied to the node N11 from a wiring BL or the like through the transistor Tr30. When the transistor Tr30 is in an off state, the node N11 is in a floating state and thus the potential of the node N11 is retained. Since the off-state current of the transistor Tr30 which is an OS transistor is extremely low, the potential of the node N11 can be retained for a long time. The conduction state of the transistor Tr30 can be controlled by supply of a predetermined potential to a wiring which is connected to a gate of the transistor Tr30.

Figures 2, 14B:
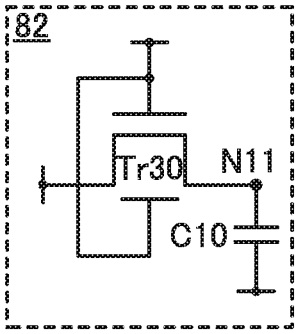
Figures 3, 14B:
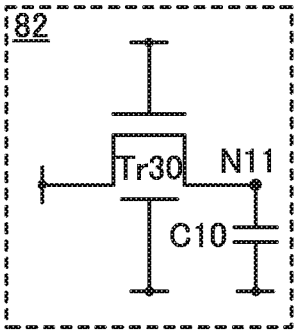

Note that the OS transistor may include a back gate. FIGS. 14B2 and 14B3 each illustrate an example in which the transistor Tr30 includes a back gate. The back gate of the transistor Tr30 in FIG. 14B2 is connected to a front gate of the transistor Tr30. The back gate of the transistor Tr30 in FIG. 14B3 is connected to a wiring to which a predetermined potential is supplied.

When the OS transistor is used in the memory cell 82 as described above, data stored in the memory cell 82 can be held for a long time. Specific configuration examples of the memory cell 82 are described below.

Figure 15A:
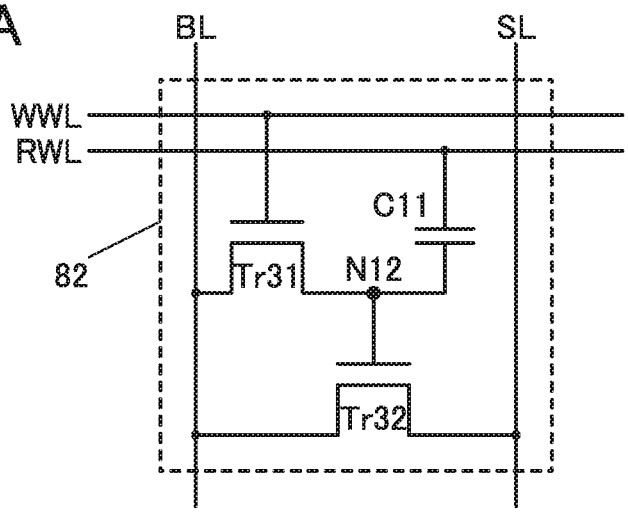
FIGS. 15A to 15C each illustrate a configuration example of a memory cell.

FIG. 15A illustrates a configuration example of the memory cell 82. The memory cell 82 illustrated in FIG. 15A includes a transistor Tr31, a transistor Tr32, and a capacitor C11. Note that the transistor Tr31 is an OS transistor. Although the transistor Tr32 is an n-channel transistor here, the transistor Tr32 may be a p-channel transistor.

A gate of the transistor Tr31 is connected to a wiring WWL, one of a source and a drain of the transistor Tr31 is connected to a gate of the transistor Tr32 and one electrode of the capacitor C11, and the other of the source and the drain of the transistor Tr31 is connected to the wiring BL. One of a source and a drain of the transistor Tr32 is connected to the wiring SL, and the other of the source and the drain of the transistor Tr32 is connected to the wiring BL. The other electrode of the capacitor is connected to a wiring RWL. Here, a node which is connected to the one of the source and the drain of the transistor Tr31, the gate of the transistor Tr32, and the one electrode of the capacitor C11 is referred to as a node N12.

The wiring WWL has a function of transmitting a signal for selecting the memory cell 82 to which data is written. The wiring RWL has a function of transmitting a signal for selecting the memory cell 82 from which data is read. The wiring BL has a function of transmitting a potential corresponding to data written to the memory cell 82 (hereinafter also referred to as a write potential) or a potential corresponding to data stored in the memory cell 82 (hereinafter also referred to as a read potential). The wiring SL is supplied with a predetermined potential. The predetermined potential may be a fixed potential, or may be two or more different potentials. Note that the wiring WWL and the wiring RWL are connected to the driver circuit 83. The wiring SL may be connected to the driver circuit 83 or the driver circuit 84, or may be connected to a power supply line provided separately from the driver circuit 83 and the driver circuit 84.

When an OS transistor is used as the transistor Tr31, the transistor Tr31 in the off state enables the potential of the node N12 to be retained for an extremely long time.

Next, an operation of the memory cell 82 illustrated in FIG. 15A will be described. First, the potential of the wiring WWL is set to a potential at which the transistor Tr31 is turned on, so that the transistor Tr31 is turned on. Accordingly, the potential of the wiring BL is supplied to the node N12. That is, a predetermined charge is supplied to the gate electrode of the transistor Tr32 (data writing).

After that, the potential of the wiring WWL is set to a potential at which the transistor Tr31 is turned off, so that the transistor Tr31 is turned off. This makes the node N12 floating, so that the potential of the node N12 is retained (data retention).

Next, the potential of the wiring SL is fixed to a constant potential, and then, the potential of the wiring RWL is set to a predetermined potential, so that the potential of the wiring BL varies depending on the amount of charge retained at the node N12. This is because, in general, in the case where the transistor Tr32 is an n-channel transistor, an apparent threshold voltage $V_{th_H}$ at the time when the potential of the gate of the transistor Tr32 is at the high level is lower than an apparent threshold voltage $V_{th_L}$ at the time when the potential of the gate of the transistor Tr32 is at the low level. Here, the apparent threshold voltage refers to the potential of the wiring RWL which is needed to turn on the transistor Tr32. Thus, by setting the potential of the wiring RWL to a potential $V_0$ which is between $V_{th_H}$ and $V_{th_L}$, the potential of the node N12 can be determined. For example, in the case where the potential of the node N12 is at the high level, the transistor Tr32 is turned on when the potential of the wiring RWL becomes $V_0$ ($>V_{th_H}$). In the case where the potential of the node N12 is at the low level, the transistor Tr32 remains in the off state even when the potential of the wiring RWL becomes $V_0$ ($<V_{th_L}$). Thus, the data stored in the memory cell 82 can be read out by determining the potential of the wiring BL.

In the case where the data reading is not performed, a potential at which the transistor Tr32 is turned off regardless of the potential of the node N12, that is, a potential lower than VthH may be supplied to the wiring RWL.

Rewriting of data can be performed in a manner similar to that of the writing and retaining of data. Specifically, the potential of the wiring WWL is set to a potential at which the transistor Tr31 is turned on, so that the transistor Tr31 is turned on. Accordingly, the potential of the wiring BL which corresponds to data to be rewritten is supplied to the node N12. After that, the potential of the wiring WWL is set to a potential at which the transistor Tr31 is turned off, so that the transistor Tr31 is turned off. This makes the node N12 floating, so that the potential corresponding to the rewritten data is retained at the node N12.

Since the transistor Tr31 is an OS transistor with an extremely low off-state current, the potential of the node N12 can be maintained for a long time in the retention period. Consequently, even in a period during which the power supply to the memory cell 82 is stopped, data can be retained.

Figure 15B:
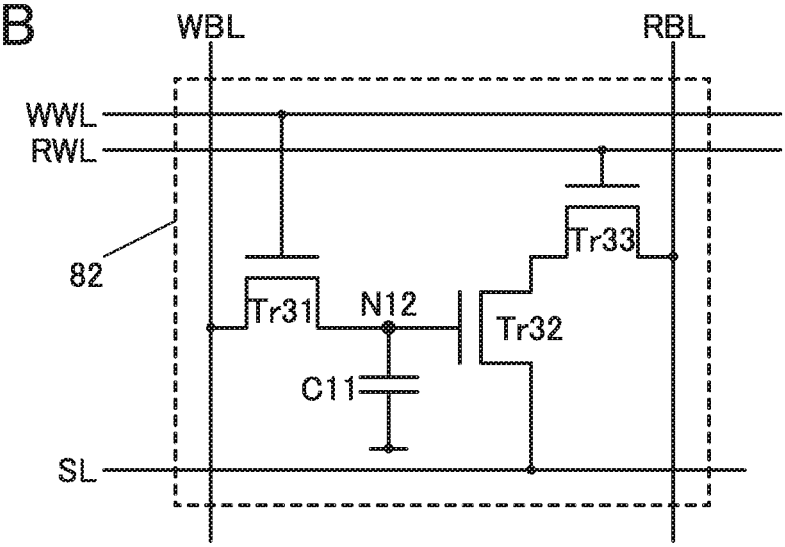

Although FIG. 15A illustrates a configuration in which the data writing and the data reading are performed using the same wiring BL, the data writing and the data reading may be performed using different wirings. In other words, the other of the source and the drain of the transistor Tr31 and the other of the source and the drain of the transistor Tr32 may be connected to different wirings. In addition, the transistor Tr32 may be connected to the wiring BL through another transistor, or the transistor Tr32 may be connected to the wiring SL through another transistor. FIG. 15B illustrates a modification example of the memory cell 82 in FIG. 15A.

The memory cell 82 illustrated in FIG. 15B includes a transistor Tr33 in addition to the transistor Tr31, the transistor Tr32, and the capacitor C11. Note that although the transistors Tr32 and Tr33 are n-channel transistors here, the transistors Tr32 and Tr33 may be p-channel transistors.

A gate of the transistor Tr31 is connected to the wiring WWL. One of a source and a drain of the transistor Tr31 is connected to a gate of the transistor Tr32 and one electrode of the capacitor C11. The other of the source and the drain of the transistor Tr31 is connected to a wiring WBL. One of a source and a drain of the transistor Tr32 is connected to the wiring SL, and the other of the source and the drain is connected to one of a source and a drain of the transistor Tr33. A gate of the transistor Tr33 is connected to the wiring RWL, and the other of the source and the drain of the transistor Tr33 is connected to a wiring RBL. The other electrode of the capacitor C11 is connected to a wiring to which a predetermined potential is supplied.

The memory cell 82 in FIG. 15B includes different wirings, the wiring WBL and the wiring RBL, as the wiring BL. The wiring WBL has a function of transmitting the write potential, and the wiring RBL has a function of transmitting the read potential.

In FIG. 15B, the potential of the wiring RWL is set to a potential at which the transistor Tr33 is turned on, so that the transistor Tr33 is turned on. Accordingly, the read potential can be output to the wiring RBL. That is, data reading from the memory cell 82 can be controlled by a signal supplied to the wiring RWL.

Figure 15C:
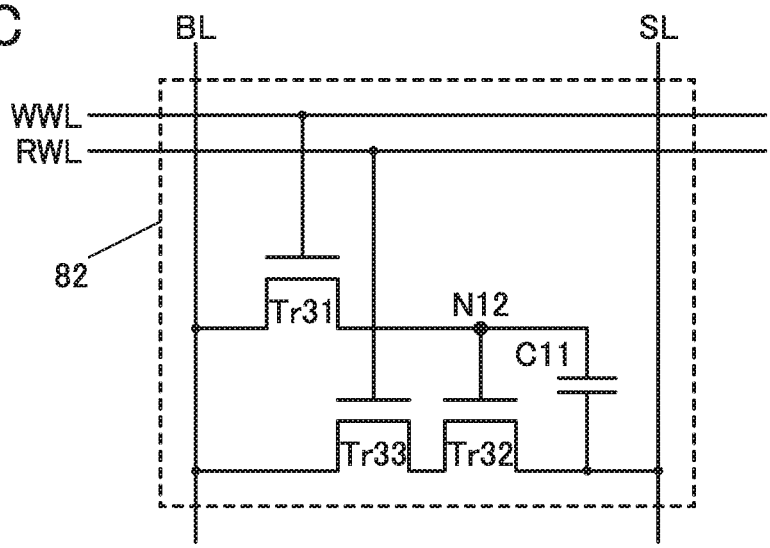

In FIG. 15B, the wiring WBL and the wiring RBL may be the single wiring BL. FIG. 15C illustrates such a configuration of the memory cell 82. In FIG. 15C, the transistor Tr31 and the transistor Tr33 are connected to the wiring BL. The capacitor C11 is connected to the wiring SL.

Note that the transistor Tr31 and the transistor Tr32 (and the transistor Tr33) in FIGS. 15A to 15C can be stacked. For example, an insulating layer can be provided above the transistor Tr32, and the transistor Tr31 which is an OS transistor and the capacitor C11 can be provided above the insulating layer. Accordingly, the area of the memory cell 82 can be reduced.

When the OS transistor is used in the memory cell 82 as described above, data stored in the memory cell 82 can be held for a long time. Accordingly, even in a state where power supply to the memory device 80 is stopped, data indicating the relationship between a recognition state and a flicker, which is stored in the memory device 80, can be held.

This embodiment can be combined with any of the other embodiments as appropriate.

Embodiment 4

In this embodiment, configuration examples of a display device that can be used for the display portion 20 described in the above embodiment are described. Here, configuration examples of a display device provided with a plurality of kinds of display elements are particularly described.

A display device of this embodiment can perform hybrid display. Hybrid display is a method for displaying a letter and/or an image using reflected light and self-emitted light together in one panel that complement the color tone or light intensity of each other. Alternatively, hybrid display is a method for displaying a letter and/or an image using light from a plurality of display elements in one pixel or one subpixel. Note that when a hybrid display performing hybrid display is locally observed, a pixel or a subpixel performing display using any one of the plurality of display elements and a pixel or a subpixel performing display using two or more of the plurality of display elements are included in some cases.

Note that in the present specification and the like, hybrid display satisfies any one or a plurality of the above-described descriptions.

Furthermore, a hybrid display includes a plurality of display elements in one pixel or one subpixel. Note that as an example of the plurality of display elements, a reflective element that reflects light and a self-luminous element that emits light can be given. Note that the reflective element and the self-luminous element can be controlled independently. A hybrid display has a function of displaying a letter and/or an image using one or both of reflected light and self-emitted light in a display portion.

The display device of this embodiment includes a first display element and a second display element. The case where the first display element is a display element that reflects visible light and the second display element is a display element that emits visible light or a display element that transmits visible light is described. The display device of this embodiment has a function of displaying an image using one or both of light reflected by the first display element and light emitted from the second display element.

As the first display element, an element which displays an image by reflecting external light can be used. Such an element does not include a light source and thus power consumption in display can be significantly reduced. As the first display element, a reflective liquid crystal element can be typically used.

As the second display element, a light-emitting element or a transmissive liquid crystal element is preferably used. Since the luminance and the chromaticity of light emitted from such a display element are not affected by external light, a clear image that has high color reproducibility (wide color gamut) and a high contrast can be displayed.

The display device of this embodiment has a first display mode in which an image is displayed using the first display element, a second display mode in which an image is displayed using the second display element, and a third display mode in which an image is displayed using both the first display element and the second display element. The display device of this embodiment can be switched between these display modes automatically or manually.

In the first display mode, an image is displayed using the first display element and external light. The first display mode does not require a light source and is therefore an extremely low-power mode. When sufficient external light enters the display device (e.g., in a bright environment), for example, an image can be displayed by using light reflected by the first display element. The first display mode is effective in the case where external light is white light or light near white light and is sufficiently strong, for example. The first display mode is suitably used for displaying text. Furthermore, the first display mode enables eye-friendly display owing to the use of reflected external light, which leads to an effect of easing eyestrain.

In a second display mode, an image is displayed using the second display element. Thus, an extremely vivid image (with high contrast and excellent color reproducibility) can be displayed regardless of the illuminance and the chromaticity of external light. The second display mode is effective in the case of extremely low illuminance, such as in a night environment or in a dark room, for example. When a bright image is displayed in a dark environment, a user may feel that the image is too bright. To prevent this, an image with reduced luminance is preferably displayed in the second display mode. Thus, not only a reduction in the luminance but also low power consumption can be achieved. The second display mode is suitable for displaying a vivid (still and moving) image or the like.

In the third display mode, an image is displayed with the use of both light reflected by the first display element and light emitted from the second display element. A clearer image than that in the first display mode can be displayed and power consumption can be lower than that in the second display mode. The third display mode is effective in the case where the illuminance is relatively low or in the case where the chromaticity of external light is not white, for example, in an environment under indoor illumination or in the morning or evening. With the use of the combination of light obtained by an element that reflects external light for display and light emitted from a light-emitting element, an image that makes a viewer feel like looking at a painting can be displayed.

With such a structure, an all-weather display device or a highly convenient display device with high visibility regardless of the ambient brightness can be fabricated.

The display device of this embodiment includes a plurality of pixels each including the first display element and the second display element. The pixels are preferably arranged in a matrix.

Each of the pixels can include one or more sub-pixels. For example, each pixel can include one sub-pixel (e.g., a white (W) sub-pixel), three sub-pixels (e.g., red (R), green (G), and blue (B) sub-pixels, or yellow (Y), cyan (C), and magenta (M) sub-pixels), or four sub-pixels (e.g., red (R), green (G), blue (B), and white (W) sub-pixels, or red (R), green (G), blue (B), and yellow (Y) sub-pixels).

The display device of this embodiment can display a full-color image using either the first display element or the second display element. Alternatively, the display device of this embodiment can be configured to display a black-and-white image or a grayscale image using the first display element and can display a full-color image using the second display element. The first display element that can be used for displaying a black-and-white image or a grayscale image is suitable for displaying information that need not be displayed in color such as text information.

Note that the first display element and the second display element are not limited to the above and can be selected freely. For example, the display elements described in Embodiment 1 can be used as the first display element and the second display element.

<Configuration Example of Display Device>

Configuration examples of the display device of this embodiment are described with reference to FIGS. 16 to 19.

Configuration Example 1

Figure 16:
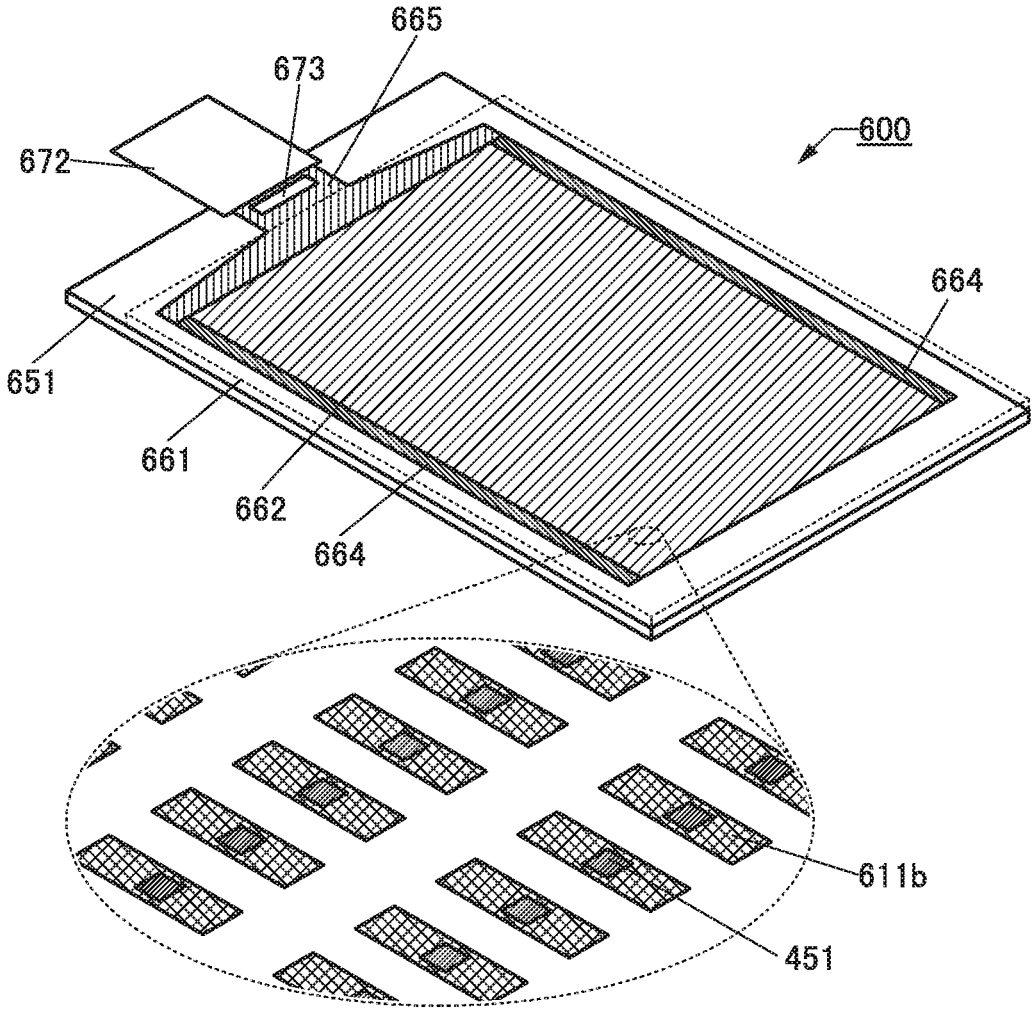
FIG. 16 illustrates a configuration example of a display device.

FIG. 16 is a schematic perspective view of a display device 600. In the display device 600, a substrate 651 and a substrate 661 are bonded to each other. In FIG. 16, the substrate 661 is denoted by a dashed line.

The display device 600 includes a display portion 662, a circuit 664, a wiring 665, and the like. FIG. 16 illustrates an example in which the display device 600 is provided with an integrated circuit (IC) 673 and an FPC 672. Thus, the configuration illustrated in FIG. 16 can be regarded as a display module including the display device 600, the IC, and the FPC.

As the circuit 664, the driver circuit 23 (see FIG. 5) can be used, for example.

The wiring 665 has a function of supplying a signal and power to the display portion 662 and the circuit 664. The signal and power are input to the wiring 665 from the outside through the FPC 672 or from the IC 673.

FIG. 16 illustrates an example in which the IC 673 is provided over the substrate 651 by a chip on glass (COG) method, a chip on film (COF) method, or the like. An IC including the driver circuit 24 (see FIG. 5) or the like can be used as the IC 673, for example. Note that the display device 600 and the display module are not necessarily provided with an IC. The IC may be provided over the FPC by a COF method or the like.

FIG. 16 also illustrates an enlarged view of part of the display portion 662. Electrodes 611*b* included in a plurality of display elements are arranged in a matrix in the display portion 662. The electrode 611*b* has a function of reflecting visible light, and serves as a reflective electrode of a liquid crystal element.

As illustrated in FIG. 16, the electrode 611*b* includes the opening 451. In addition, the display portion 662 includes a light-emitting element that is positioned closer to the substrate 651 than the electrode 611*b* is. Light from the light-emitting element is emitted to the substrate 661 side through the opening 451 in the electrode 611*b*. The area of the light-emitting region of the light-emitting element may be equal to the area of the opening 451. One of the area of the light-emitting region of the light-emitting element and the area of the opening 451 is preferably larger than the other because a margin for misalignment can be increased. It is particularly preferable that the area of the opening 451 be larger than the area of the light-emitting region of the light-emitting element. When the area of the opening 451 is small, part of light from the light-emitting element is blocked by the electrode 611*b* and cannot be extracted to the outside, in some cases. The opening 451 with a sufficiently large area can reduce waste of light emitted from the light-emitting element.

Figure 17:
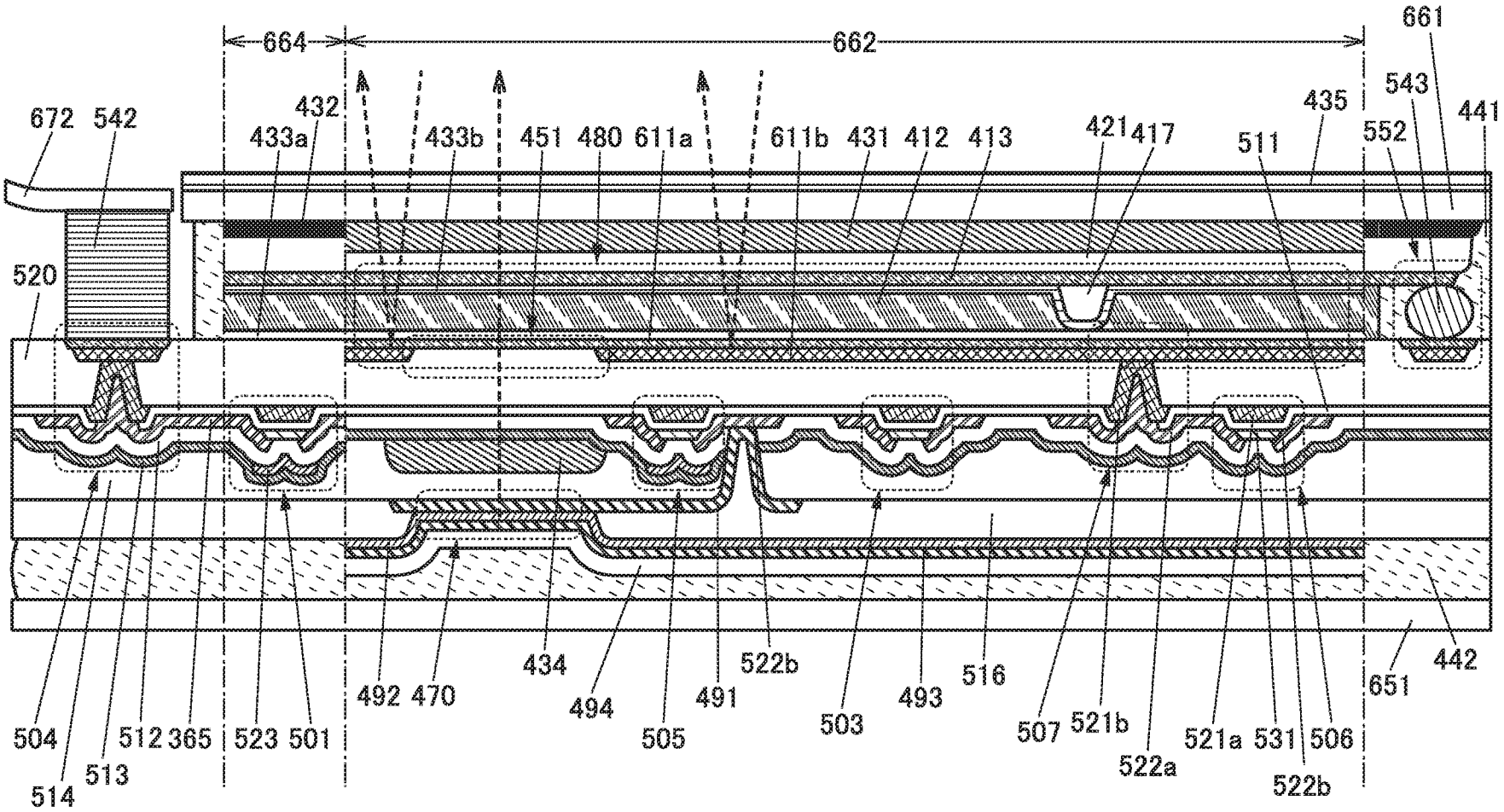
FIG. 17 illustrates a configuration example of a display device.

FIG. 17 illustrates an example of cross sections of part of a region including the FPC 672, part of a region including the circuit 664, and part of a region including the display portion 662 of the display device 600 illustrated in FIG. 16.

The display device 600 illustrated in FIG. 17 includes a transistor 501, a transistor 503, a transistor 505, a transistor 506, a liquid crystal element 480, a light-emitting element 470, an insulating layer 520, a coloring layer 431, a coloring layer 434, and the like between the substrate 651 and the substrate 661. The substrate 661 is bonded to the insulating layer 520 with an adhesive layer 441. The substrate 651 is bonded to the insulating layer 520 with an adhesive layer 442.

The substrate 661 is provided with the coloring layer 431, a light-blocking layer 432, an insulating layer 421, an electrode 413 functioning as a common electrode of the liquid crystal element 480, an alignment film 433*b*, an insulating layer 417, and the like. A polarizing plate 435 is provided on an outer surface of the substrate 661. The insulating layer 421 may function as a planarization layer. The insulating layer 421 enables the electrode 413 to have a substantially flat surface, resulting in a uniform alignment state of a liquid crystal layer 412. The insulating layer 417 serves as a spacer for holding a cell gap of the liquid crystal element 480. In the case where the insulating layer 417 transmits visible light, the insulating layer 417 may be positioned to overlap with a display region of the liquid crystal element 480.

The liquid crystal element 480 is a reflective liquid crystal element. The liquid crystal element 480 has a stacked-layer structure of an electrode 611*a* functioning as a pixel electrode, the liquid crystal layer 412, and the electrode 413. The electrode 611*b* that reflects visible light is provided in contact with a surface of the electrode 611*a* on the substrate 651 side. The electrode 611*b* includes the opening 451. The electrode 611*a* and the electrode 413 transmit visible light. An alignment film 433*a* is provided between the liquid crystal layer 412 and the electrode 611*a*. The alignment film 433*b* is provided between the liquid crystal layer 412 and the electrode 413.

In the liquid crystal element 480, the electrode 611*b* has a function of reflecting visible light, and the electrode 413 has a function of transmitting visible light. Light entering from the substrate 661 side is polarized by the polarizing plate 435, transmitted through the electrode 413 and the liquid crystal layer 412, and reflected by the electrode 611*b*. Then, the light is transmitted through the liquid crystal layer 412 and the electrode 413 again to reach the polarizing plate 435. In this case, alignment of liquid crystals can be controlled with a voltage that is applied between the electrode 611*b* and the electrode 413, and thus optical modulation of light can be controlled. In other words, the intensity of light emitted through the polarizing plate 435 can be controlled. Light excluding light in a particular wavelength region is absorbed by the coloring layer 431, and thus, emitted light is red light, for example.

As illustrated in FIG. 17, the electrode 611*a* that transmits visible light is preferably provided across the opening 451. Accordingly, liquid crystals in the liquid crystal layer 412 are aligned in a region overlapping with the opening 451 as in the other regions, in which case an alignment defect of the liquid crystals is prevented from being generated in a boundary portion of these regions and undesired light leakage can be suppressed.

At a connection portion 507, the electrode 611*b* is connected to a conductive layer 522*a* included in the transistor 506 via a conductive layer 521*b*. The transistor 506 has a function of controlling the driving of the liquid crystal element 480.

A connection portion 552 is provided in part of a region where the adhesive layer 441 is provided. In the connection portion 552, a conductive layer obtained by processing the same conductive film as the electrode 611*a* is connected to part of the electrode 413 with a connector 543. Accordingly, a signal or a potential input from the FPC 672 connected to the substrate 651 side can be supplied to the electrode 413 formed on the substrate 661 side through the connection portion 552.

As the connector 543, a conductive particle can be used, for example. As the conductive particle, a particle of an organic resin, silica, or the like coated with a metal material can be used. It is preferable to use nickel or gold as the metal material because contact resistance can be decreased. It is also preferable to use a particle coated with layers of two or more kinds of metal materials, such as a particle coated with nickel and further with gold. As the connector 543, a material capable of elastic deformation or plastic deformation is preferably used. As illustrated in FIG. 17, the connector 543, which is the conductive particle, has a shape that is vertically crushed in some cases. With the crushed shape, the contact area between the connector 543 and a conductive layer electrically connected to the connector 543 can be increased, thereby reducing contact resistance and suppressing the generation of problems such as disconnection.

The connector 543 is preferably provided so as to be covered with the adhesive layer 441. For example, the connectors 543 are dispersed in the adhesive layer 441 before curing of the adhesive layer 441.

The light-emitting element 470 is a bottom-emission light-emitting element. The light-emitting element 470 has a stacked-layer structure in which an electrode 491 serving as a pixel electrode, an EL layer 492, and an electrode 493 serving as a common electrode are stacked in this order from the insulating layer 520 side. The electrode 491 is connected to a conductive layer 522*b* included in the transistor 505 through an opening provided in an insulating layer 514. The transistor 505 has a function of controlling the driving of the light-emitting element 470. An insulating layer 516 covers an end portion of the electrode 491. The electrode 493 includes a material that reflects visible light, and the electrode 491 includes a material that transmits visible light. An insulating layer 494 is provided to cover the electrode 493. Light is emitted from the light-emitting element 470 to the substrate 661 side through the coloring layer 434, the insulating layer 520, the opening 451, the electrode 611*a*, and the like.

The liquid crystal element 480 and the light-emitting element 470 can exhibit various colors when the color of the coloring layer varies among pixels. The display device 600 can display a color image using the liquid crystal element 480. The display device 600 can display a color image using the light-emitting element 470.

The transistor 501, the transistor 503, the transistor 505, and the transistor 506 are formed on a plane of the insulating layer 520 on the substrate 651 side. These transistors can be fabricated using the same process.

A circuit electrically connected to the liquid crystal element 480 and a circuit connected to the light-emitting element 470 are preferably formed on the same plane. In that case, the thickness of the display device can be smaller than that in the case where the two circuits are formed on different planes. Furthermore, since two transistors can be formed in the same process, a manufacturing process can be simplified as compared to the case where two transistors are formed on different planes.

The pixel electrode of the liquid crystal element 480 is positioned on the opposite side of a gate insulating layer included in the transistor from the pixel electrode of the light-emitting element 470.

In the case where an OS transistor is used as the transistor 506 or a memory element connected to the transistor 506 is used, for example, a gray level can be maintained even when writing operation to the pixel is stopped while a still image is displayed using the liquid crystal element 480. That is, display can be maintained even when the frame rate is set to an extremely small value. In one embodiment of the present invention, the frame rate can be extremely low and driving with low power consumption can be performed.

The transistor 503 is used for controlling whether the pixel is selected or not (such a transistor is also referred to as a switching transistor or a selection transistor). The transistor 505 is used for controlling current flowing to the light-emitting element 470 (such a transistor is also referred to as a driving transistor).

Insulating layers such as an insulating layer 511, an insulating layer 512, an insulating layer 513, and the insulating layer 514 are provided on the substrate 651 side of the insulating layer 520. Part of the insulating layer 511 functions as a gate insulating layer of each transistor. The insulating layer 512 is provided to cover the transistor 506 and the like. The insulating layer 513 is provided to cover the transistor 505 and the like. The insulating layer 514 functions as a planarization layer. Note that the number of insulating layers covering the transistor is not limited and may be one or two or more.

A material through which impurities such as water and hydrogen do not easily diffuse is preferably used for at least one of the insulating layers that cover the transistors. This is because such an insulating layer can serve as a barrier film. Such a structure can effectively suppress diffusion of the impurities into the transistors from the outside, and a highly reliable display device can be achieved.

Each of the transistors 501, 503, 505, and 506 includes a conductive layer 521*a* functioning as a gate, the insulating layer 511 functioning as a gate insulating layer, the conductive layer 522*a* and the conductive layer 522*b* functioning as a source and a drain, and a semiconductor layer 531. Here, a plurality of layers obtained by processing the same conductive film are shown with the same hatching pattern.

The transistor 501 and the transistor 505 each include a conductive layer 523 functioning as a gate, in addition to the components of the transistor 503 or the transistor 506.

The structure in which the semiconductor layer including a channel formation region is provided between two gates is used as an example of the transistors 501 and 505. Such a structure enables the control of the threshold voltages of the transistors. The two gates may be connected to each other and supplied with the same signal to operate the transistors. Such transistors can have higher field-effect mobility and thus have higher on-state current than other transistors. Consequently, a circuit capable of high-speed operation can be obtained. Furthermore, the area occupied by a circuit portion can be reduced. The use of the transistor having high on-state current can reduce signal delay in wirings and can reduce display unevenness even in a display device in which the number of wirings is increased because of increase in size or definition.

Alternatively, by supplying a potential for controlling the threshold voltage to one of the two gates and a potential for driving to the other, the threshold voltage of the transistors can be controlled.

The structure of the transistors included in the display device is not limited. The transistor included in the circuit 664 and the transistor included in the display portion 662 may have the same structure or different structures. A plurality of transistors included in the circuit 664 may have the same structure or a combination of two or more kinds of structures. Similarly, a plurality of transistors included in the display portion 662 may have the same structure or a combination of two or more kinds of structures.

It is preferable to use a conductive material containing an oxide for the conductive layer 523. A conductive film used for the conductive layer 523 is formed in an oxygen-containing atmosphere, whereby oxygen can be supplied to the insulating layer 512. The proportion of an oxygen gas in a deposition gas is preferably higher than or equal to 90% and lower than or equal to 100%. Oxygen supplied to the insulating layer 512 is supplied to the semiconductor layer 531 by later heat treatment, so that oxygen vacancies in the semiconductor layer 531 can be reduced.

It is particularly preferable to use a low-resistance metal oxide for the conductive layer 523. In that case, an insulating film that releases hydrogen, such as a silicon nitride film, is preferably used for the insulating layer 513, for example, because hydrogen can be supplied to the conductive layer 523 during the formation of the insulating layer 513 or by heat treatment performed after the formation of the insulating layer 513, which leads to an effective reduction in the electric resistance of the conductive layer 523.

The coloring layer 434 is provided in contact with the insulating layer 513. The coloring layer 434 is covered with the insulating layer 514.

A connection portion 504 is provided in a region where the substrates 651 and 661 do not overlap with each other. In the connection portion 504, the wiring 665 is connected to the FPC 672 via a connection layer 542. The connection portion 504 has a structure similar to that of the connection portion 507. On the top surface of the connection portion 504, a conductive layer obtained by processing the same conductive film as the electrode 611*a* is exposed. Thus, the connection portion 504 and the FPC 672 can be connected to each other via the connection layer 542.

As the polarizing plate 435 provided on the outer surface of the substrate 661, a linear polarizing plate or a circularly polarizing plate can be used. An example of a circularly polarizing plate is a stack including a linear polarizing plate and a quarter-wave retardation plate. Such a structure can reduce reflection of external light. The cell gap, alignment, drive voltage, and the like of the liquid crystal element used as the liquid crystal element 480 are controlled depending on the kind of the polarizing plate so that desirable contrast is obtained.

Note that a variety of optical members can be arranged on the outer surface of the substrate 661. Examples of the optical members include a polarizing plate, a retardation plate, a light diffusion layer (e.g., a diffusion film), an anti-reflective layer, and a light-condensing film. Furthermore, an antistatic film preventing the attachment of dust, a water repellent film suppressing the attachment of stain, a hard coat film suppressing a scratch in use, or the like may be arranged on the outer surface of the substrate 661.

For each of the substrates 651 and 661, glass, quartz, ceramic, sapphire, an organic resin, or the like can be used. When the substrates 651 and 661 are formed using a flexible material, the flexibility of the display device can be increased.

In the case where the reflective liquid crystal element is used, the polarizing plate 435 is provided on the display surface side. In addition, a light diffusion plate is preferably provided on the display surface side to improve visibility.

A front light may be provided on the outer side of the polarizing plate 435. As the front light, an edge-light front light is preferably used. A front light including a light-emitting diode (LED) is preferably used to reduce power consumption.

Configuration Example 2

Figure 18:
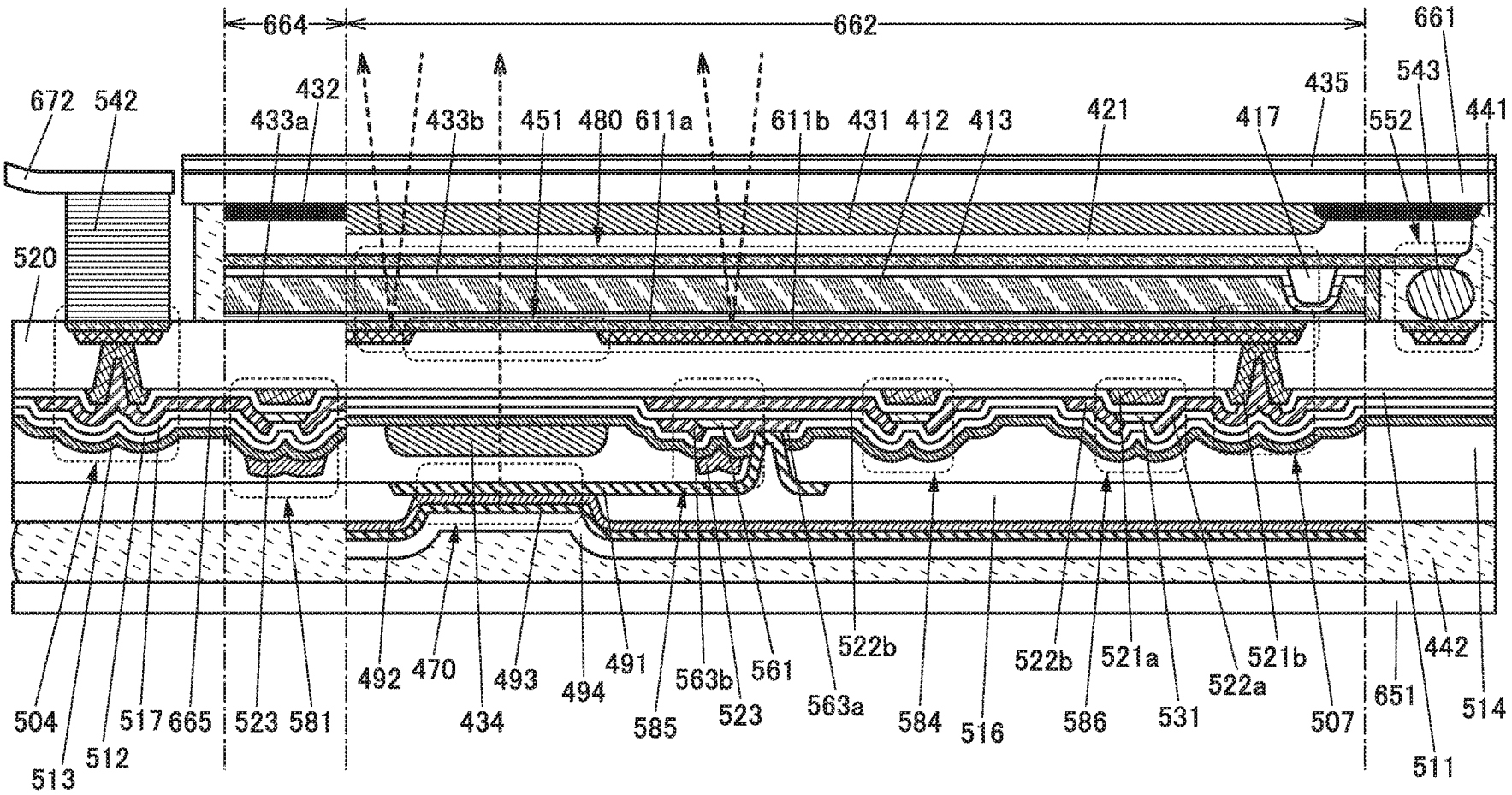
FIG. 18 illustrates a configuration example of a display device.

A display device 601 illustrated in FIG. 18 is different from the display device 600 mainly in that a transistor 581, a transistor 584, a transistor 585, and a transistor 586 are included instead of the transistor 501, the transistor 503, the transistor 505, and the transistor 506.

Note that the positions of the insulating layer 417, the connection portion 507, and the like in FIG. 18 are different from those in FIG. 17. FIG. 18 illustrates an end portion of a pixel. The insulating layer 417 is provided so as to overlap with an end portion of the coloring layer 431 and an end portion of the light-blocking layer 432. As in this structure, the insulating layer 417 may be provided in a region not overlapping with a display region (or in a region overlapping with the light-blocking layer 432).

Two transistors included in the display device may partly overlap with each other like the transistor 584 and the transistor 585. In that case, the area occupied by a pixel circuit can be reduced, leading to an increase in resolution. Furthermore, the light-emitting area of the light-emitting element 470 can be increased, leading to an improvement in aperture ratio. The light-emitting element 470 with a high aperture ratio requires low current density to obtain necessary luminance; thus, the reliability is improved.

Each of the transistors 581, 584, and 586 includes the conductive layer 521*a*, the insulating layer 511, the semiconductor layer 531, the conductive layer 522*a*, and the conductive layer 522*b*. The conductive layer 521*a* overlaps with the semiconductor layer 531 with the insulating layer 511 positioned therebetween. The conductive layer 522*a* and the conductive layer 522*b* are electrically connected to the semiconductor layer 531. The transistor 581 includes the conductive layer 523.

The transistor 585 includes the conductive layer 522*b*, an insulating layer 517, a semiconductor layer 561, the conductive layer 523, the insulating layer 512, the insulating layer 513, a conductive layer 563*a*, and a conductive layer 563*b*. The conductive layer 522*b* overlaps with the semiconductor layer 561 with the insulating layer 517 positioned therebetween. The conductive layer 523 overlaps with the semiconductor layer 561 with the insulating layers 512 and 513 positioned therebetween. The conductive layer 563*a* and the conductive layer 563*b* are electrically connected to the semiconductor layer 561.

The conductive layer 521*a* functions as a gate. The insulating layer 511 functions as a gate insulating layer. The conductive layer 522*a* functions as one of a source and a drain. The conductive layer 522*b* included in the transistor 586 functions as the other of the source and the drain.

The conductive layer 522*b* shared by the transistor 584 and the transistor 585 has a portion functioning as the other of a source and a drain of the transistor 584 and a portion functioning as a gate of the transistor 585. The insulating layer 517, the insulating layer 512, and the insulating layer 513 function as gate insulating layers. One of the conductive layers 563*a* and 563*b* functions as a source, and the other functions as a drain. The conductive layer 523 functions as a gate.

Configuration Example 3

Figure 19:
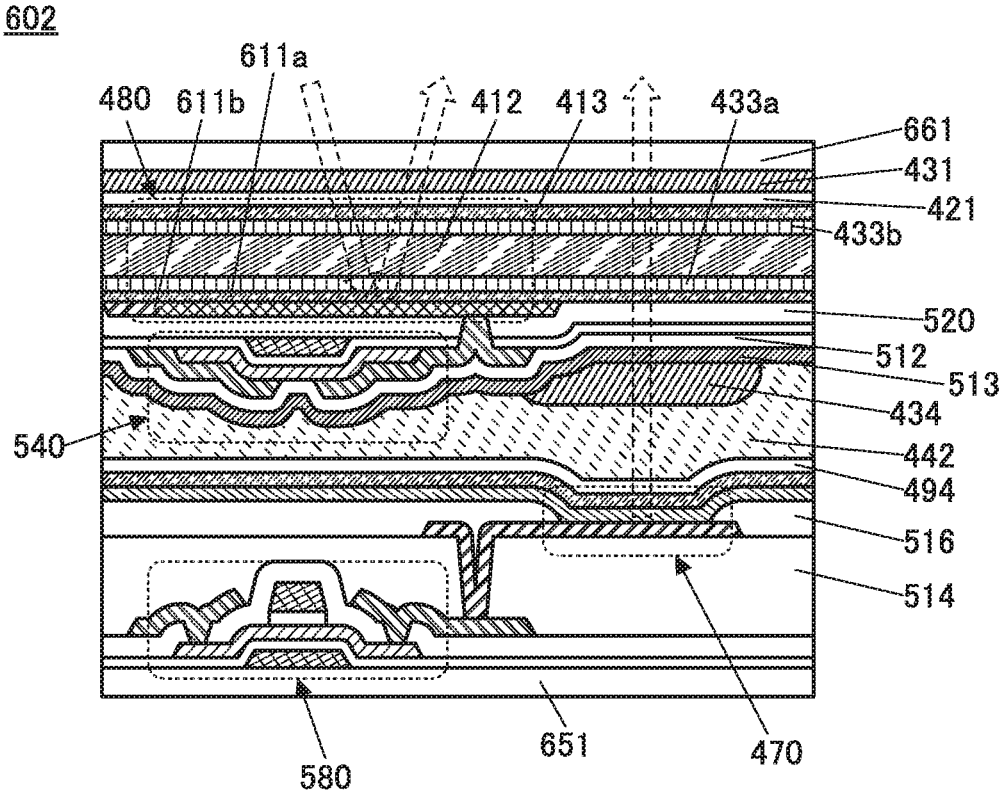
FIG. 19 illustrates a configuration example of a display device.

FIG. 19 is a cross-sectional view illustrating a display portion of a display device 602.

The display device 602 illustrated in FIG. 19 includes a transistor 540, a transistor 580, the liquid crystal element 480, the light-emitting element 470, the insulating layer 520, the coloring layer 431, the coloring layer 434, and the like between the substrate 651 and the substrate 661.

In the liquid crystal element 480, the electrode 611*b* reflects external light to the substrate 661 side. The light-emitting element 470 emits light to the substrate 661 side.

The substrate 661 is provided with the coloring layer 431, the insulating layer 421, the electrode 413 functioning as a common electrode of the liquid crystal element 480, and the alignment film 433*b*.

The liquid crystal layer 412 is provided between the electrode 611*a* and the electrode 413 with the alignment film 433*a* and the alignment film 433*b* positioned therebetween.

The transistor 540 is covered with the insulating layer 512 and the insulating layer 513. The insulating layer 513 and the coloring layer 434 are bonded to the insulating layer 494 with the adhesive layer 442.

In the display device 602, the transistor 540 for driving the liquid crystal element 480 and the transistor 580 for driving the light-emitting element 470 are formed over different planes; thus, each of the transistors can be easily formed using a structure and a material suitable for driving the corresponding display element.

<Configuration Examples of Pixel>

Next, specific configuration examples of a pixel including a plurality of display elements are described with reference to FIGS. 20A and 20B1 to 20B4, FIG. 21, and FIGS. 22A and 22B. Here, as an example, a configuration in which one pixel includes a reflective liquid crystal element and a light-emitting element is described.

Figure 20A:
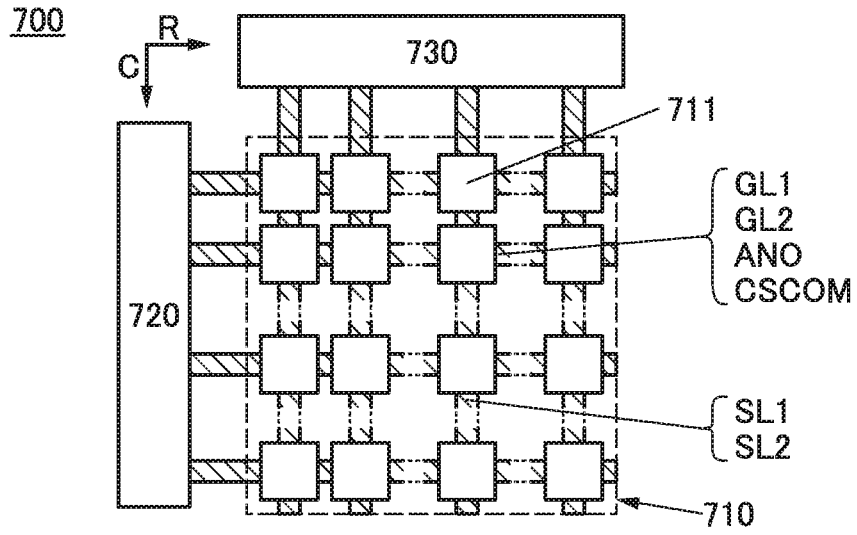
Figure 20A:
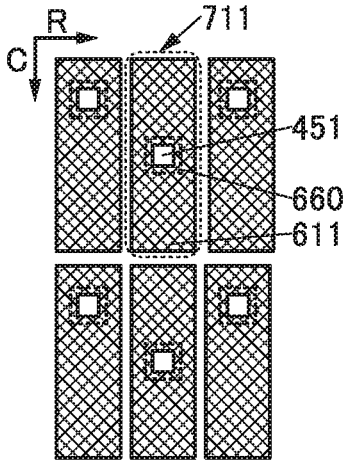
Figure 20A:
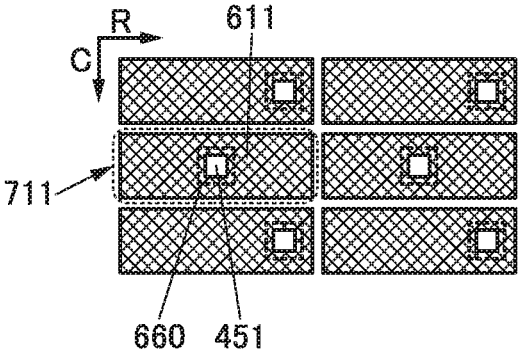
Figure 20A:
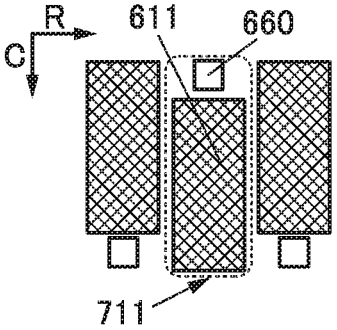
Figure 20A:
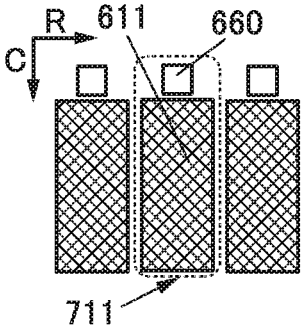

FIG. 20A is a block diagram of a display device 700. The display device 700 includes a pixel portion 710, a driver circuit 720, and a driver circuit 730. The pixel portion 710 includes a plurality of pixels 711 arranged in a matrix. Note that the pixel portion 710, the driver circuit 720, the driver circuit 730, and the pixel 711 correspond to the pixel portion 21, the driver circuit 23, the driver circuit 24, and the pixel 22 in FIG. 5, respectively.

The display device 700 includes a plurality of wirings GL1, a plurality of wirings GL2, a plurality of wirings ANO, a plurality of wirings CSCOM, a plurality of wirings SL1, and a plurality of wirings SL2. The plurality of wirings GL1, the plurality of wirings GL2, the plurality of wirings ANO, and the plurality of wirings CSCOM are each connected to the driver circuit 720 and the plurality of pixels 711 arranged in a direction indicated by an arrow R. The plurality of wirings SL1 and the plurality of wirings SL2 are each connected to the driver circuit 730 and the plurality of pixels 711 arranged in a direction indicated by an arrow C.

The pixel 711 includes a reflective liquid crystal element and a light-emitting element. Note that although a configuration including one driver circuit 720 and one driver circuit 730 is described for simplicity here, the driver circuits 720 and 730 for driving the liquid crystal element and the driver circuits 720 and 730 for driving the light-emitting element may be provided separately.

FIGS. 20B1 to 20B4 illustrate configuration examples of an electrode 611 included in the pixel 711. The electrode 611 serves as a reflective electrode of the liquid crystal element. The opening 451 is provided in the electrode 611 in FIGS. 20B1 and 20B2.

In FIGS. 20B1 and 20B2, a light-emitting element 660 positioned in a region overlapping with the electrode 611 is indicated by a broken line. The light-emitting element 660 overlaps with the opening 451 included in the electrode 611. Thus, light from the light-emitting element 660 is emitted to the display surface side through the opening 451.

In FIG. 20B1, the pixels 711 adjacent in the direction indicated by an arrow R correspond to different emission colors. As illustrated in FIG. 20B1, the openings 451 are preferably provided in different positions in the electrodes 611 so as not to be aligned in the two pixels adjacent to each other in the direction indicated by the arrow R. This allows the two light-emitting elements 660 to be apart from each other, thereby preventing light emitted from the light-emitting element 660 from entering a coloring layer in the adjacent pixel 711 (such a phenomenon is also referred to as crosstalk). Furthermore, since the two adjacent light-emitting elements 660 can be arranged apart from each other, a high-resolution display device can be achieved even when EL layers of the light-emitting elements 660 are separately formed with a shadow mask or the like.

In FIG. 20B2, the pixels 711 adjacent in a direction indicated by an arrow C correspond to different emission colors. Also in FIG. 20B2, the openings 451 are preferably provided in different positions in the electrodes 611 so as not to be aligned in the two pixels adjacent to each other in the direction indicated by the arrow C.

The smaller the ratio of the total area of the opening 451 to the total area except for the opening is, the brighter an image displayed using the liquid crystal element can be. Furthermore, the larger the ratio of the total area of the opening 451 to the total area except for the opening is, the brighter an image displayed using the light-emitting element 660 can be.

The opening 451 may have a polygonal shape, a quadrangular shape, an elliptical shape, a circular shape, a cross-like shape, a stripe shape, a slit-like shape, or a checkered pattern, for example. The opening 451 may be provided close to the adjacent pixel. Preferably, the opening 451 is provided close to another pixel emitting light of the same color, in which case crosstalk can be suppressed.

As illustrated in FIGS. 20B3 and 20B4, a light-emitting region of the light-emitting element 660 may be positioned in a region where the electrode 611 is not provided, in which case light emitted from the light-emitting element 660 is emitted to the display surface side.

In FIG. 20B3, the light-emitting elements 660 are not aligned in the two pixels 711 adjacent in the direction indicated by the arrow R. In FIG. 20B4, the light-emitting elements 660 are aligned in the two pixels adjacent to each other in the direction indicated by the arrow R.

The structure illustrated in FIG. 20B3 can, as mentioned above, prevent crosstalk and increase the resolution because the light-emitting elements 660 included in the two adjacent pixels 711 can be apart from each other. The structure illustrated in FIG. 20B4 can prevent light emitted from the light-emitting element 660 from being blocked by the electrode 611 because the electrode 611 is not positioned along a side of the light-emitting element 660 which is parallel to the direction indicated by the arrow C. Thus, high viewing angle characteristics can be achieved.

Figure 21:
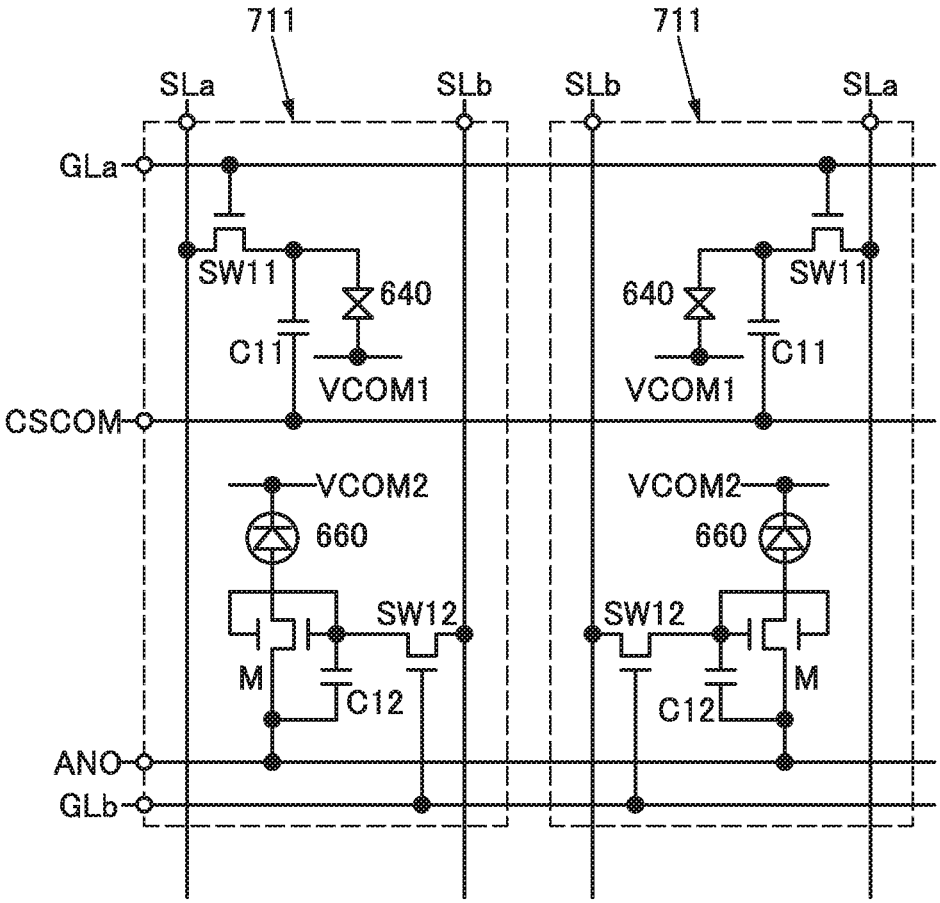
FIG. 21 illustrates a configuration example of a pixel.

FIG. 21 is an example of a circuit diagram of the pixel 711. FIG. 21 illustrates two adjacent pixels 711.

The pixel 711 includes a switch SW11, the capacitor C11, a liquid crystal element 640, a switch SW12, a transistor M, a capacitor C12, and the light-emitting element 660. The wiring GLa, the wiring GLb, a wiring ANO, a wiring CSCOM, the wiring SLa, and the wiring SLb are connected to the pixel 711. FIG. 21 illustrates a wiring VCOM1 connected to the liquid crystal element 640 and a wiring VCOM2 connected to the light-emitting element 660.

FIG. 21 illustrates an example in which a transistor is used as each of the switches SW11 and SW12.

A gate of the switch SW11 is connected to the wiring GLa. One of a source and a drain of the switch SW11 is connected to the wiring SLa, and the other of the source and the drain is connected to one electrode of the capacitor C11 and one electrode of the liquid crystal element 640. The other electrode of the capacitor C11 is connected to the wiring CSCOM. The other electrode of the liquid crystal element 640 is connected to the wiring VCOM1.

A gate of the switch SW12 is connected to the wiring GLb. One of a source and a drain of the switch SW12 is connected to the wiring SLb, and the other of the source and the drain is connected to one electrode of the capacitor C12 and a gate of the transistor M. The other electrode of the capacitor C12 is connected to one of a source and a drain of the transistor M and the wiring ANO. The other of the source and the drain of the transistor M is connected to one electrode of the light-emitting element 660. The other electrode of the light-emitting element 660 is connected to the wiring VCOM2.

FIG. 21 illustrates an example in which the transistor M includes two gates between which a semiconductor is provided and which are connected to each other. This structure can increase the amount of current flowing through the transistor M.

A predetermined potential can be supplied to each of the wirings VCOM1 and CSCOM.

The wiring VCOM2 and the wiring ANO can be supplied with potentials having a difference large enough to make the light-emitting element 660 emit light.

In the pixel 711 of FIG. 21, for example, an image can be displayed in a reflective mode by driving the pixel with the signals supplied to the wiring GLa and the wiring SLa and utilizing the optical modulation of the liquid crystal element 640. In the case where an image is displayed in a transmissive mode, the pixel is driven with the signals supplied to the wiring GLb and the wiring SLb and the light-emitting element 660 emits light. In the case where both modes are performed at the same time, the pixel can be driven with the signals supplied to the wirings GLa, GLb, SLa, and SLb.

The switches SW11 and SW12 have a function of controlling the selection/non-selection state of the pixel 711. As the switches SW11 and SW12, OS transistors are preferably used. With the use of the OS transistors, an image signal can be held in the pixel 711 for an extremely long time; thus, a gray level displayed by the pixel 711 can be maintained for a long time.

Figure 22A:
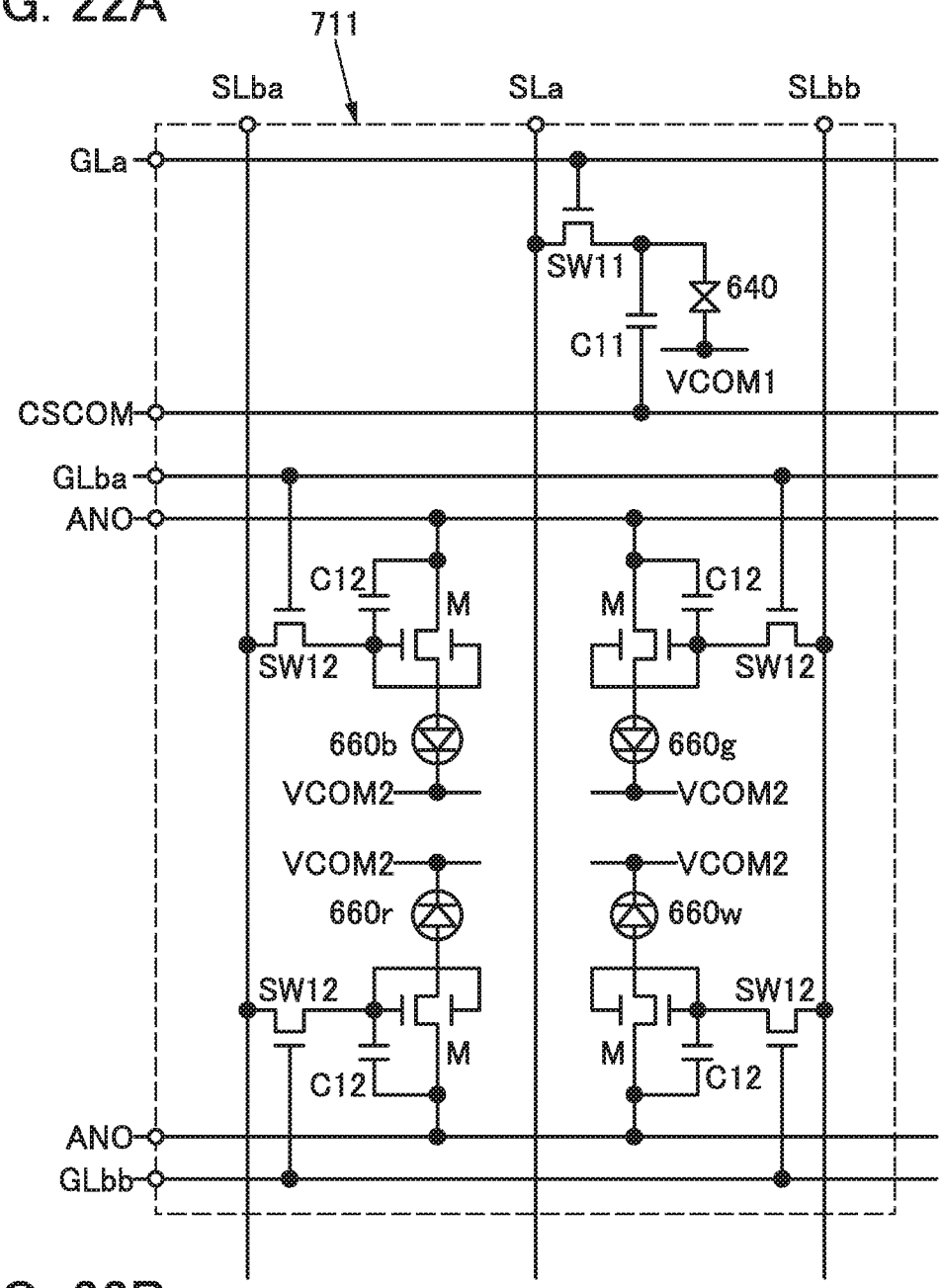
FIGS. 22A and 22B illustrate a configuration example of a pixel.

Although FIG. 21 illustrates an example in which one liquid crystal element 640 and one light-emitting element 660 are provided in one pixel 711, one embodiment of the present invention is not limited thereto. FIG. 22A illustrates an example in which one liquid crystal element 640 and four light-emitting elements 660 (light-emitting elements 660*r*, 660*g*, 660*b*, and 660*w*) are provided in one pixel 711. Unlike the pixel 711 in FIG. 21, the pixel 711 in FIG. 22A allows full-color display using light-emitting elements by one pixel.

In FIG. 22A, a wiring GLba, a wiring GLbb, a wiring SLba, and a wiring SLbb are connected to the pixel 711.

In the example in FIG. 22A, light-emitting elements emitting red light (R), green light (G), blue light (B), and white light (W) can be used as the four light-emitting elements 660, for example. Furthermore, as the liquid crystal element 640, a reflective liquid crystal element emitting white light can be used. Thus, in the case of performing display in the reflective mode, white display with high reflectivity can be performed. In the case of performing display in the transmissive mode, an image can be displayed with a higher color rendering property at low power consumption.

Figure 22B:
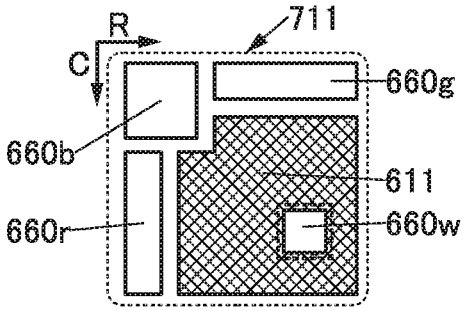

FIG. 22B illustrates a configuration example of the pixel 711 corresponding to FIG. 22A. The pixel 711 includes the light-emitting element 660*w* overlapping with the opening included in the electrode 611 as well as the light-emitting element 660*r*, the light-emitting element 660*g*, and the light-emitting element 660*b* which are provided around the electrode 611. It is preferable that the light-emitting elements 660*r*, 660*g*, and 660*b* have almost the same light-emitting area.

This embodiment can be combined with any of the other embodiments as appropriate.

Embodiment 5

In this embodiment, a configuration example of a display module using any of the display devices described in the above embodiments is described.

Figure 23:
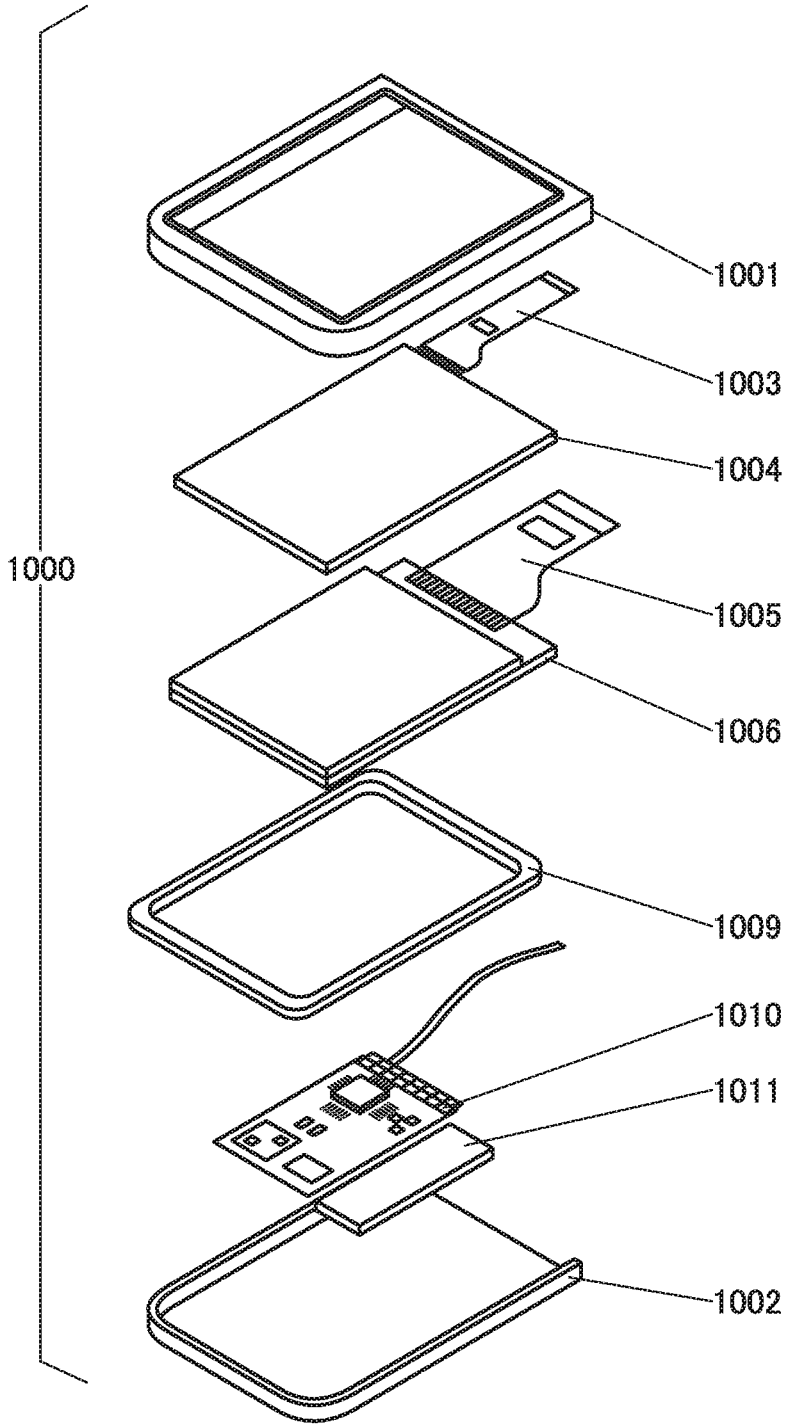
FIG. 23 illustrates a configuration example of a display module.

In a display module 1000 illustrated in FIG. 23, a touch panel 1004 connected to an FPC 1003, a display device 1006 connected to an FPC 1005, a frame 1009, a printed circuit board 1010, and a battery 1011 are provided between an upper cover 1001 and a lower cover 1002.

The display device described in the above embodiment can be used as the display device 1006.

The shapes and sizes of the upper cover 1001 and the lower cover 1002 can be changed as appropriate in accordance with the sizes of the touch panel 1004 and the display device 1006.

The touch panel 1004 can be a resistive touch panel or a capacitive touch panel and may be formed to overlap with the display device 1006. Instead of providing the touch panel 1004, the display device 1006 can have a touch panel function.

The frame 1009 protects the display device 1006 and also functions as an electromagnetic shield for blocking electromagnetic waves generated by the operation of the printed circuit board 1010. The frame 1009 may function as a radiator plate.

The printed circuit board 1010 is provided with a power supply circuit and a signal processing circuit for outputting a video signal and a clock signal. As a power source for supplying power to the power supply circuit, an external commercial power source or a power source using the battery 1011 provided separately may be used. The battery 1011 can be omitted in the case of using a commercial power source.

The display module 1000 may be additionally provided with a member such as a polarizing plate, a retardation plate, or a prism sheet.

This embodiment can be combined with any of the other embodiments as appropriate.

Embodiment 6

In this embodiment, a configuration example of the driver portion 30 in the above embodiments is described. Here, as an example, a configuration example of the driver portion 30 having a function of controlling the operation of the display portion 20 including pixels each including a plurality of display elements is described.

Figure 24:
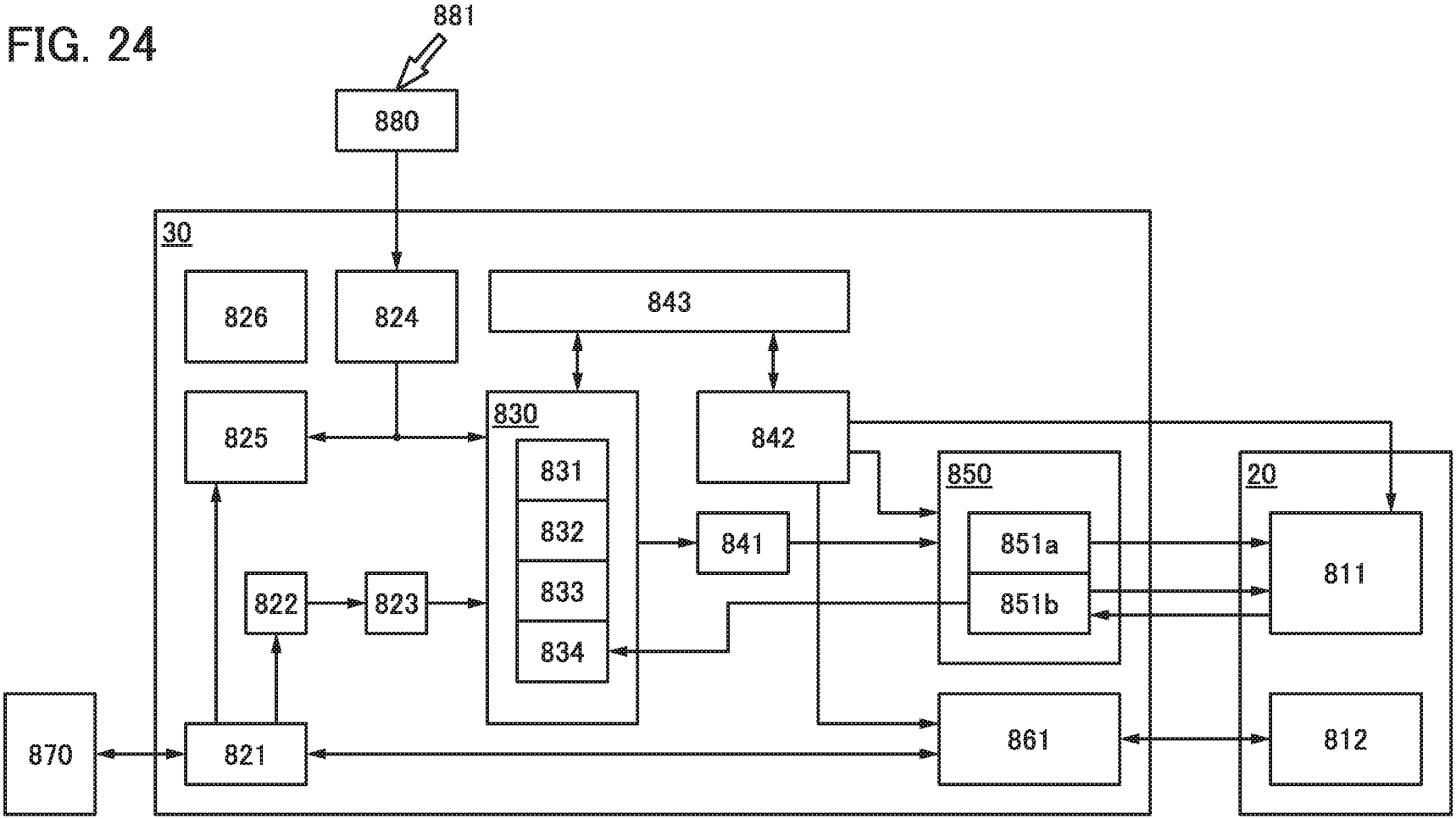
FIG. 24 illustrates a configuration example of a driver portion.

FIG. 24 illustrates a configuration example of the driver portion 30 having a function of controlling the operation of the display portion 20. The driver portion 30 includes an interface 821, a frame memory 822, a decoder 823, a sensor controller 824, a controller 825, a clock generation circuit 826, an image processing portion 830, a memory device 841, a timing controller 842, a register 843, a driver circuit 850, and a touch sensor controller 861.

The display portion 20 has a function of displaying an image on a display unit 811 using an image signal input from the driver portion 30. In addition, the display portion 20 may include a touch sensor unit 812 having a function of obtaining data on whether touch operation is performed or not, touch position, or the like. In the case where the display portion 20 does not include the touch sensor unit 812, the touch sensor controller 861 can be omitted.

The display unit 811 has a function of performing display using a display element. The display unit 811 corresponds to a unit composed of the pixel portion 21 and the driver circuit 23 in FIG. 5. Here, as an example, a configuration in which the display unit 811 includes a reflective liquid crystal element and a light-emitting element is described.

The driver circuit 850 includes a source driver 851. The source driver 851 is a circuit having a function of supplying an image signal to the display unit 811. In FIG. 24, the driver circuit 850 includes a source driver 851*a* which supplies an image signal to the reflective liquid crystal element and a source driver 851*b* which supplies an image signal to the light-emitting element.

Communication between the driver portion 30 and a host 870 is performed through the interface 821. Image data, various control signals, and the like are transmitted from the host 870 to the driver portion 30. Data on whether touch operation is performed or not, touch position, and the like, which is obtained by the touch sensor controller 861, is transmitted from the driver portion 30 to the host 870. Note that the circuits included in the driver portion 30 are chosen as appropriate depending on the standard of the host 870, the specifications of the display portion 20, and the like. The host 870 corresponds to a processor that controls the operation of the driver portion 30, for example, and can be formed using a central processing unit (CPU), a graphics processing unit (GPU), or the like.

Note that the host 870 can be used as the control portion 40 in FIG. 1. In this case, the signal SR in FIG. 1 is input to the driver portion 30 through the interface 821.

The frame memory 822 is a memory circuit having a function of storing image data input to the driver portion 30. In the case where compressed image data is transmitted from the host 870 to the driver portion 30, the frame memory 822 can store the compressed image data. The decoder 823 is a circuit for decompressing the compressed image data. When decompression of the image data is not needed, processing is not performed in the decoder 823. Note that the decoder 823 can be provided between the frame memory 822 and the interface 821.

The image processing portion 830 has a function of performing various kinds of image processing on image data input from the frame memory 822 or the decoder 823 and generating an image signal. For example, the image processing portion 830 includes a gamma correction circuit 831, a dimming circuit 832, and a toning circuit 833.

When the source driver 851*b* includes a circuit (current detection circuit) having a function of detecting current flowing through a light-emitting element, an EL correction circuit 834 may be provided in the image processing portion 830. The EL correction circuit 834 has a function of adjusting the luminance of the light-emitting element on the basis of a signal transmitted from the current detection circuit.

An image signal generated in the image processing portion 830 is output to the driver circuit 850 through the memory device 841. The memory device 841 has a function of temporarily storing image data. The source drivers 851*a* and 851*b* have a function of performing various kinds of processing on image signals input from the memory device 841 and outputting the signals to the display unit 811.

The timing controller 842 has a function of generating timing signals and the like used in the driver circuit 850, the touch sensor controller 861, and the driver circuit included in the display unit 811.

The touch sensor controller 861 has a function of controlling the operation of the touch sensor unit 812. A signal including touch information detected by the touch sensor unit 812 is processed in the touch sensor controller 861 and transmitted to the host 870 via the interface 821. The host 870 generates image data reflecting the touch information and transmits the image data to the driver portion 30. The driver portion 30 may have a function of reflecting the touch information in the image data. The touch sensor controller 861 may be provided in the touch sensor unit 812.

The clock generation circuit 826 has a function of generating a clock signal used in the driver portion 30. The controller 825 has a function of processing a variety of control signals transmitted from the host 870 through the interface 821 and controlling a variety of circuits in the driver portion 30. The controller 825 also has a function of controlling power supply to the variety of circuits in the driver portion 30. For example, the controller 825 can temporarily interrupt the power supply to a circuit that is not driven.

The register 843 has a function of storing data used for the operation of the control portion 30. Examples of the data stored in the register 843 include a parameter used to perform correction processing in the image processing portion 830 and parameters used to generate waveforms of a variety of timing signals in the timing controller 842. The register 843 can be formed using a scan chain register including a plurality of registers.

A parameter used in the timing controller 842 is changed on the basis of the signal SR in FIG. 1, whereby the refresh rate of an image displayed on the display portion 20 can be changed.

The sensor controller 824 connected to a photosensor 880 can be provided in the driver portion 30. The photosensor 880 has a function of sensing external light 881 and generating a sensing signal. The sensor controller 824 has a function of generating a control signal on the basis of the sensing signal. The control signal generated in the sensor controller 824 is output to the controller 825, for example.

The image processing portion 830 has a function of separately generating an image signal supplied to the reflective liquid crystal element and an image signal supplied to the light-emitting element. In that case, the reflection intensity of the reflective liquid crystal element and the emission intensity of the light-emitting element can be adjusted in response to the brightness of the external light 881 measured using the photosensor 880 and the sensor controller 824. Here, the adjustment can be referred to as dimming or dimming treatment. In addition, a circuit that performs the dimming treatment is referred to as a dimming circuit.

The image processing portion 830 may include another processing circuit such as an RGB-RGBW conversion circuit depending on the specifications of the display portion 20. The RGB-RGBW conversion circuit has a function of converting image data of red, green, and blue (RGB) into image signals of red, green, blue, and white (RGBW). That is, in the case where the display portion 20 includes pixels of four colors of RGBW, power consumption can be reduced by displaying a white (W) component in the image data using the white (W) pixel. Note that in the case where the display portion 20 includes pixels of four colors of RGBY, an RGB-RGBY (red, green, blue, and yellow) conversion circuit can be used, for example.

This embodiment can be combined with any of the other embodiments as appropriate.

Embodiment 7

In this embodiment, a configuration example of an OS transistor that can be used in the above embodiment is described.

Configuration Example of Transistor

Configuration Example 1

Figure 25A:
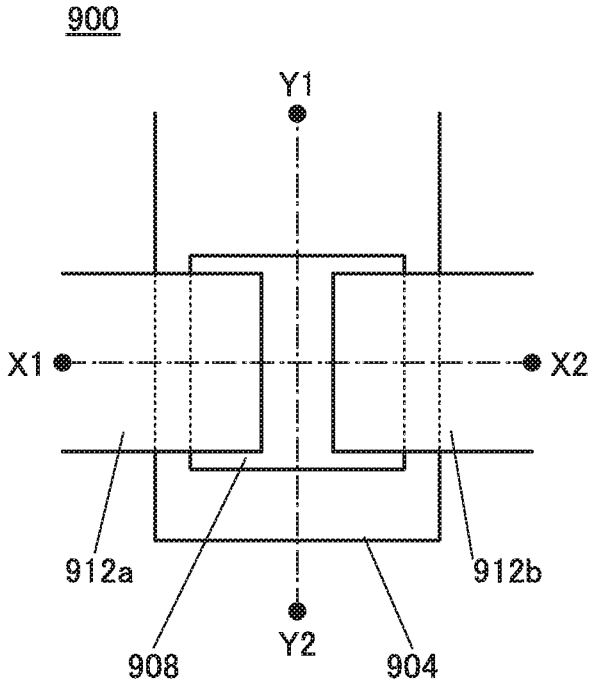
FIGS. 25A to 25D illustrate a configuration example of a transistor.

FIG. 25A is a top view of a transistor 900. FIG. 25C is a cross-sectional view taken along line X1-X2 in FIG. 25A. FIG. 25D is a cross-sectional view taken along line Y1-Y2 in FIG. 25A. Note that in FIG. 25A, some components of the transistor 900 (e.g., an insulating film serving as a gate insulating film) are not illustrated to avoid complexity. In some cases, the direction of line X1-X2 is referred to as a channel length direction and the direction of line Y1-Y2 is referred to as a channel width direction. As in FIG. 25A, some components are not illustrated in some cases in top views of transistors described below.

The transistor 900 includes a conductive film 904 functioning as a gate electrode over a substrate 902, an insulating film 906 over the substrate 902 and the conductive film 904, an insulating film 907 over the insulating film 906, a metal oxide film 908 over the insulating film 907, a conductive film 912*a* functioning as a source electrode connected to the metal oxide film 908, and a conductive film 912*b* functioning as a drain electrode connected to the metal oxide film 908. Over the transistor 900, specifically, over the conductive films 912*a* and 912*b* and the metal oxide film 908, an insulating film 914, an insulating film 916, and an insulating film 918 are provided. The insulating films 914, 916, and 918 function as a protective insulating film for the transistor 900.

The metal oxide film 908 includes a first metal oxide film 908*a* on the conductive film 904 side functioning as a gate electrode and a second metal oxide film 908*b* over the first metal oxide film 908*a*. The insulating films 906 and 907 function as a gate insulating film of the transistor 900.

An In-M oxide (M is Ti, Ga, Sn, Y, Zr, La, Ce, Nd, or Hf) or an In-M-Zn oxide can be used for the metal oxide film 908. It is particularly preferable to use an In-M-Zn oxide for the metal oxide film 908.

The first metal oxide film 908*a* includes a first region in which the atomic proportion of In is larger than the atomic proportion of M The second metal oxide film 908*b* includes a second region in which the atomic proportion of In is smaller than that in the first metal oxide film 908*a*. The second region includes a portion thinner than the first region.

The first metal oxide film 908*a* including the first region in which the atomic proportion of In is larger than that of M can increase the field-effect mobility (also simply referred to as mobility or μFE) of the transistor 900. Specifically, the field-effect mobility of the transistor 900 can exceed 10 $cm^2/Vs$.

For example, the use of the transistor with high field-effect mobility for a driver circuit that generates a selection signal (specifically, a demultiplexer connected to an output terminal of a shift register included in the driver circuit) allows a semiconductor device or a display device to have a narrow frame.

On the other hand, the first metal oxide film 908*a* including the first region in which the atomic proportion of In is larger than that of M makes it easier to change electrical characteristics of the transistor 900 in light irradiation in some cases. However, in the semiconductor device of one embodiment of the present invention, the second metal oxide film 908*b* is formed over the first metal oxide film 908*a*. In addition, the thickness of a channel formation region in the second metal oxide film 908*b* is smaller than the thickness of the first metal oxide film 908*a*.

Furthermore, the second metal oxide film 908*b* includes the second region in which the atomic proportion of In is smaller than that in the first metal oxide film 908*a* and thus has larger Eg than the first metal oxide film 908*a*. For this reason, the metal oxide film 908 that is a layered structure of the first metal oxide film 908*a* and the second metal oxide film 908*b* has high resistance to a negative bias stress test with light irradiation.

The amount of light absorbed by the metal oxide film 908 with the above structure can be reduced during light irradiation. As a result, the change in electrical characteristics of the transistor 900 due to light irradiation can be reduced. In the semiconductor device of one embodiment of the present invention, the insulating film 914 or the insulating film 916 includes excess oxygen. This structure can further reduce the change in electrical characteristics of the transistor 900 due to light irradiation.

Here, the metal oxide film 908 is described in detail with reference to FIG. 25B.

Figure 25B:
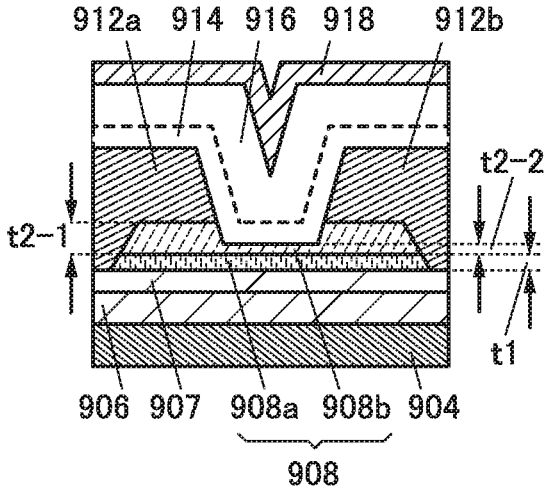
Figure 25C:
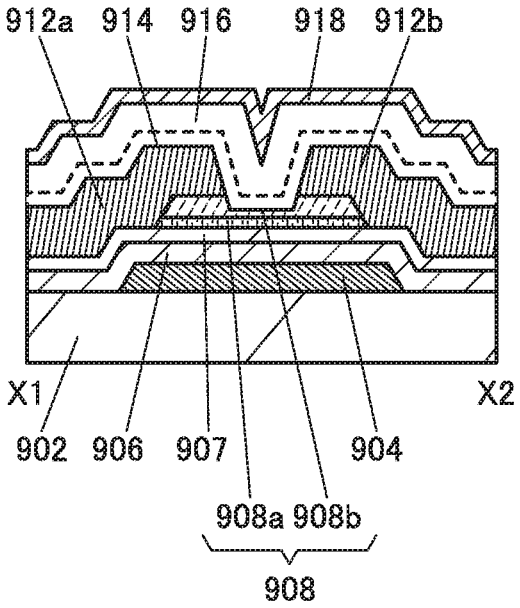
Figure 25D:
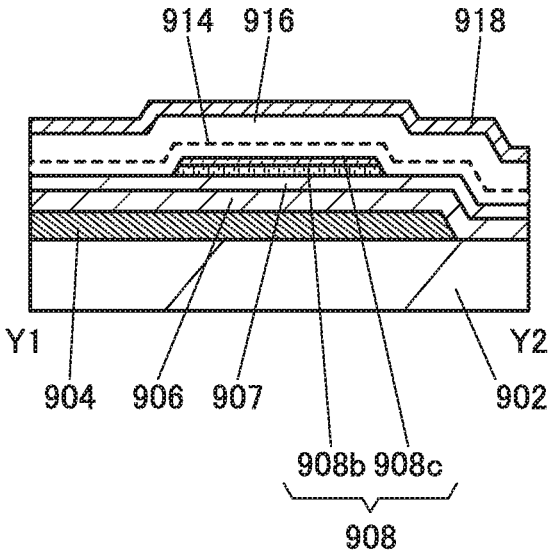

FIG. 25B is an enlarged cross-sectional view of the metal oxide film 908 and the vicinity thereof in the transistor 900 illustrated in FIG. 25C.

In FIG. 25B, t1, t2-1, and t2-2 denote a thickness of the first metal oxide film 908*a*, one thickness of the second metal oxide film 908*b*, and the other thickness of the second metal oxide film 908*b*, respectively. The second metal oxide film 908*b* over the first metal oxide film 908*a* prevents the first metal oxide film 908*a* from being exposed to an etching gas, an etchant, or the like when the conductive films 912*a* and 912*b* are formed. This is why the first metal oxide film 908*a* is not or is hardly reduced in thickness. In contrast, in the second metal oxide film 908*b*, a portion not overlapping with the conductive films 912*a* and 912*b* is etched by formation of the conductive films 912*a* and 912*b*, so that a depression is formed in the etched region. In other words, a thickness of the second metal oxide film 908*b* in a region overlapping with the conductive films 912*a* and 912*b* is t2-1, and a thickness of the second metal oxide film 908*b* in a region not overlapping with the conductive films 912*a* and 912*b* is t2-2.

As for the relationships between the thicknesses of the first metal oxide film 908*a* and the second metal oxide film 908*b*, t2-1>t1>t2-2 is preferable. A transistor with the thickness relationships can have high field-effect mobility and less variation in threshold voltage in light irradiation.

When oxygen vacancies are formed in the metal oxide film 908 included in the transistor 900, electrons serving as carriers are generated; as a result, the transistor 900 tends to be normally-on. Therefore, for stable transistor characteristics, it is important to reduce oxygen vacancies in the metal oxide film 908, particularly oxygen vacancies in the first metal oxide film 908*a*. In the structure of the transistor of one embodiment of the present invention, excess oxygen is introduced into an insulating film over the metal oxide film 908, here, the insulating film 914 and/or the insulating film 916 over the metal oxide film 908, whereby oxygen is moved from the insulating film 914 and/or the insulating film 916 to the metal oxide film 908 to fill oxygen vacancies in the metal oxide film 908, particularly in the first metal oxide film 908*a*.

Note that it is preferable that the insulating films 914 and 916 each include a region (oxygen excess region) including oxygen in excess of that in the stoichiometric composition. In other words, the insulating films 914 and 916 are insulating films capable of releasing oxygen. Note that the oxygen excess region is formed in the insulating films 914 and 916 in such a manner that oxygen is introduced into the insulating films 914 and 916 after the deposition, for example. Oxygen can be introduced by an ion implantation method, an ion doping method, a plasma immersion ion implantation method, plasma treatment, or the like.

In order to fill oxygen vacancies in the first metal oxide film 908*a*, the thickness of the portion including the channel formation region and the vicinity of the channel formation region in the second metal oxide film 908*b* is preferably small, and t2-2<t1 is preferably satisfied. For example, the thickness of the portion including the channel formation region and the vicinity of the channel formation region in the second metal oxide film 908*b* is preferably greater than or equal to 1 nm and less than or equal to 20 nm, further preferably greater than or equal to 3 nm and less than or equal to 10 nm.

Configuration Example 2

Figure 26A:
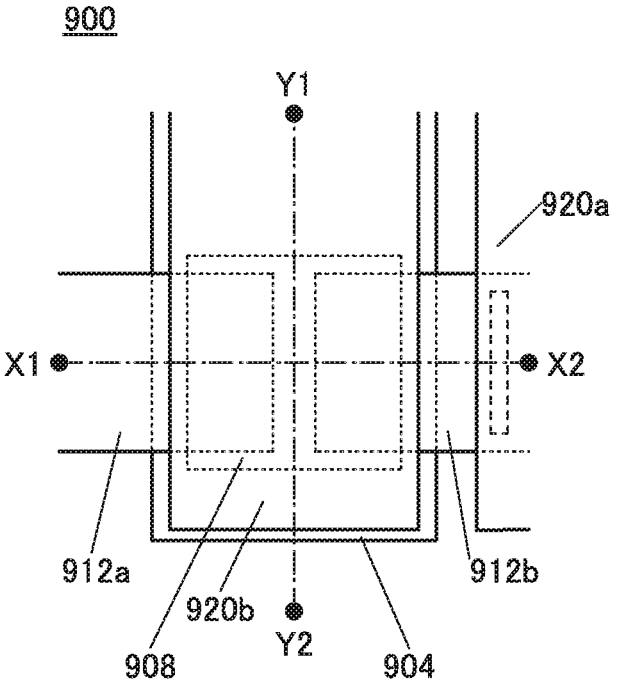
FIGS. 26A to 26C illustrate a configuration example of a transistor.
Figure 26B:
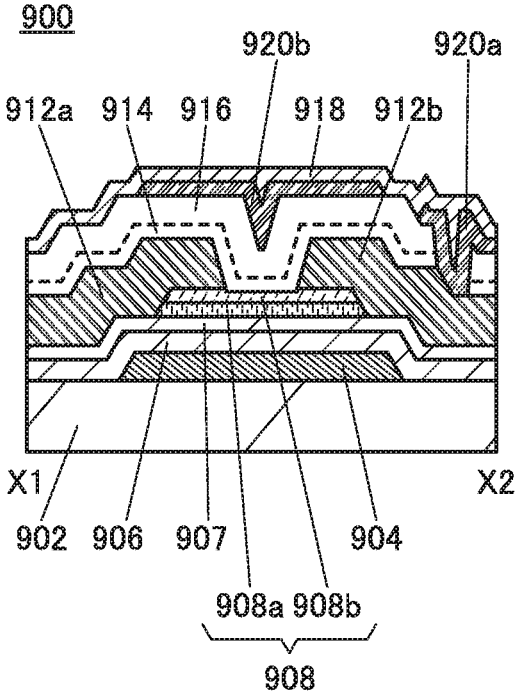
Figure 26C:
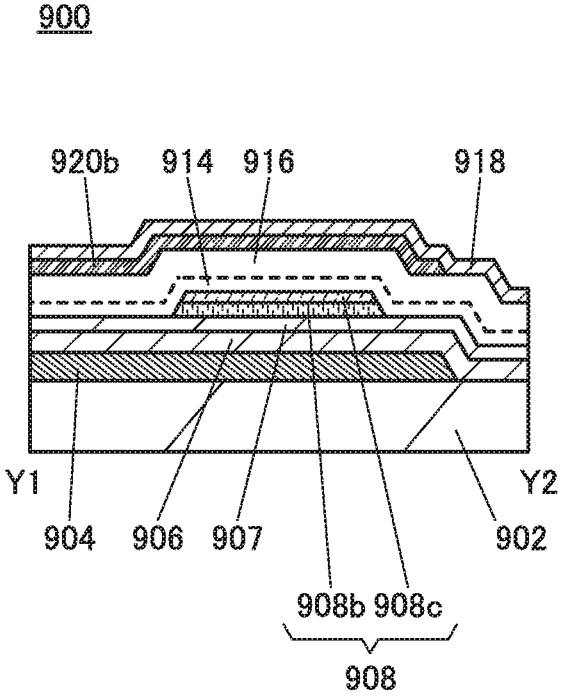

FIGS. 26A to 26C illustrate another configuration example of the transistor 900. FIG. 26A is a top view of the transistor 900. FIG. 26B is a cross-sectional view taken along line X1-X2 in FIG. 26A, and FIG. 26C is a cross-sectional view taken along line Y1-Y2 in FIG. 26A.

The transistor 900 includes the conductive film 904 functioning as a first gate electrode over the substrate 902, the insulating film 906 over the substrate 902 and the conductive film 904, the insulating film 907 over the insulating film 906, the metal oxide film 908 over the insulating film 907, the conductive film 912*a* functioning as the source electrode electrically connected to the metal oxide film 908, the conductive film 912*b* functioning as the drain electrode electrically connected to the metal oxide film 908, the insulating films 914 and 916 over the metal oxide film 908 and the conductive films 912*a* and 912*b*, a conductive film 920*a* that is over the insulating film 916 and electrically connected to the conductive film 912*b*, a conductive film 920*b* over the insulating film 916, and the insulating film 918 over the insulating film 916 and the conductive films 920*a* and 920*b*.

The conductive film 920*b* can be used as a second gate electrode of the transistor 900. In the case where the transistor 900 is used in a display portion of an input/output device, the conductive film 920*a* can be used as an electrode of a display element, or the like.

The conductive film 920*a* functioning as a conductive film and the conductive film 920*b* functioning as the second gate electrode each include a metal element that is the same as that included in the metal oxide film 908. For example, the conductive film 920*b* functioning as the second gate electrode and the metal oxide film 908 include the same metal element; thus, the manufacturing cost can be reduced.

For example, in the case where the conductive film 920*a* functioning as a conductive film and the conductive film 920*b* functioning as the second gate electrode each include In-M-Zn oxide, the atomic ratio of metal elements in a sputtering target used for forming the In-M-Zn oxide preferably satisfies In≥M. The atomic ratio of metal elements in such a sputtering target is, for example, In:M:Zn=2:1:3, In:M:Zn=3:1:2, or In:M:Zn=4:2:4.1.

The conductive film 920*a* functioning as a conductive film and the conductive film 920*b* functioning as the second gate electrode can each have a single-layer structure or a stacked-layer structure of two or more layers. Note that in the case where the conductive film 920*a* and the conductive film 920*b* each have a stacked-layer structure, the composition of the sputtering target is not limited to that described above.

In a step of forming the conductive films 920*a* and 920*b*, the conductive films 920*a* and 920*b* serve as a protective film for suppressing release of oxygen from the insulating films 914 and 916. The conductive films 920*a* and 920*b* serve as semiconductors before a step of forming the insulating film 918 and serve as conductors after the step of forming the insulating film 918.

Oxygen vacancies are formed in the conductive films 920*a* and 920*b*, and hydrogen is added from the insulating film 918 to the oxygen vacancies, whereby a donor level is formed in the vicinity of the conduction band. As a result, the conductivity of each of the conductive films 920*a* and 920*b* is increased, so that the conductive films 920*a* and 920*b* become conductors. The conductive films 920*a* and 920*b* having become conductors can each be referred to as an oxide conductor. Oxide semiconductors generally have a visible light transmitting property because of their large energy gap. An oxide conductor is an oxide semiconductor having a donor level in the vicinity of the conduction band. Therefore, the influence of absorption due to the donor level is small in an oxide conductor, and an oxide conductor has a visible light transmitting property comparable to that of an oxide semiconductor.

<Metal Oxide>

Next, a metal oxide that can be used in the OS transistor is described. In particular, the details of a metal oxide and a cloud-aligned composite (CAC)-OS are described below.

A CAC-OS or a CAC metal oxide has a conducting function in part of the material and has an insulating function in another part of the material; as a whole, the CAC-OS or the CAC metal oxide has a function of a semiconductor. In the case where the CAC-OS or the CAC metal oxide is used in a channel formation region of a transistor, the conducting function is to allow electrons (or holes) serving as carriers to flow, and the insulating function is to not allow electrons serving as carriers to flow. By the complementary action of the conducting function and the insulating function, the CAC-OS or the CAC metal oxide can have a switching function (on/off function). In the CAC-OS or CAC metal oxide, separation of the functions can maximize each function.

The CAC-OS or the CAC metal oxide includes conductive regions and insulating regions. The conductive regions have the above-described conducting function, and the insulating regions have the above-described insulating function. In some cases, the conductive regions and the insulating regions in the material are separated at the nanoparticle level. In some cases, the conductive regions and the insulating regions are unevenly distributed in the material. The conductive regions are observed to be coupled in a cloud-like manner with their boundaries blurred, in some cases.

Furthermore, in the CAC-OS or the CAC metal oxide, the conductive regions and the insulating regions each have a size greater than or equal to 0.5 nm and less than or equal to 10 nm, preferably greater than or equal to 0.5 nm and less than or equal to 3 nm and are dispersed in the material, in some cases.

The CAC-OS or the CAC metal oxide includes components having different bandgaps. For example, the CAC-OS or the CAC metal oxide includes a component having a wide gap due to the insulating region and a component having a narrow gap due to the conductive region. In the case of such a composition, carriers mainly flow in the component having a narrow gap. The component having a narrow gap complements the component having a wide gap, and carriers also flow in the component having a wide gap in conjunction with the component having a narrow gap. Therefore, in the case where the above-described CAC-OS or the CAC metal oxide is used in a channel formation region of a transistor, high current drive capability in the on state of the transistor, that is, a high on-state current and high field-effect mobility, can be obtained.

In other words, the CAC-OS or the CAC metal oxide can be called a matrix composite or a metal matrix composite.

The CAC-OS has, for example, a composition in which elements included in a metal oxide are unevenly distributed. Materials including unevenly distributed elements each have a size of greater than or equal to 0.5 nm and less than or equal to 10 nm, preferably greater than or equal to 1 nm and less than or equal to 2 nm, or a similar size. Note that in the following description of a metal oxide, a state in which one or more metal elements are unevenly distributed and regions including the metal element(s) are mixed is referred to as a mosaic pattern or a patch-like pattern. The regions each have a size greater than or equal to 0.5 nm and less than or equal to 10 nm, preferably greater than or equal to 1 nm and less than or equal to 2 nm, or a similar size.

Note that a metal oxide preferably contains at least indium. In particular, indium and zinc are preferably contained. In addition, one or more of aluminum, gallium, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like may be contained.

For example, of the CAC-OS, an In—Ga—Zn oxide with the CAC composition (such an In—Ga—Zn oxide may be particularly referred to as CAC-IGZO) has a composition in which materials are separated into indium oxide ($InO_{X1}$, where X1 is a real number greater than 0) or indium zinc oxide ($In_{X2}Zn_{Y2}O_{Z2}$, where X2, Y2, and Z2 are real numbers greater than 0), and gallium oxide ($GaO_{X3}$, where X3 is a real number greater than 0) or gallium zinc oxide ($Ga_{X4}Zn_{Y4}O_{Z4}$, where X4, Y4, and Z4 are real numbers greater than 0), and a mosaic pattern is formed. Then, $InO_{X1}$ or $In_{X2}Zn_{Y2}O_{Z2}$ forming the mosaic pattern is evenly distributed in the film. This composition is also referred to as a cloud-like composition.

That is, the CAC-OS is a composite metal oxide with a composition in which a region including $GaO_{X3}$ as a main component and a region including $In_{X2}Zn_{Y2}O_{Z2}$ or $InO_{X1}$ as a main component are mixed. Note that in this specification, for example, when the atomic ratio of In to an element M in a first region is greater than the atomic ratio of In to an element M in a second region, the first region has higher In concentration than the second region.

Note that a compound including In, Ga, Zn, and O is also known as IGZO. Typical examples of IGZO include a crystalline compound represented by $InGaO_3(ZnO)_{m1}$ (m1 is a natural number) and a crystalline compound represented by $In_{(1+x0)}Ga_{(1-x0)}O_3(ZnO)_{m0}$ ($-1 \leq x0 \leq 1$; m0 is a given number).

The above crystalline compounds have a single crystal structure, a polycrystalline structure, or a c-axis-aligned crystalline (CAAC) structure. Note that the CAAC structure is a crystal structure in which a plurality of IGZO nanocrystals have c-axis alignment and are connected in the a-b plane direction without alignment.

On the other hand, the CAC-OS relates to the material composition of a metal oxide. In a material composition of a CAC-OS including In, Ga, Zn, and O, nanoparticle regions including Ga as a main component are observed in part of the CAC-OS and nanoparticle regions including In as a main component are observed in part thereof. These nanoparticle regions are randomly dispersed to form a mosaic pattern. Therefore, the crystal structure is a secondary element for the CAC-OS.

Note that in the CAC-OS, a stacked-layer structure including two or more films with different atomic ratios is not included. For example, a two-layer structure of a film including In as a main component and a film including Ga as a main component is not included.

A boundary between the region including $GaO_{X3}$ as a main component and the region including $In_{X2}Zn_{Y2}O_{Z2}$ or $InO_{X1}$ as a main component is not clearly observed in some cases.

In the case where one or more of aluminum, yttrium, copper, vanadium, beryllium, boron, silicon, titanium, iron, nickel, germanium, zirconium, molybdenum, lanthanum, cerium, neodymium, hafnium, tantalum, tungsten, magnesium, and the like are contained instead of gallium in a CAC-OS, nanoparticle regions including the selected metal element(s) as a main component(s) are observed in part of the CAC-OS and nanoparticle regions including In as a main component are observed in part thereof, and these nanoparticle regions are randomly dispersed to form a mosaic pattern in the CAC-OS.

The CAC-OS can be formed by a sputtering method under conditions where a substrate is not heated intentionally, for example. In the case of forming the CAC-OS by a sputtering method, one or more selected from an inert gas (typically, argon), an oxygen gas, and a nitrogen gas may be used as a deposition gas. The ratio of the flow rate of an oxygen gas to the total flow rate of the deposition gas at the time of deposition is preferably as low as possible, and for example, the flow ratio of an oxygen gas is preferably higher than or equal to 0% and lower than 30%, further preferably higher than or equal to 0% and lower than or equal to 10%.

The CAC-OS is characterized in that no clear peak is observed in measurement using $\theta/2\theta$ scan by an out-of-plane method, which is an X-ray diffraction (XRD) measurement method. That is, X-ray diffraction shows no alignment in the a-b plane direction and the c-axis direction in a measured region.

In an electron diffraction pattern of the CAC-OS which is obtained by irradiation with an electron beam with a probe diameter of 1 nm (also referred to as a nanometer-sized electron beam), a ring-like region with high luminance and a plurality of bright spots in the ring-like region are observed. Therefore, the electron diffraction pattern indicates that the crystal structure of the CAC-OS includes a nanocrystal (nc) structure with no alignment in plan-view and cross-sectional directions.

For example, an energy dispersive X-ray spectroscopy (EDX) mapping image confirms that an In—Ga—Zn oxide with the CAC composition has a structure in which a region including $GaO_{X3}$ as a main component and a region including $In_{X2}Zn_{Y2}O_{Z2}$ or $InO_{X1}$ as a main component are unevenly distributed and mixed.

The CAC-OS has a structure different from that of an IGZO compound in which metal elements are evenly distributed, and has characteristics different from those of the IGZO compound. That is, in the CAC-OS, regions including $GaO_{X3}$ or the like as a main component and regions including $In_{X2}Zn_{Y2}O_{Z2}$ or $InO_{X1}$ as a main component are separated to form a mosaic pattern.

The conductivity of a region including $In_{X2}Zn_{Y2}O_{Z2}$ or $InO_{X1}$ as a main component is higher than that of a region including $GaO_{X3}$ or the like as a main component. In other words, when carriers flow through regions including $In_{X2}Zn_{Y2}O_{Z2}$ or $InO_{X1}$ as a main component, the conductivity of an oxide semiconductor is exhibited. Accordingly, when regions including $In_{X2}Zn_{Y2}O_{Z2}$ or $InO_{X1}$ as a main component are distributed in an oxide semiconductor like a cloud, high field-effect mobility ($\mu$) can be achieved.

In contrast, the insulating property of a region including $GaO_{X3}$ or the like as a main component is higher than that of a region including $In_{X2}Zn_{Y2}O_{Z2}$ or $InO_{X1}$ as a main component. In other words, when regions including $GaO_{X3}$ or the like as a main component are distributed in an oxide semiconductor, leakage current can be suppressed and favorable switching operation can be achieved.

Accordingly, when a CAC-OS is used for a semiconductor element, the insulating property derived from $GaO_{X3}$ or the like and the conductivity derived from $In_{X2}Zn_{Y2}O_{Z2}$ or $InO_{X1}$ complement each other, whereby high on-state current (Ion) and high field-effect mobility ($\mu$) can be achieved.

A semiconductor element including a CAC-OS has high reliability. Thus, the CAC-OS is suitably used in a variety of semiconductor devices.

This embodiment can be combined with any of the other embodiments as appropriate.

Embodiment 8

In this embodiment, examples of an electronic device including the semiconductor device, the display device, the display system, or the display module of one embodiment of the present invention are described.

Figure 27A:
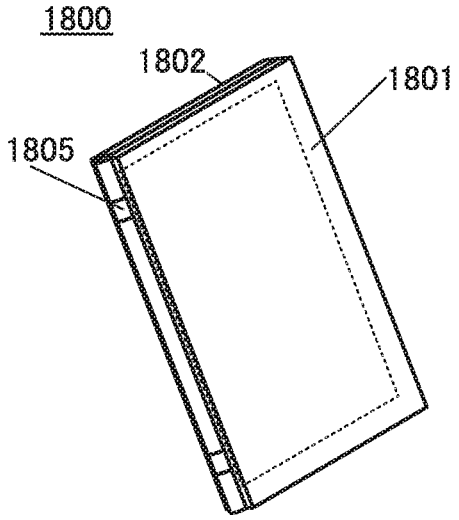
FIGS. 27A to 27D illustrate configuration examples of an electronic device.
Figure 27B:
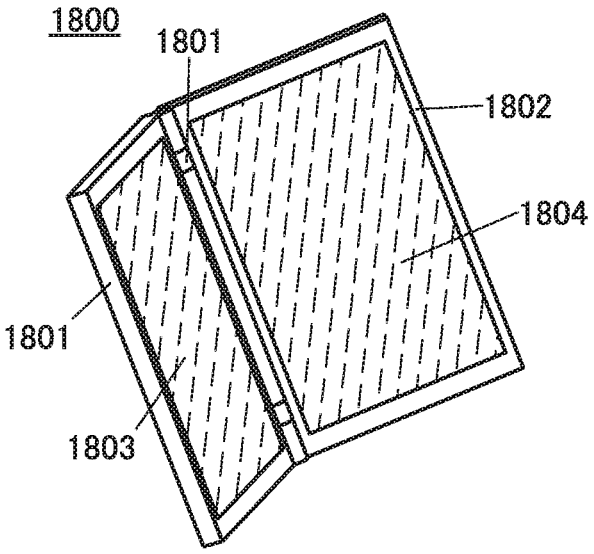

FIGS. 27A and 27B illustrate an example of a portable information terminal 1800. The portable information terminal 1800 includes a housing 1801, a housing 1802, a display portion 1803, a display portion 1804, and a hinge 1805, for example.

The housing 1801 and the housing 1802 are joined together with the hinge 1805. The portable information terminal 1800 folded as illustrated in FIG. 27A can be changed into the state illustrated in FIG. 27B, in which the housing 1801 and the housing 1802 are opened.

For example, text information can be displayed on the display portions 1803 and 1804; thus, the portable information terminal can be used as an e-book reader. Furthermore, still images and moving images can be displayed on the display portions 1803 and 1804.

The portable information terminal 1800 can be folded when being carried, and thus has general versatility.

Note that the housings 1801 and 1802 may have a power button, an operation button, an external connection port, a speaker, a microphone, and the like.

Figure 27C:
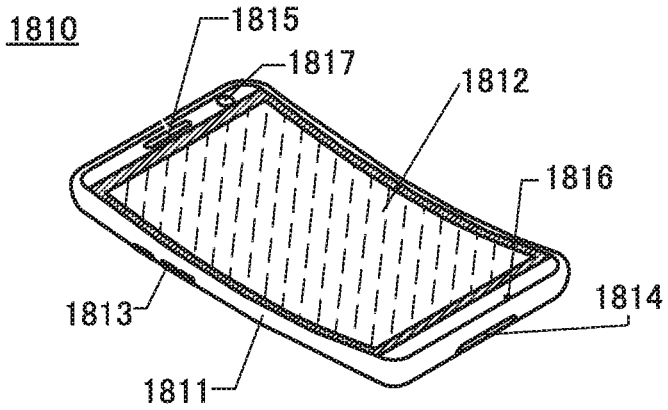

FIG. 27C illustrates an example of a portable information terminal. A portable information terminal 1810 illustrated in FIG. 27C includes a housing 1811, a display portion 1812, operation buttons 1813, an external connection port 1814, a speaker 1815, a microphone 1816, a camera 1817, and the like.

The portable information terminal 1810 includes a touch sensor in the display portion 1812. Operations such as making a call and inputting a letter can be performed by a touch on the display portion 1812 with a finger, a stylus, or the like.

With the operation buttons 1813, power on/off can be switched and types of images displayed on the display portion 1812 can be switched. For example, images can be switched from a mail creation screen to a main menu screen.

When a detection device such as a gyroscope sensor or an acceleration sensor is provided inside the portable information terminal 1810, the direction of display on the screen of the display portion 1812 can be automatically changed by determining the orientation of the portable information terminal 1810 (whether the portable information terminal 1810 is placed horizontally or vertically for a landscape mode or a portrait mode). The direction of display on the screen can also be changed by a touch on the display portion 1812, operation with the operation buttons 1813, sound input using the microphone 1816, or the like.

The portable information terminal 1810 has one or more of a telephone function, a notebook function, an information browsing function, and the like. Specifically, the portable information terminal 1810 can be used as a smartphone. The portable information terminal 1810 is capable of executing a variety of applications such as mobile phone calls, e-mailing, viewing and editing texts, music reproduction, video replay, Internet communication, and games.

Figure 27D:
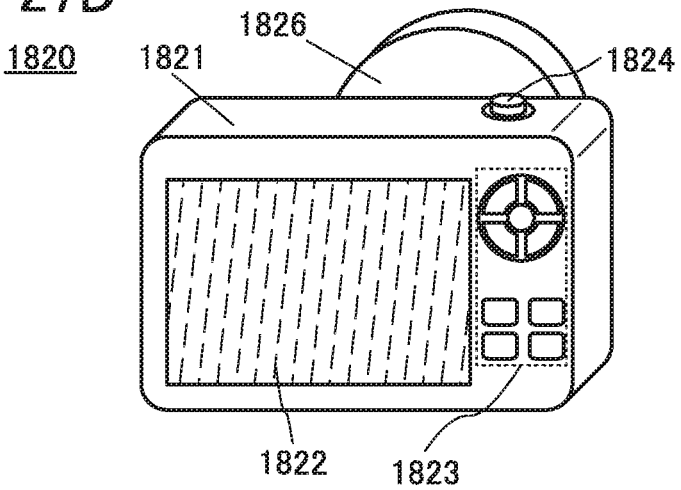

FIG. 27D illustrates an example of a camera. A camera 1820 includes a housing 1821, a display portion 1822, operation buttons 1823, a shutter button 1824, and the like. The camera 1820 is provided with an attachable lens 1826.

Although the lens 1826 of the camera 1820 here is detachable from the housing 1821 for replacement, the lens 1826 may be integrated with the housing 1821.

Still images or moving images can be taken with the camera 1820 by pushing the shutter button 1824. In addition, images can be taken by a touch on the display portion 1822 that serves as a touch panel.

Note that a stroboscope, a viewfinder, or the like can be additionally provided in the camera 1820. Alternatively, these can be incorporated in the housing 1821.

Figure 28A:
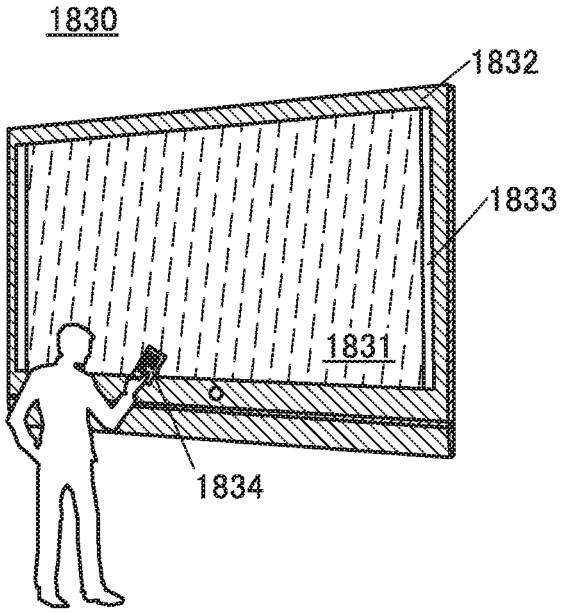
FIGS. 28A to 28C illustrate configuration examples of an electronic device.

FIG. 28A illustrates a television device 1830. The television device 1830 includes a display portion 1831, a housing 1832, a speaker 1833, and the like. The television device 1830 can further include an LED lamp, operation keys (including a power switch or an operation switch), a connection terminal, a variety of sensors, a microphone, and the like.

The television device 1830 can be controlled with a remote controller 1834.

The television device 1830 can receive airwaves such as a ground wave and a wave transmitted from a satellite. The television device 1830 can receive airwaves for analog broadcasting, digital broadcasting, and the like, and image-sound-only broadcasting, sound-only broadcasting, and the like. For example, the television device 1830 can receive airwaves transmitted in a certain frequency band, such as a UHF band (about 300 MHz to 3 GHz) or a VHF band (30 MHz to 300 MHz). When a plurality of pieces of data received in a plurality of frequency bands is used, the transfer rate can be increased and more information can thus be obtained. Accordingly, the display portion 1831 can display an image with a resolution higher than the full high definition, such as 4K2K, 8K4K, 16K8K, or more.

An image to be displayed on the display portion 1831 may be generated using broadcasting data transmitted with technology for transmitting data through a computer network such as the Internet, a local area network (LAN), or Wireless Fidelity (Wi-Fi) (registered trademark). In that case, the television device 1830 does not necessarily include a tuner.

Figure 28B:
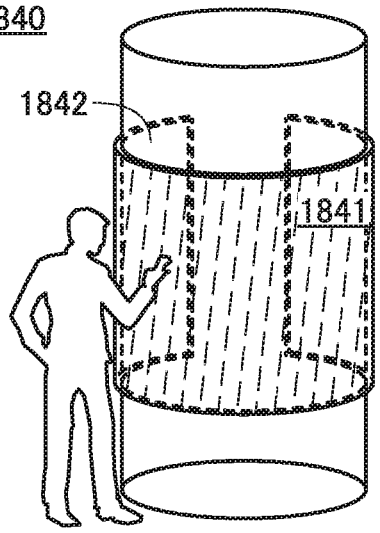

FIG. 28B illustrates a digital signage 1840 mounted on a cylindrical pillar 1842. The digital signage 1840 includes a display portion 1841.

The larger display portion 1841 can provide more information at a time. In addition, a larger display portion 1841 attracts more attention, so that the effectiveness of the advertisement can be increased, for example.

It is preferable to use a touch panel in the display portion 1841 because a device with such a structure does not just display a still or moving image, but can be operated by users intuitively. Alternatively, in the case where the display device of one embodiment of the present invention is used for providing information such as route information or traffic information, usability can be enhanced by intuitive operation.

Figure 28C:
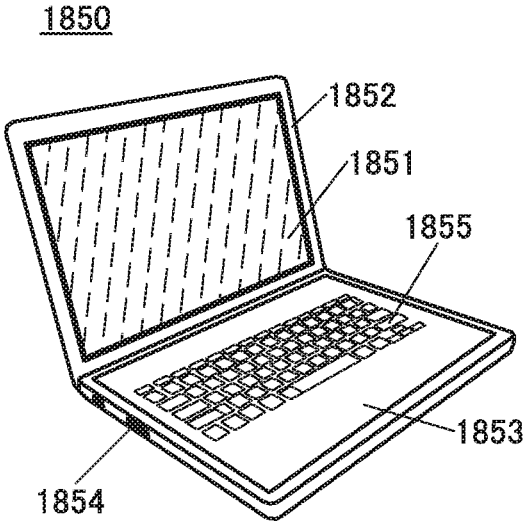

FIG. 28C illustrates a notebook personal computer 1850. The personal computer 1850 includes a display portion 1851, a housing 1852, a touch pad 1853, a connection port 1854, and the like.

The touch pad 1853 functions as an input unit such as a pointing device or a pen tablet and can be controlled with a finger, a stylus, or the like.

Furthermore, a display element is incorporated in the touch pad 1853. As illustrated in FIG. 28C, when an input key 1855 is displayed on a surface of the touch pad 1853, the touch pad 1853 can be used as a keyboard. In that case, a vibration module may be incorporated in the touch pad 1853 so that sense of touch is achieved by vibration when a user touches the input key 1855.

Figure 29A:
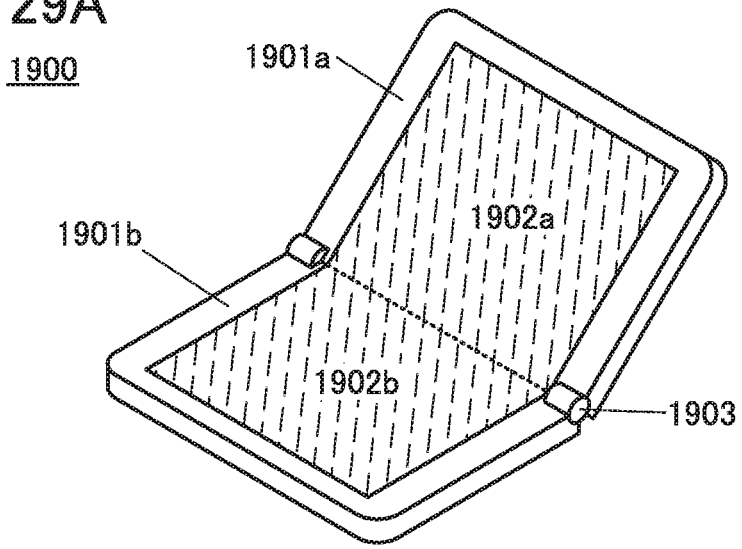
FIGS. 29A to 29C illustrate configuration examples of an electronic device.
Figure 29B:
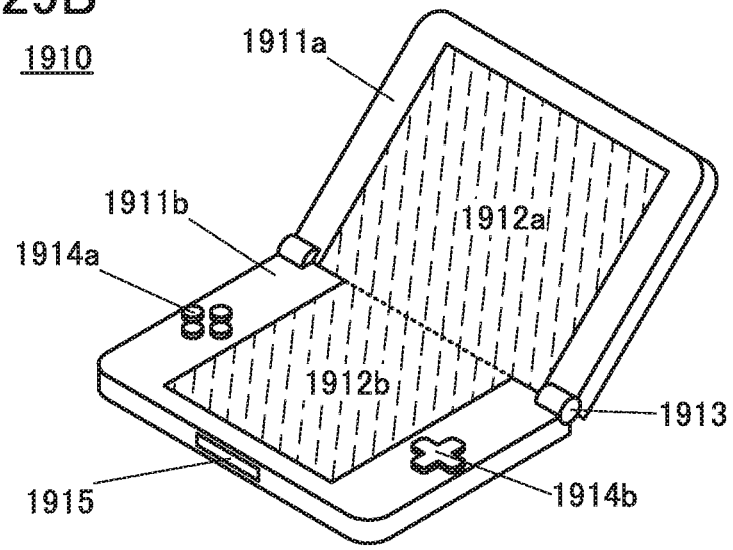
Figure 29C:
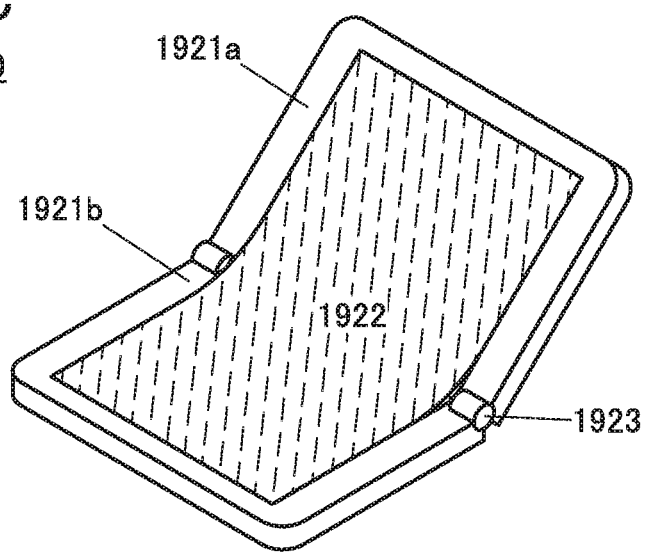

FIGS. 29A to 29C illustrate foldable electronic devices.

An electronic device 1900 illustrated in FIG. 29A includes a housing 1901*a*, a housing 1901*b*, a hinge 1903, a display portion 1902*a*, a display portion 1902*b*, and the like. The display portion 1902*a* and the display portion 1902*b* are incorporated in the housing 1901*a* and the housing 1901*b*, respectively.

The housing 1901*a* and the housing 1901*b* are rotatably joined to each other by the hinge 1903. The electronic device 1900 can be changed in shape between a state where the housing 1901*a* and the housing 1901*b* are closed and a state where the housing 1901*a* and the housing 1901*b* are opened as illustrated in FIG. 29A. Thus, the electronic device 1900 has high portability when carried and excellent visibility when used because of its large display region.

The hinge 1903 preferably includes a locking mechanism so that an angle formed between the housing 1901*a* and the housing 1901*b* does not become larger than a predetermined angle when the housing 1901*a* and the housing 1901*b* are opened. For example, an angle at which they become locked (they are not opened any further) can be preferably greater than or equal to 90° and less than 180° and is typically 90°, 120°, 135°, 150°, or the like. In that case, the convenience, the safety, and the reliability can be improved.

At least one of the display portion 1902*a* and the display portion 1902*b* can function as a touch panel and be controlled with a finger, a stylus, or the like.

Either of the housing 1901*a* and the housing 1901*b* is provided with a wireless communication module, and data can be transmitted and received through a computer network such as the Internet, a LAN, or Wi-Fi (registered trademark).

One flexible display may be incorporated in the display portion 1902*a* and the display portion 1902*b*. In that case, an image can be displayed continuously between the display portion 1902*a* and the display portion 1902*b*.

FIG. 29B illustrates an electronic device 1910 that functions as a portable game console. The electronic device 1910 includes a housing 1911*a*, a housing 1911*b*, a display portion 1912*a*, a display portion 1912*b*, a hinge 1913, an operation button 1914*a*, an operation button 1914*b*, and the like.

A cartridge 1915 can be inserted into the housing 1911*b*. The cartridge 1915 stores application software such as a game, for example, and a variety of applications can be executed on the electronic device 1910 by replacing the cartridge 1915.

FIG. 29B illustrates an example where the display portion 1912*a* and the display portion 1912*b* have different sizes. Specifically, the display portion 1912*a* of the housing 1911*a* is larger than the display portion 1912*b* of the housing 1911*b* where the operation buttons 1914*a* and 1914*b* are provided. For example, the display portions can be used for different purposes by performing display using the display portion 1912*a* as a main screen and the display portion 1912*b* as an operation screen.

In an electronic device 1920 illustrated in FIG. 29C, a flexible display portion 1922 is provided across a housing 1921*a* and a housing 1921*b* which are joined to each other by a hinge 1923.

At least part of the display portion 1922 can be bent. The display portion 1922 can display an image while being bent display since pixels are continuously arranged from the housing 1921*a* to the housing 1921*b*.

Since the hinge 1923 includes the above-described locking mechanism, excessive force is not applied to the display portion 1922; thus, breakage of the display portion 1922 can be prevented. Consequently, a highly reliable electronic device can be obtained.

The electronic devices illustrated in FIGS. 27A to 27D, FIGS. 28A to 28C, and FIGS. 29A to 29C can each incorporate the control portion 40 that controls a refresh rate of an image displayed on the display portion and is described in the above embodiments. Thus, the display system of one embodiment of the present invention can be mounted on any of the electronic devices. In this case, an interface such as the operation button, the speaker, the microphone, the touch sensor, the shutter button, or the touch pad in FIGS. 27A to 27D, FIGS. 28A to 28C, and FIGS. 29A to 29C can be used as the input portion 50 in FIG. 1.

This embodiment can be combined with any of the other embodiments as appropriate.

REFERENCE NUMERALS

10: display system, 20: display portion, 21: pixel portion, 22: pixel, 23: driver circuit, 24: driver circuit, 30: driver portion, 40: control portion, 50: input portion, 60: controller, 61: output portion, 62: output portion, 63: analysis device, 70: counter, 80: memory device, 81: cell array, 82: memory cell, 83: driver circuit, 84: driver circuit, 110: light-emitting element, 120: liquid crystal element, 412: liquid crystal layer, 413: electrode, 417: insulating layer, 421: insulating layer, 431: coloring layer, 432: light-blocking layer, 433: alignment film, 434: coloring layer, 434: coloring layer, 435: polarizing plate, 441: adhesive layer, 442: adhesive layer, 451: opening, 470: light-emitting layer, 480: liquid crystal element, 481: external light, 491: electrode, 492: EL layer, 493: electrode, 494: insulating layer, 501: transistor, 503: transistor, 504: connection portion, 505: transistor, 506: transistor, 507: connection portion, 511: insulating layer, 512: insulating layer, 513: insulating layer, 514: insulating layer, 516: insulating layer, 517: insulating layer, 520: insulating layer, 521: conductive layer, 522: conductive layer, 523: conductive layer, 531: semiconductor layer, 540: transistor, 542: connection layer, 543: connector, 552: connection portion, 561: semiconductor layer, 563: conductive layer, 580: transistor, 581: transistor, 584: transistor, 585: transistor, 586: transistor, 600: display device, 601: display device, 602: display device, 611: electrode, 640: liquid crystal element, 651: substrate, 660: light-emitting element, 661: substrate, 662: display portion, 664: circuit, 665: wiring, 672: FPC, 673: IC, 700: display device, 710: pixel portion, 711: pixel, 720: driver circuit, 730: driver circuit, 811: display unit, 812: touch sensor unit, 821: interface, 822: frame memory, 823: decoder, 824: sensor controller, 825: controller, 826: clock generation circuit, 830: image processing portion, 831: gamma correction circuit, 832: dimming circuit, 833: toning circuit, 834: EL correction circuit, 841: memory device, 842: timing controller, 843: register, 850: driver circuit, 851: source driver, 861: touch sensor controller, 870: host, 880: photosensor, 881: external light, 900: transistor, 902: substrate, 904: conductive film, 906: insulating film, 907: insulating film, 908: metal oxide film, 912: conductive film, 914: insulating film, 916: insulating film, 918: insulating film, 920: conductive film, 1000: display module, 1001: upper cover, 1002: lower cover, 1003: FPC, 1004: touch panel, 1005: FPC, 1006: display device, 1009: frame, 1010: printed circuit board, 1011: battery, 1800: portable information terminal, 1801: housing, 1802: housing, 1803: display portion, 1804: display portion, 1805: hinge, 1810: portable information terminal, 1811: housing, 1812: display portion, 1813: operation button, 1814: external connection port, 1815: speaker, 1816: microphone, 1817: camera, 1820: camera, 1821: housing, 1822: display portion, 1823: operation button, 1824: shutter button, 1826: lens, 1830: television device, 1831: display portion, 1832: housing, 1833: speaker, 1834: remote controller, 1840: digital signage, 1841: display portion, 1842: pillar, 1850: personal computer, 1851: display portion, 1852: housing, 1853: touch pad, 1854: connection port, 1855: input key, 1900: electronic device, 1901: housing, 1901*a*: housing, 1901*b*: housing, 1902*a*: display portion, 1902*b*: display portion, 1903: hinge, 1910: electronic device, 1911: housing, 1912: display portion, 1913: hinge, 1914: operation button, 1915: cartridge, 1920: electronic device, 1921: housing, 1922: display portion, and 1923: hinge.

This application is based on Japanese Patent Application Serial No. 2016-192889 filed with Japan Patent Office on Sep. 30, 2016, and Japanese Patent Application Serial No. 2017-086898 filed with Japan Patent Office on Apr. 26, 2017, the entire contents of which are hereby incorporated by reference.

The invention claimed is:

1. A display system comprising:

a display portion configured to display an image; and a control portion configured to output a signal for controlling a refresh rate of the image, wherein the control portion comprises a controller and a memory device, wherein the memory device is configured to store data, wherein the data includes first data indicating a recognition state including a first refresh rate and second data on whether or not a flicker is recognized in the recognition state by a user, wherein the controller is configured to change the refresh rate of the image from the first refresh rate to a second refresh rate with reference to the data stored in the memory device when third data is input to the control portion, wherein the third data indicates that a flicker is recognized in the recognition state including the first refresh rate by the user, wherein the control portion comprises a counter, wherein the counter is configured to count time during which the image is continuously displayed at a specific refresh rate, and wherein the controller is configured to predict a refresh rate at which a flicker is not recognized by comparing the time counted by the counter and the data stored in the memory device.

2. The display system according to claim 1, wherein the first data includes at least one of data indicating a user who recognizes the image, data indicating time during which the image is recognized, and data indicating a content of the image.

3. The display system according to claim 1, wherein the display portion comprises a pixel including a first display element and a second display element, and wherein a selection/non-selection state of the pixel is controlled by a transistor including a metal oxide in a channel formation region.

4. The display system according to claim 1, further comprising:

an input portion configured to detect the third data and output the third data to the controller.

5. An electronic device comprising:

the display system according to claim 4, wherein as the input portion, an operation button, a touch sensor, a speaker, or a microphone is used.

6. A display system comprising:

a display portion configured to display an image; and a control portion comprising a controller, wherein the controller comprises a neural network configured to learn data, wherein the data includes first data indicating a recognition state including a first refresh rate and second data on whether or not a flicker is recognized in the recognition state by a user, wherein the neural network is configured to infer a second refresh rate at which a flicker is not recognized with reference to the data and then calculate the second refresh rate, wherein the neural network is configured to output the second refresh rate when third data is input to the neural network, and wherein the third data indicates that a flicker is recognized in the recognition state including the first refresh rate by the user.

7. The display system according to claim 6, wherein the control portion comprises a counter, wherein the counter is configured to count time during which the image is continuously displayed at a specific refresh rate, and wherein the first data includes data indicating the time counted by the counter.

8. The display system according to claim 6, wherein the first data includes at least one of data indicating a user who recognizes the image, data indicating time during which the image is recognized, and data indicating a content of the image.

9. The display system according to claim 6, wherein the display portion comprises a pixel including a first display element and a second display element, and wherein a selection/non-selection state of the pixel is controlled by a transistor including a metal oxide in a channel formation region.

10. The display system according to claim 6, further comprising:

an input portion configured to detect the third data and output the third data to the controller.

11. An electronic device comprising:

the display system according to claim 10, wherein as the input portion, an operation button, a touch sensor, a speaker, or a microphone is used.

12. A display system comprising:

a display portion configured to display an image; and a control portion configured to output a signal for controlling a refresh rate of the image, wherein the control portion comprises a controller and a memory device, wherein the memory device is configured to store data, wherein the controller is configured to change the refresh rate of the image from a first refresh rate to a second refresh rate with reference to the data stored in the memory device when third data is input to the control portion, wherein the third data indicates that whether or not a flicker is recognized in a recognition state including the first refresh rate by a user, wherein the recognition state including the first refresh rate and the third data are stored in the memory device, wherein the control portion comprises a counter, wherein the counter is configured to count time during which the image is continuously displayed at a specific refresh rate, and wherein the controller is configured to predict a refresh rate at which a flicker is not recognized by comparing the time counted by the counter and the data stored in the memory device.

13. The display system according to claim 12, wherein the data includes at least one of data indicating a user who recognizes the image, data indicating time during which the image is recognized, and data indicating a content of the image.

14. The display system according to claim 12, wherein the display portion comprises a pixel including a first display element and a second display element, and wherein a selection/non-selection state of the pixel is controlled by a transistor including a metal oxide in a channel formation region.

15. The display system according to claim 12, further comprising:

an input portion configured to detect the third data and output the third data to the controller.

16. An electronic device comprising:

the display system according to claim 15, wherein as the input portion, an operation button, a touch sensor, a speaker, or a microphone is used.

* * * * *